US005226297A

United States Patent [19]

Manini

[11] Patent Number: 5,226,297

[45] Date of Patent: Jul. 13, 1993

[54] KNITTING MACHINE FOR PRODUCING TIGHTS (PANTIHOSE)

[75] Inventor: Benito Manini, Florence, Italy

[73] Assignee: Lambda S.r.l., Florence, Italy

[21] Appl. No.: 826,847

[22] Filed: Jan. 28, 1992

[30] Foreign Application Priority Data

Jan. 31, 1991 [IT] Italy ..... FI/91/A 26

[51] Int. Cl.[5] ..... D04B 9/46

[52] U.S. Cl. ..... 66/13; 66/8

[58] Field of Search ..... 66/7, 8, 13, 17

[56] References Cited

U.S. PATENT DOCUMENTS 4,221,120 9/1980 Farmer ..... 66/8

FOREIGN PATENT DOCUMENTS 1138883 10/1962 Fed. Rep. of Germany ..... 66/8

821735 12/1937 France ..... 66/8

*Primary Examiner*—Clifford D. Crowder

*Assistant Examiner*—John J. Calvert

*Attorney, Agent, or Firm*—McGlew and Tuttle

[57] ABSTRACT

A knitting machine for producing stocking-knicker products (tights, pantihose) and the like, which has opposite, parallel rectilinear needle beds, a rotatable central unit (22, 16) having its own central vertical shaft (16) and carrying a double rectilinear needle bed central segment (210); two epicyclic units (38, 66) mounted symmetrically on the central unit (22, 16) with shafts (38) offset relative to the central shaft (16), each of the epicyclic units carrying a double rectilinear needle bed (110); along each elongated plate (66), annular guides for carriages (100, 100A) holding textile component parts are adapted to cooperate with the respective double rectilinear needle bed (110) for the knitting of the legs while the central unit (22, 16) is stationary; supplementary guides corresponding to the double needle bed central segment (210) for the purpose of completing the guiding of the carriages (100, 100A) around the two double rectilinear needle beds (110) and the double needle bed central segment (210) when they are in alignment with one another on the central unit, for the knitting of the body by rotation of the central unit.

15 Claims, 60 Drawing Sheets

CP
CV
G
CP
G
112
110
110
112
98
100
100
66
96
G
92
94
92
212
210
110
112
98
120
100
66
96
G

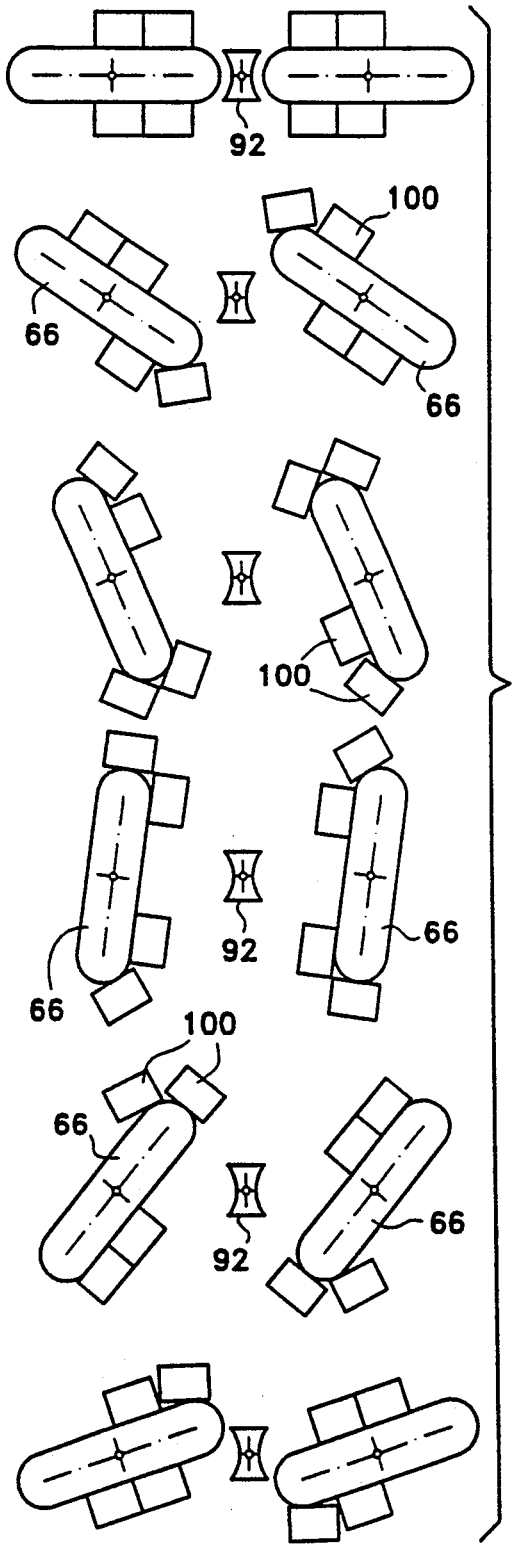
Fig. 10
Fig. 11
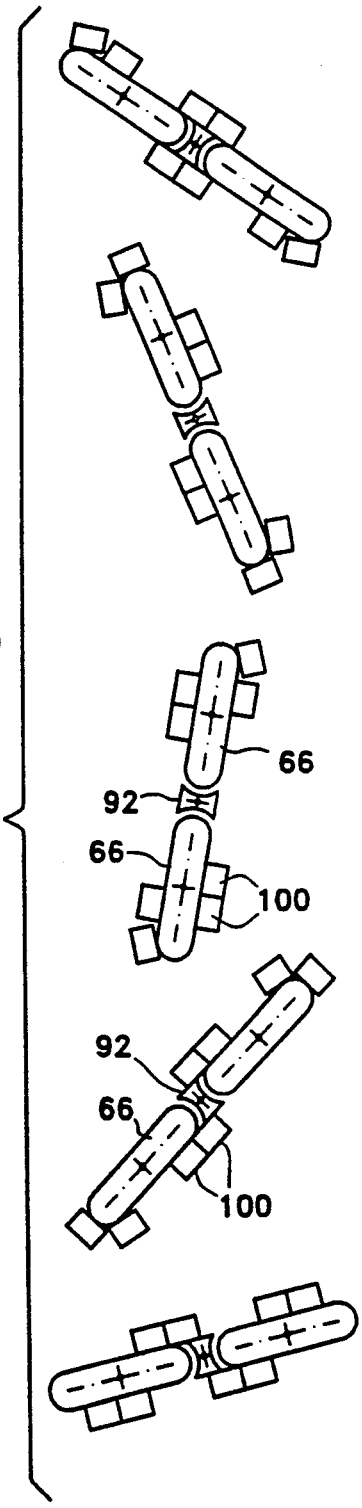

KNITTING MACHINE FOR PRODUCING TIGHTS (PANTIHOSE)

FIELD OF THE INVENTION

The invention is a knitting machine suitable for the complete manufacture of stocking-knicker products (tights, pantihose or the like), which is of a totally new design and able to offer numerous advantages over other machines of that kind. In particular, the machine is of a type which permits the fixed positioning of the yarn feed bobbins, a wide range of selection, and other aims and advantages which will become apparent on perusal of the following text.

SUMMARY OF THE INVENTION

The machine has opposite, parallel rectilinear needle beds, which advantageously are also convergent in the working zone. According to the invention the machine comprises: a rotatable central unit having its own central vertical shaft and carrying a plate having a double rectilinear needle bed central segment; two epicyclic units mounted symmetrically on said central unit with shafts offset relative to the central shaft, each of said epicyclic units carrying an elongated plate having a double rectilinear needle bed; along each elongated plate, annular guide means for carriages holding textile component parts, such as cams and thread guides, adapted to cooperate with the respective double rectilinear needle bed for the knitting of the legs while the central unit is stationary; supplementary guide means corresponding to the double needle bed central segment for the purpose of completing the guiding of said carriages around the two double rectilinear needle beds and the double needle bed central segment when they are in alignment with one another on said central unit, for the knitting of the body by rotation of the entire central unit. The following are also provided: a transmission for the rotation of said central unit and transmissions for the rotation of said epicyclic units; and means for holding the carriages in a substantially fixed position in relation to the rotating epicyclic units and in relation to the rotating central unit.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIGS. 10 and 11 shows two sequences of positions of the needle beds and thread guide carriages during the formatron of the legs and the body respectively;

DETAILED DESCRIPTION OF THE PREFERRED EMBODIMENT

Figure 1:
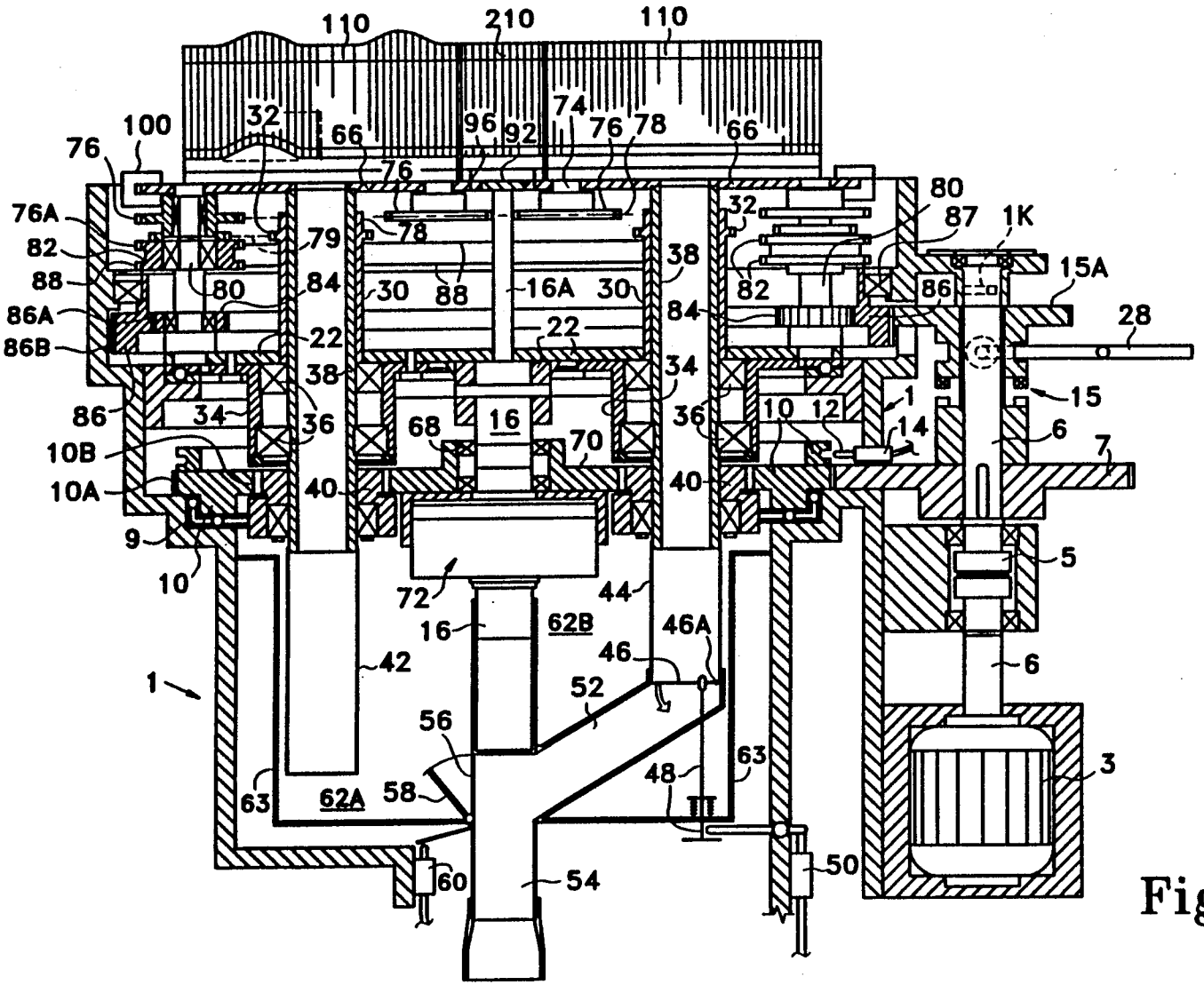
FIG. 1 is a summarily view drawn to a vertical section of a first embodiment of the invention.
Figure 2:
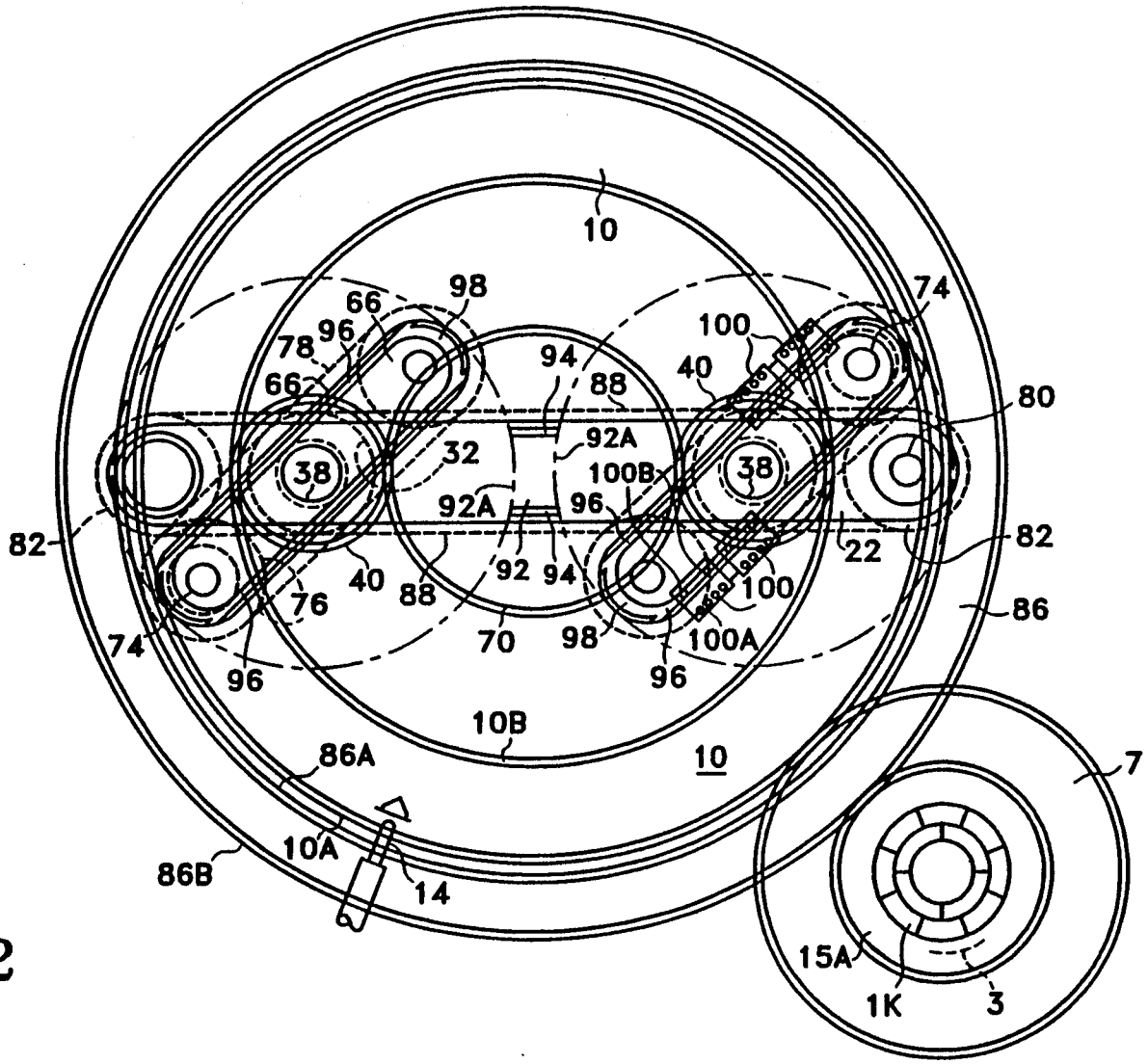
FIG. 2 is a schematic plan view.

In the example illustrated in FIGS. 1 through 13 of the accompanying drawings, 1 designates a main frame of the machine. On the side of the frame 1 is mounted a motor 3 combined with a friction clutch 5 adapted to allow limited slip above a certain resisting torque between the driving part and the driven part. The driven shaft 6 of the clutch 5 carries a gear 7 which partly penetrates into the interior of the frame 1. A ring 10 is mounted for rotation in bearings 9 in the frame 1, and has an external toothed rim 10A meshing with the gear 7, and an internal rim 10B for the purposes indicated below. The ring 10 can be locked by means of a retaining pin 12 mounted on the frame and appropriately controlled by an actuator 14 to permit the locking of the ring 10 or its release for free rotation with the aid of the bearings 9. On an extension of the driven shaft 6 is mounted a slip clutch 15, whose driven part 15A forms a toothed wheel penetrating into the frame 1 to mesh with an external toothed rim 86B, which will be described later on. In the raised position the slip clutch 15 meshes with frontal teeth 1K on a projection on the frame 1 in order to lock said driven part 15A of the clutch 15, and thus to lock the toothed wheel and parts meshing with it. In the center is provided a rotatable pillar 16 mounted in rolling contact bearings on the frame 1; an elongated plate structure 22, which is supported for rotation on the frame 1 by means of radial and axial type bearings 24, is fastened to the pillar 16. The elongated plate 22 with the pillar 16 constitutes a rotating unit which is lockable by means of said frontal teeth 1K under the control of an actuator 28 for the purpose of locking and unlocking the driven part 15A and, consequently, said unit 16, 22. On the unit 16, 22, and particularly on the plate 22 there, are fastened two top sleeves 30, each of which forms at the top a sprocket toothing 32. Two bushes 34 are fastened to the plate 22, coaxially to the sleeves 30 and below said plate 22, and internally contain rolling contact bearings 36 for two respective tubular shafts 38, which extend downward below the bearings 36 and upward above the sleeves 30. Below the bearings 36 the tubular shafts 38 carry planetary gears. 40 which mesh with the internal toothing 10B of the ring 10. Coaxially to and below the tubular shafts 38 are provided on one side a gridded basket 42 closed at the bottom, and on the other side a basket 44 similar to said basket 42 but having an openable bottom 46, which is for example hinged at 46A and which is operated by a link 48 operated by an actuator 50 for purposes which will be explained below; an inclined suction duct 52, forming an offset extension of the basket 44 when the bottom 46 of the latter is open, extends to a central suction and pneumatic conveyor duct 54. The duct has an opening 56 provided with a grid and closable by a door 58 operated by means of an actuator 60; the gridded opening 56 opens toward the zone 62A of a double chamber 62A, 62B divided by a diaphragm (not shown) which forms the grid 56; the double chamber 62A, 62B is defined by a casing 63, in which a substantial vacuum can prevail and which- contains the network baskets 42 and 44. Each of the tubular shafts 38 carries at the top an elongated plate 66, which may be defined as an epicyclic plate permitting the movement which will be indicated later on. The two epicyclic plates 66 are arranged to make angular movements about the axes of the respective shafts 38 in such a manner as to keep the two plates parallel to themselves during the rotation. The casing 63, together with the baskets 42, form part of the unit 16, 22 which is movable in bearings.

A central gear 70 is mounted in bearings 68 on the central pillar 16, on which it is loose. The central gear 70 can be locked in respect of rotation to the pillar 16 by coupling with the aid of a friction clutch 72 adapted to lock the pillar 16 to the gear 70, for the purposes indicated below.

Chain wheels 76, on which a chain 78 is mounted and deflected, are mounted loose on each of the epicyclic plates 66, by means of shafts, 74 disposed at the two ends of each of the plates 66. As chain 79 is on the other hand provided between the chain wheel 32 of the corresponding sleeve 30 and a chain wheel 76A fastened on one of the chain wheels 76. The transmission system 32, 79, 76A is a reduction system.

Two chain wheels 82 (double wheels in the example) are mounted loose by means of shafts 80 on the elongated plate 22, which is fastened to the pillar 16, and are fastened to respective gears 84. The wheels 82 together with the gears 84 are mounted loose on said shafts 80. The gears 84 mesh with an internal toothed rim 86A formed by a ring 86 carried by the frame 1 with the aid of a rolling contact bearing 87 concentric to the axis of the pillar 16. The ring 86 forms an external toothed rim 86B, which meshes with the toothed wheel 15A of the clutch 15. A chain 88 is mounted and deflected on the chain wheels 82, and thus extends along and above the elongated plate 22; the chain 88 lies outside the sleeves 30 and below the two chains 78 and 79, which extend approximately parallel to the chain 88, the latter extending diametrically from the axis of the pillar 16.

The unit 16, 22, of which the pillar 16 and the elongated plate 22 form part, also includes an extension 16A in the upward direction, beyond the plate 22, in order to form a complementary plate member 92, which is at the same level as the elongated epicyclic plates 66 and which has a shape comprising two opposite concave profiles whose center corresponds to the axes of the tubular shafts 38 and therefore of the axes of rotation of the elongated epicyclic plates 66. The top and bottom surfaces of said complementary plate member 92 are provided with two channels 94, shown in FIG. 2, parallel and corresponding to one another on the top and bottom surfaces. These channels 94 are parallel to the elongation of the elongated plate 22.

Each of the elongated epicyclic plates 66 is provided on its top and bottom surfaces with channels 96, which extend parallel to the longitudinal dimensions of the epicyclic plates 66, as far as the ends of the latter. Adjacent to the ends of the plates 66 the channels 66 have arcuate channel-shaped connections 98 wider than the channels 96, for the purposes to be described below.

In substance, the channels 96 together with the connections 98 extend roughly parallel to the same path of the chains 78. When the two epicyclic plates 66 are disposed in alignment with one another and in positions corresponding to the complementary plate member 92, the channels 96 together with the outer connections 98 and the channels 94 follow a path corresponding to that of the chain 88.

The epicyclic plates 66 and complementary plate members 92 are constructed with their respective channels 96, 98 and 94 to guide slide shoes both along the periphery of the epicyclic plates 66 and along the entire periphery of the pair of plates 66 in alignment with one another and supplemented by the complementary member 92. The reference 100 (see in particular FIG. 7) designates these shoes, which may comprise one pair or two or more pairs of shoes disposed side by side for each of the epicyclic plates 66, and therefore for each of the chains 78. The shoes 100 can be coupled alternately to the chains 78 and the chains 88. For this purpose pins 102 and 104 respectively are provided which are lowered and raised by means of compressed air drives designated generically 106 and 108, usually with a positive drive in one direction and a resilient drive in the other direction, or in other appropriate manner. The pins 102 can penetrate into seats formed by blocks 78A fastened to the chains 78, while the pins 104 can penetrate into seats formed by blocks 88A fastened to the chains 88; by alternately operating the pins 102 and 104 the shoes 100 are joined to the chains 78 and 88 respectively. The shoes 100 are slidingly guided (optionally with the intervention of rolling contact means such as balls held and rotating in seats on the carriages) along the channels 96 and the channels 94 and along the connections 98. The engagement of each individual shoe in the channels 96 and connections 98 is achieved geometrically with three points of contact, namely an outer intermediate point of contact 100A and two inner points of contact 100B spaced apart, respectively; the outer contact point 100A cooperates with the periphery of the plates 66, while the inner contact points 100B operate in the channels 96 and connections 98. The arrangement of the contact points 100A and 100B is also such that when the epicyclic plates 66 are in alignment with one another and in positions corresponding to the complementary member 92, the shoes 100 can be guided by the rectilinear channels 96 and by the channels 94 of the complementary member 92. In these circumstances the shoes are driven by the chain 88 with the aid of the pin 104, so that they travel along the plates 66 and the complementary member 92, following the same path as the chains 88. When on the other hand the shoes 100 are joined to the chains 78 by means of pins 102, they travel along the channels 96 and the connections 98, following the same path as each of the chains 78.

The elongated epicyclic plates 66 and the complementary member 92 carry textile component parts of the machine in order to form, in conjunction with other component parts on the two plates 66, the legs of tights or pantihose, while with another assembly of textile component parts mounted on the complementary member 92, in conjunction with the textile components mounted on the plates 66, the body of the tights or pantihose is formed. The work done by the textile component parts mounted on the plates 66 and on the complementary member 92 is completed by the textile component parts which are mounted on the shoes 100, which are operated by the chains 78 for the formation of the legs and by the chains 88 for the formation of the body, all these operations being carried out in the manner to be indicated below.

Figures 3, 4:
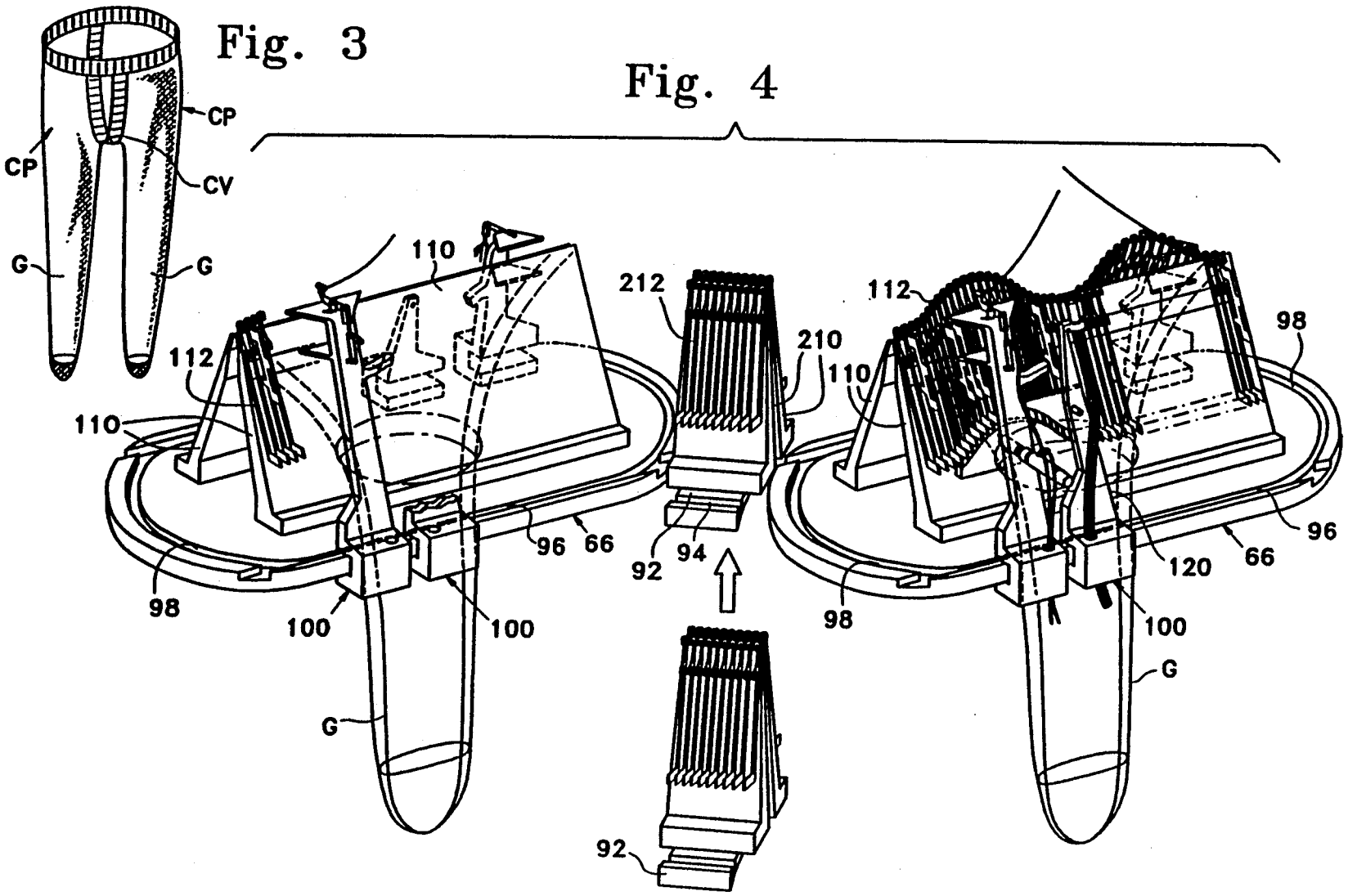
FIG. 3 shows in perspective a manufactured product in order to explain the portions knitted in successive phases.
FIGS. 4 and 5 show, separately in perspective units, with needle beds during the formation of the legs and body respectively.

As shown in FIG. 4, the textile component parts carried by the epicyclic plates 66 comprise two rectilinear needle beds 110 which extend upward toward one another in order to reduce the distance between them in the top zone, where the stitches are formed by the needles 112, which slide in the tricks of the respective needle beds. In the summary illustration shown in FIG. 6, the needles 112 are provided with butts 114 for the control of their sliding. Lifting cams 116 and lowering cams 118 carried by support members 120 extending above the shoes 100 are provided for operating the needles. The reference 122 designates oscillating sinkers which are seated in the needle beds and oscillate on internal projections (FIG. 7) and which are provided with butts 124 and 126 cooperating with cams 128 and 130 carried by the extensions 120 of the shoes 100. The extensions 120 carry profiled members 132 guiding and controlling the latches of the needles. The summarily illustrated thread guides 134 are carried on said extensions 120, and in particular above the profiled needle latch guides 132. The thread guides are insertable and excludable, being oscillatably mounted and operated by summarily illustrated actuators 136. Some of the cams, particularly the lifting cams 116, can be made displaceable for exclusion and insertion by means of actuators 138 which are summarily illustrated. Nozzles 140 for applying suction to the cut threads on the thread guides, which are raised in the exclusion mode, are also summarily illustrated. The nozzles 140 are carried by the extensions 120 and connected to suction ducts 142 passing through the shoes 100. At the side of the thread suction nozzles 140 resistors 144 for cutting the threads, or other means for cutting threads which are about to be excluded from the operation, are disposed.

The component parts described are just some of the knitting component parts provided on the needle beds 110 carried by the elongated epicyclic plates 66. The structure and composition of these knitting devices are, however, known per se and can be produced by known techniques.

The complementary plate member 92 is also provided with two needle bed sections similar to the bed 110, and these also are inclined and converge upwardly, while they are also provided with needles 212 similar to the needles 112 and with sinkers equivalent to the sinkers 122 and mounted, similarly to the latter, on their needle beds 210. The needle bed sections are intended for forming the knitted fabric in the crotch zone of the body, while the needles 112 of the two needle beds 110 are intended for forming the legs of the product manufactured. In FIG. 3 the reference G indicates the legs, which are formed by the needles 112, CP indicates the body, and CV the strip of the body which is formed by the needles 212 along the so-called crotch zone. The manner in which this product is manufactured will be explained below.

It is to be noted that the needle bed sections 210 carried by the complementary plate member 92 project outward from the concave profiles 92A of the complementary member, in such a manner that these needle bed sections 210 are almost brought into contact with the needle beds 110 carried by the epicyclic plates 66 when the latter come into alignment with one another and with the needle bed sections 210. Since an interspace has to be left between the needle beds 110 and the needle beds 210 in order to permit the rotation of the needle beds 110 together with the plates 66 about the axes of the tubular shafts 38, at the ends of the needle bed sections 210 a special needle 212A is provided which has two needle hooks 212B lying side by side instead of the single needle hook of the needles 212 and 112. The offset needle hook of the needle 212A makes it possible to form a stitch even in a position relatively closer to the needle beds 110 than a complete needle 212 could be. The needles 212 and 212A are operated by the same component parts as have already been described and are combined with the shoes 100 in the manner to be indicated below.

It is first made clear that with the arrangement described threads can be fed to the thread guides, such as 134, from fixed supply positions, inasmuch as the combination of the movements to be made is such that the shoes are substantially all held in the same position while either the plates 66, referred to as epicyclic plates, or the elongated plate 22 of the unit 16, 22 rotate. In substance, if the reference RA (FIG. 10) designates generically yarn feed bobbins, these bobbins RA are positioned in an installation fixed relative to the structure of the machine, that is to say relative to the frame 1, while the needle beds are rotatable, namely either as individual needle beds 110 or as single needle beds composed of the needle beds 110, 110 and 210 to form respectively the legs and the body; there will only be free paths of limited oscillation between the fixed thread guides guiding the threads connected to the feed bobbins RA and appropriate eyes guiding the threads to the thread guides 134. The bobbins RA may be disposed above the needle beds which are to be fed, and are arranged as shown in the diagram of FIG. 10.

For the purpose of making the legs G of the product, threads are fed to the corresponding thread guides 134 of the shoes 100, and provision is made for the movement of rotation of the epicyclic plates 66, and therefore of the needle beds 110, about the shafts 38, while the unit 16, 22 comprising the pillar 16 and the plate 22, and also including the complementary plate member 92 and the needle bed sections 110, remains stationary. For this purpose the clutch 15 of the actuator 28 is moved so as to engage in the teeth 1K; the pin 12 together with the actuator 14 is returned from the position in which the ring 10 is locked to a position in which said ring is disconnected. The locking of the plate 22 and of the ring 10 is effected with the aid of rotation by means of the motor 3 and with the intervention of the friction clutch 5, until the starting angular position of the ring 10 and of the plate 22 of the rotating unit 16, 22 is regained; a reference or zero position is consequently first reached, corresponding to the alignment of the needle beds 110, 110 and 210. On commencement of the knitting of the legs with their toes closed, the ring 10 is released through the withdrawal of the pin 12 by means of the actuator 14. At this point the motor 3 together with the gear unit 7 starts to turn the ring 10. The teeth 1K keep the elongated plate 22 locked, and thus also keep the unit 22, 16, and hence the pillar 16 and the complementary plate member 92 as well as the casing 63 and the baskets 42, 44, locked. The friction clutch 72 is freed, and therefore the central gear 70 is free to rotate (in the bearings 68) about the pillar 16. This being the case, the rotary motion of the ring 10 is transmitted to the gears 40, which bring about the rotation of the central gear 70, which is loose. As the gears 40 rotate, they turn the epicyclic plates 66 together with the shafts 38, which rotate about axes which in this phase are stationary because the unit 16, 22 is stationary. Because the plate 22 does not rotate, any movement of the gears 84 meshing with the toothed rim 86A, and consequently of the chain wheels 82 and of the double chain 88, is prevented; the pins 104 are raised from the seats in the blocks 88A, while the pins 102 are inserted into the seats in the blocks 78A; the shoes 100 are consequently connected kinematically to the chains 78 and in particular, in accordance with the drawing, two double shoes 100 are connected to each of the two chains 78. The chains 79 engage with the chain wheels 32 which, together with their sleeves 30, are stationary because of the immobility of the unit 22, 16; on the other hand, the epicyclic plates 66 rotate with their tubular shafts 38 about the axes of said shafts 38; the chain wheels 76, driven by the plates 66 about the axes of the shafts 38, thus "roll" on the chains 78 which are restrained by the chains 79 and by the teeth of the chain wheels 32; in substance, the two chains 79 progressively settle down along the teeth of the two chain wheels 32, while the chain wheels 76 roll epicyclically on the chains 78, holding them stable in position. It follows that the epicyclic plates 66 rotate with the shafts 38 about the axes of the shafts, and the chains 78 follow the respective plates 66 but do not make sliding movements, that is to say they do not make a continuous movement. The result is thus that the chains 78 hold the shoes substantially in the position occupied by them in relation to the fixed frame, and therefore also in relation to the bobbins-RA feeding their thread guides, while the plates 66 and, with them, the needle beds 110 rotate. The needle beds therefore move angularly about the axes of the shafts 38 and with said shafts 38, and the plates 66 slide relative to the shoes 100, which are held by means of the pins 102 by the chains 78 "rolling" on the teeth of the chain wheels 76. In relation to the plates 66 and to the needle beds 110 the shoes 100 make a complete stroke along the channels 96, 98, and through this relative movement operate the needles and bring about the formation of the courses of continuous circumferential, or rather helical, stitches, the number of such courses being one or two depending on whether there are one or two pairs of shoes 100 connected to the chain wheels 78. FIGS. 10 and 11 show various successive positions which are assumed by the epicyclic plates 66 rotating with the tubular shafts 38 about the axes of said shafts, while the shoes are held definitely on the same path in relation to the fixed structure, so that feeding from stationary bobbins RA is possible. During this series of rotations of the epicyclic plates 66 the legs G of the manufactured product are formed, while the complementary plate member 92 remains stationary together with the unit 16, 22. The shoes 100 will be disposed in such a manner that they do not come into the zones of the channels 98 when the latter pass in front of the concave profiles 92A of the complementary plate member 92. There is therefore no interference between the shoes 100 and the complementary plate member 92.

Figure 5:
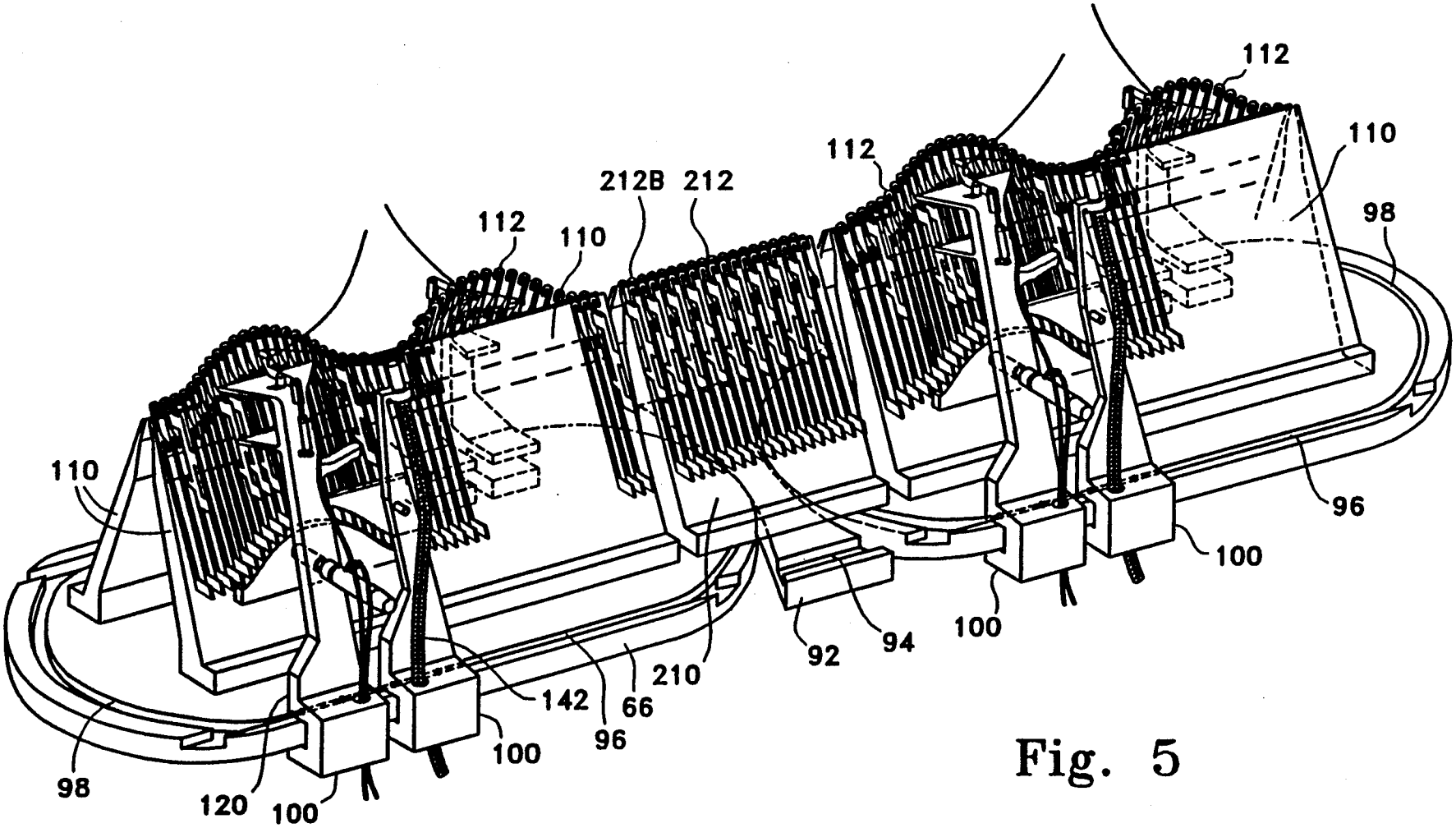
Figure 6:
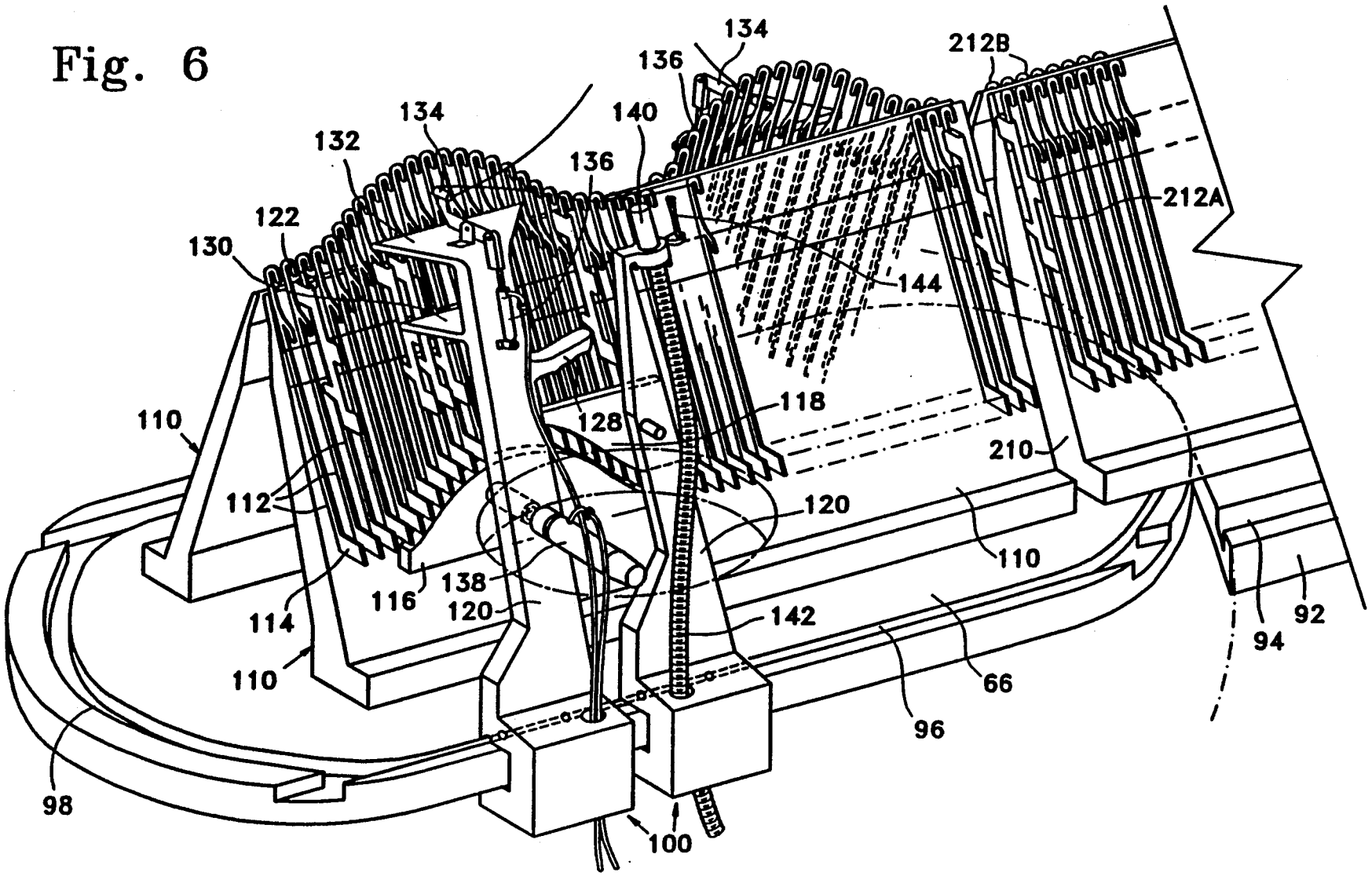
FIG. 6 shows an enlargement of part of FIG. 5.
Figure 7:
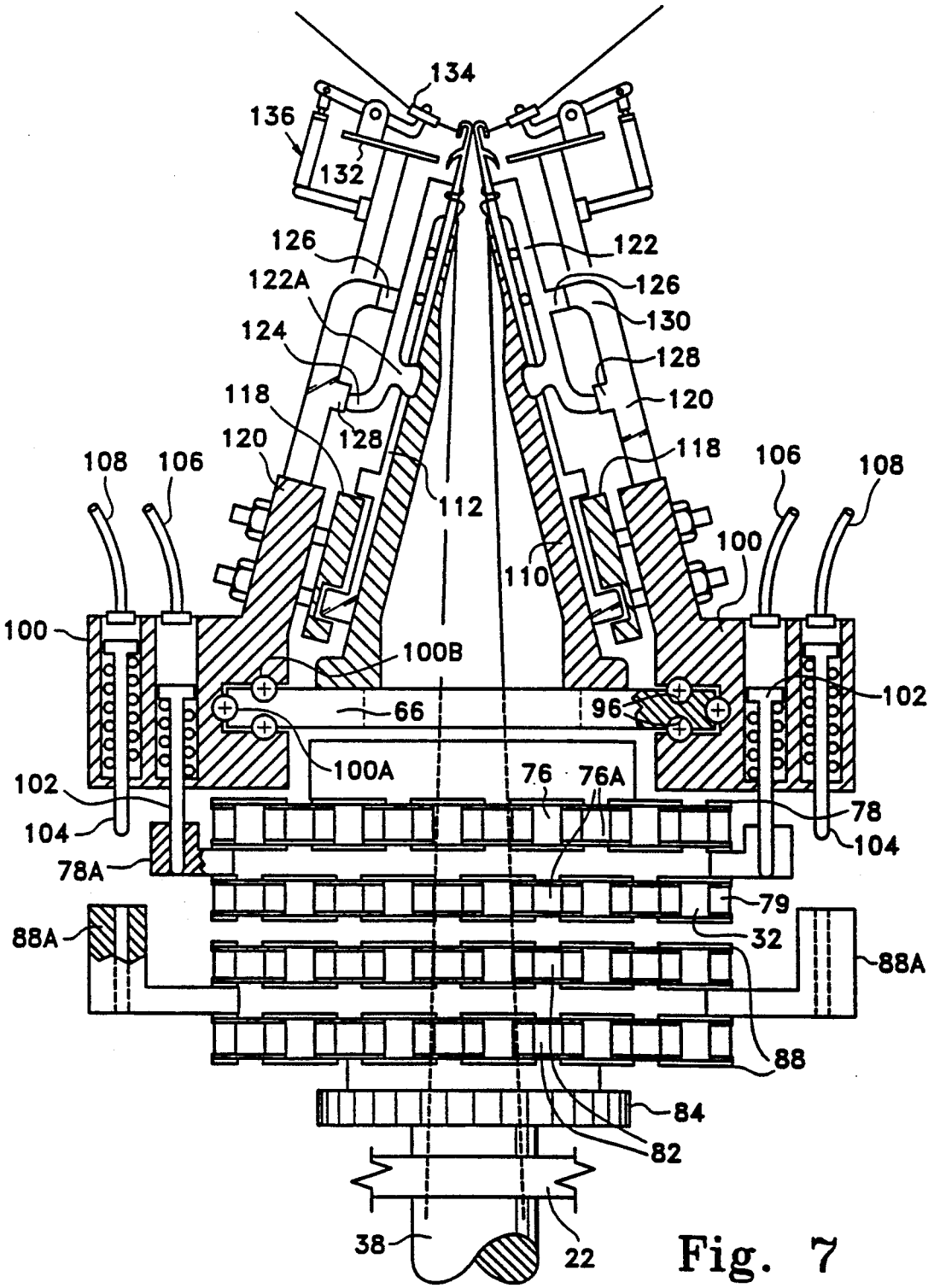
FIG. 7 is a vertical cross-section of the needle beds.
Figure 8:
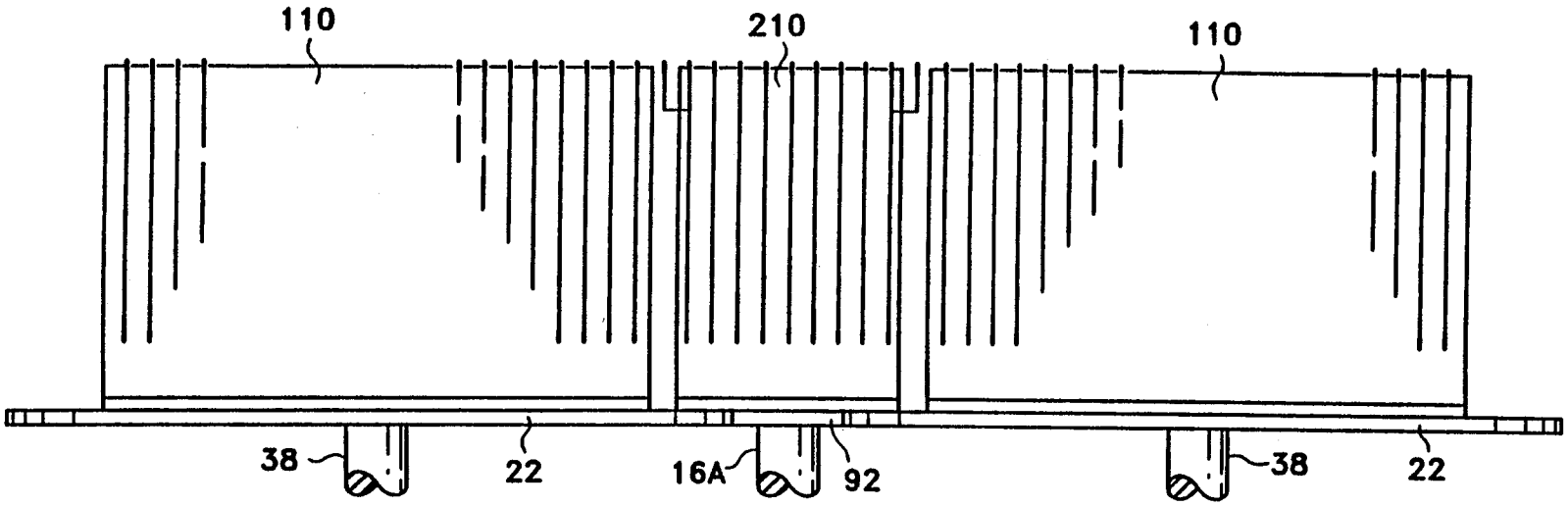
FIGS. 8 and 9 show summarily the needle beds in side and plan view respectively in the arrangement for forming the body.
Figure 9:
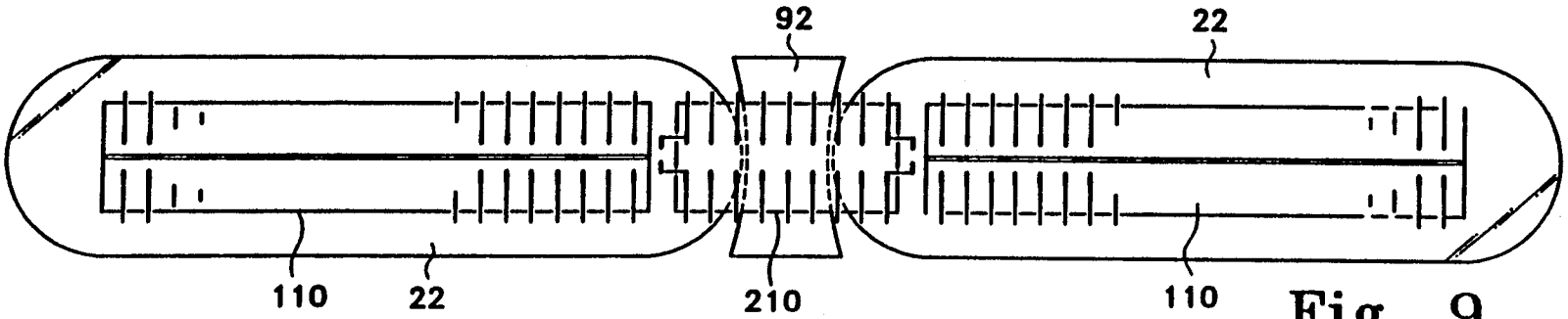

After the legs G of the product have been completed and the formation of the body CP has to be started, the needles 112 of the needle beds 110, which were working during the formation of the legs, must continue to operate and in addition the needles 212 of the needle bed sections 210 must intervene in order to form the crotch strip CV, with continuity in respect of the zones of the body CP which are the continuation of the legs G. In order to achieve this, the two epicyclic plates 66 must be stopped in alignment with one another and with the complementary plate member 92, as shown in FIGS. 5, 9 and 11, for which purpose the channels 96 of the plates 66 and the channels 94 of the complementary member 92 are aligned relative to one another by means of the assembly 12, 14. This being the case, the unit 16, 22 is released by disengagement from the teeth 1K through the action of the actuator 28 and the assembly 12, 14 is likewise released. Coupling between the pillar 16 and the central gear 70 is then effected through the action of the friction clutch 72. When this is done the central gear 70, the unit 16, 22 and therefore also the gears 40 mounted on the shafts 38 are fastened together. In point of fact, not only the plates 66 but also the tubular shafts 38 and the gears 40 are thus connected to the unit 16, 22, without relative movement. In these circumstances, the rotational movement of the ring 10 is transmitted to this entire assembly described above, which is fastened together. The pins 102 are released from the chains 78, while the pins 104 are engaged in the seats in the blocks 88A of the chains 88. Since the unit 16, 22 together with the components fastened to it starts to rotate around the axis of the central pillar 16, the gears 84 start to turn through the action of the toothed rim 86A of the ring 86, which is carried by the frame 1 and is driven by the toothed wheel 15A connected to the actuator 28. The relative movement of the chain 88, deflected by the teeth of the chain wheels 82, thus starts in relation to the rotary unit comprising the pillar 16 and the plate 22, but the movement is such that it is the unit 16, 22 that rotates together with the needle beds 110, 210, 110 which are held in alignment with one another, while the chain 88 practically does not move in relation to the frame 1, but its chain wheels 82 roll on the chains 88. The shoes 100 are still held by the pins 104 substantially in the same position in space and therefore continue to be regularly fed by the feed bobbins RA (see FIG. 11) in a fixed position, while two fronts of the aligned needle beds 110, 210, 110 slide in succession in front of the shoes 100 and therefore in front of all the textile component parts connected thereto, thus effecting knitting on the entire front formed by these combined needle beds and thereby bringing about the formation of the body. It is to be noted that in these circumstances the guide means 100A and 100B of the shoes 100 effect guiding along the channels 96 and in the channels 94 even in the short section where said channels are lacking between the ends of the channels 96, which end along the periphery of the plates 66, and the channels 94 which start along the concave edges 92A of the complementary member 92.

In substance, during this phase the shoes 100 slide along the two needle bed fronts formed by the needle beds 110, 210, 110 on each side of the plates 66 and of the plate 92 disposed therebeneath, and the body the special needles 212A.

During each phase of the operation the fabric is formed by connecting together the courses of stitches on one front and those on the other front. This is possible while maintaining the uniformity of the fabric, because the end needles are brought close and are appropriately profiled and dimensioned to reduce to a minimum, and even eliminate, any difference in structure of the fabric in the passage between the needles 112 of the two needle beds 110 during the formation of the legs and also for the passage between the end needles of the multiple needle beds 110, 210, 110 which are aligned in the formation of the body.

During the formation of the product it is necessary to provide pneumatic tensioning of the fabrics being formed, as is known in the technique of stocking production, particularly for women's stockings. During the formation of the legs this task is entrusted to a pneumatic suction, which by means of the duct 54 and the grids 56 and 46 is applied, with the door closed, in the tubular shafts 38 inside which the products of which the legs are being formed are pulled back pneumatically during their formation by the needles 112 on the needle beds 110. When the body is being formed, the pneumatic tensioning is still effected through the two baskets 42, 44. On completion of the formation of the product, when the latter has to be removed, the door 58 is closed and therefore suction is no longer applied through the gridded basket 42 and the section 62A. Suction is maintained through the duct 52 and the gridded door 46 is opened, so that the complete product is brought back through the corresponding axial passage of the tubular shaft 38 equipped with the grid member 44, and is removed through the suction and pneumatic conveyor duct 52, 54.

Figure 12:
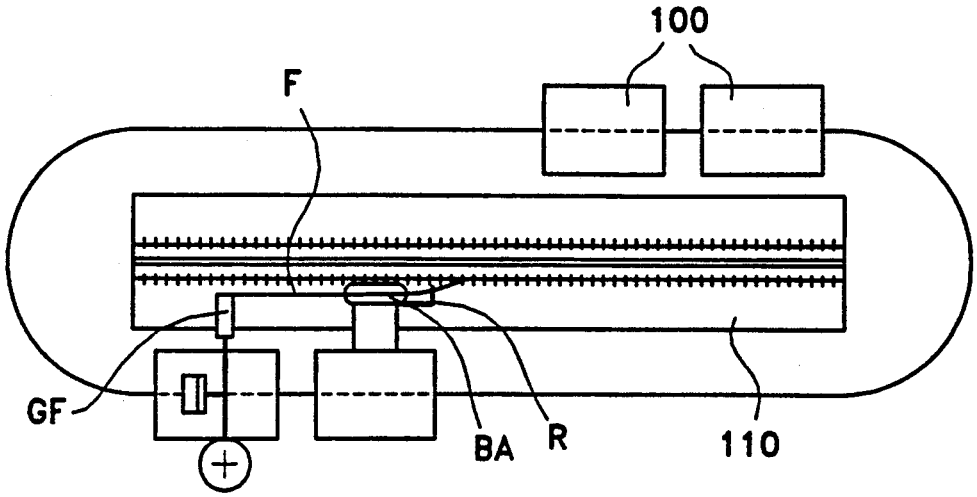
FIGS. 12 and 13 show in plan the arrangement for cutting and picking up the thread.
Figure 13:
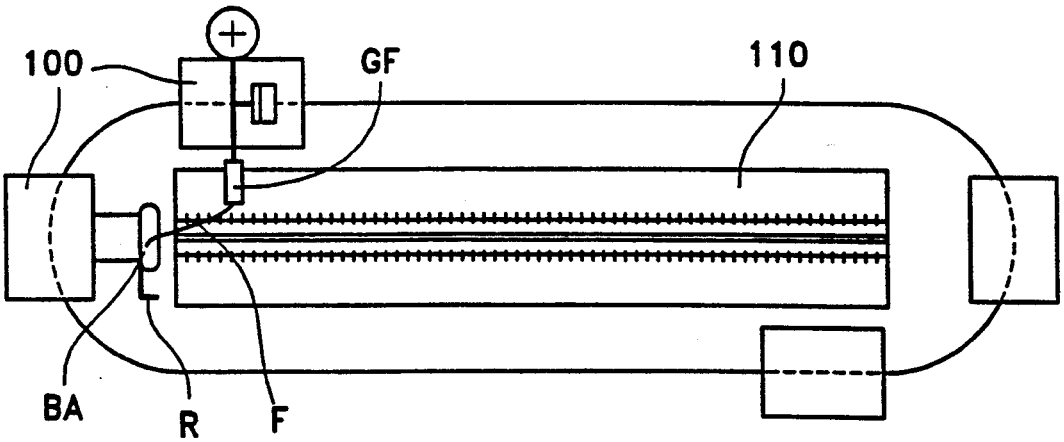

FIGS. 12 and 13 show schematically in plan the two cutting and pneumatic pickup positions of the thread F. Cutting is effected by a resistor R (144) and the thread is picked up by a pneumatic suction nozzle BA (140) carried by one of the two carriages 100 of each pair, the other carrying the thread guide GF (134).

In the construction shown in FIGS. 14 through 46 an arrangement is provided in which the rotors for the needle beds intended for the formation of the legs are rotated by the conjoint action of pantograph sets, which are also provided for holding the chains equipped with carriages for the knitting means intended to cooperate with the needles of the rotating needle beds.

Figure 27:
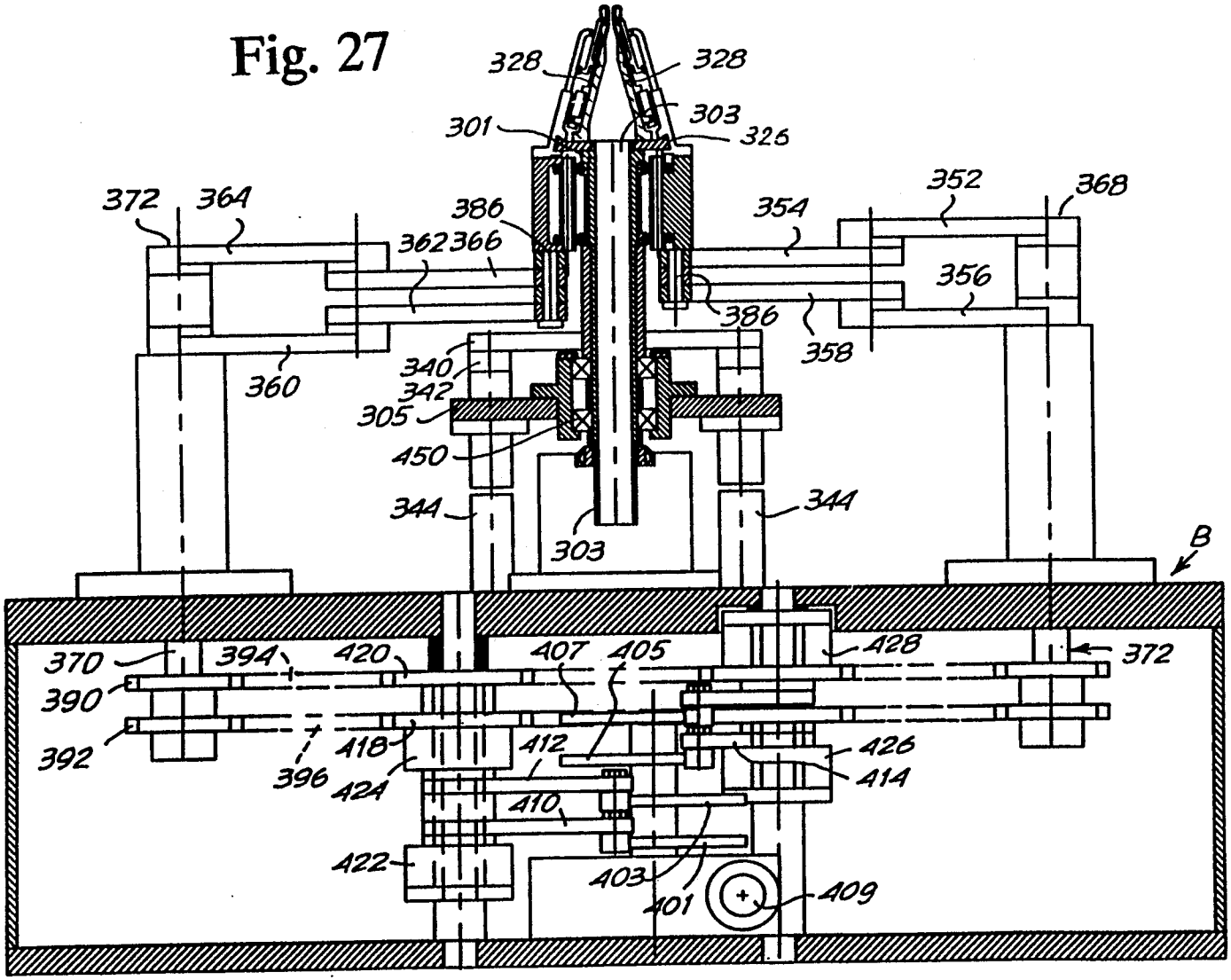
FIGS. 27 through 29 show vertical sections and external views of the machine.
Figure 28:
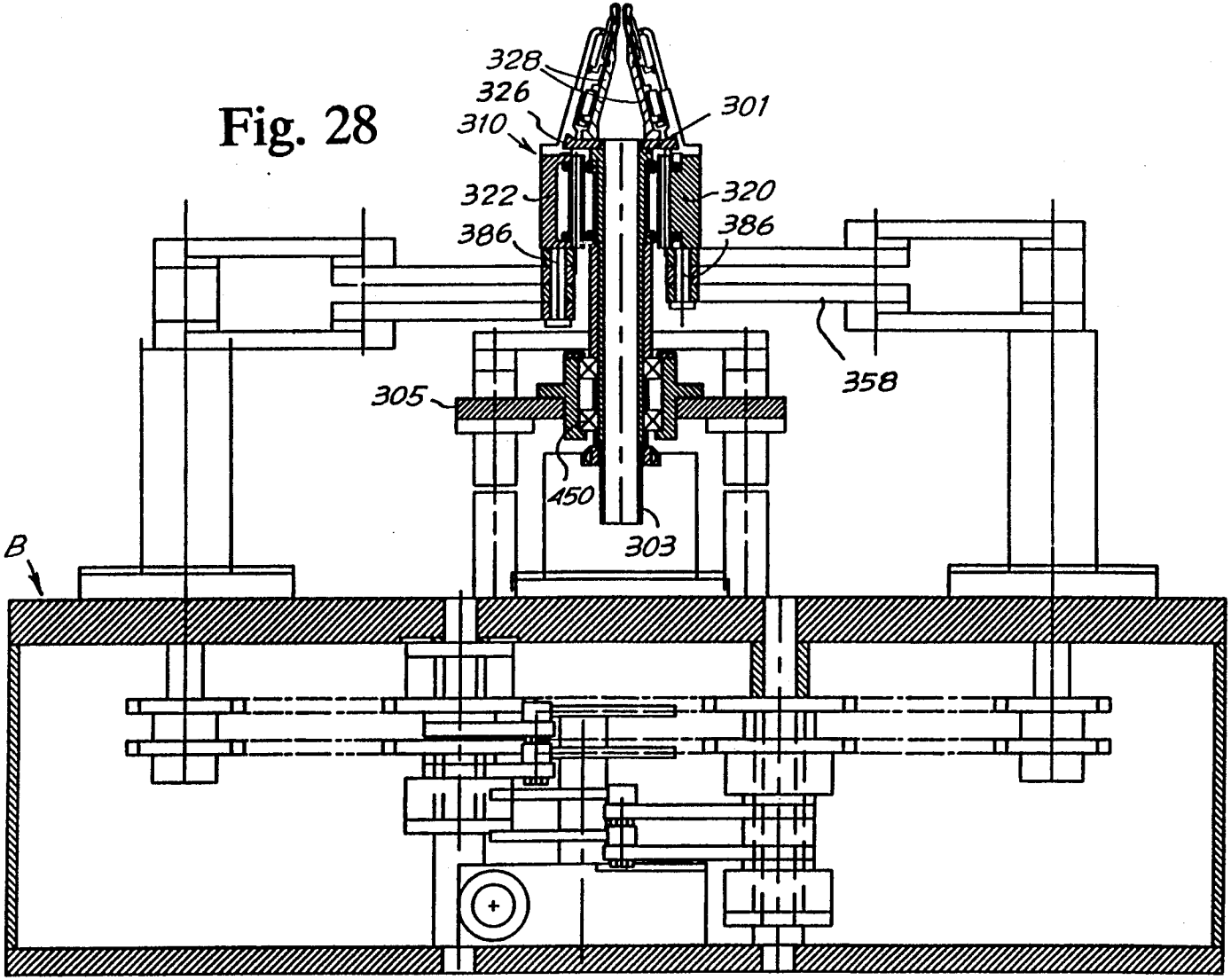
Figure 32:
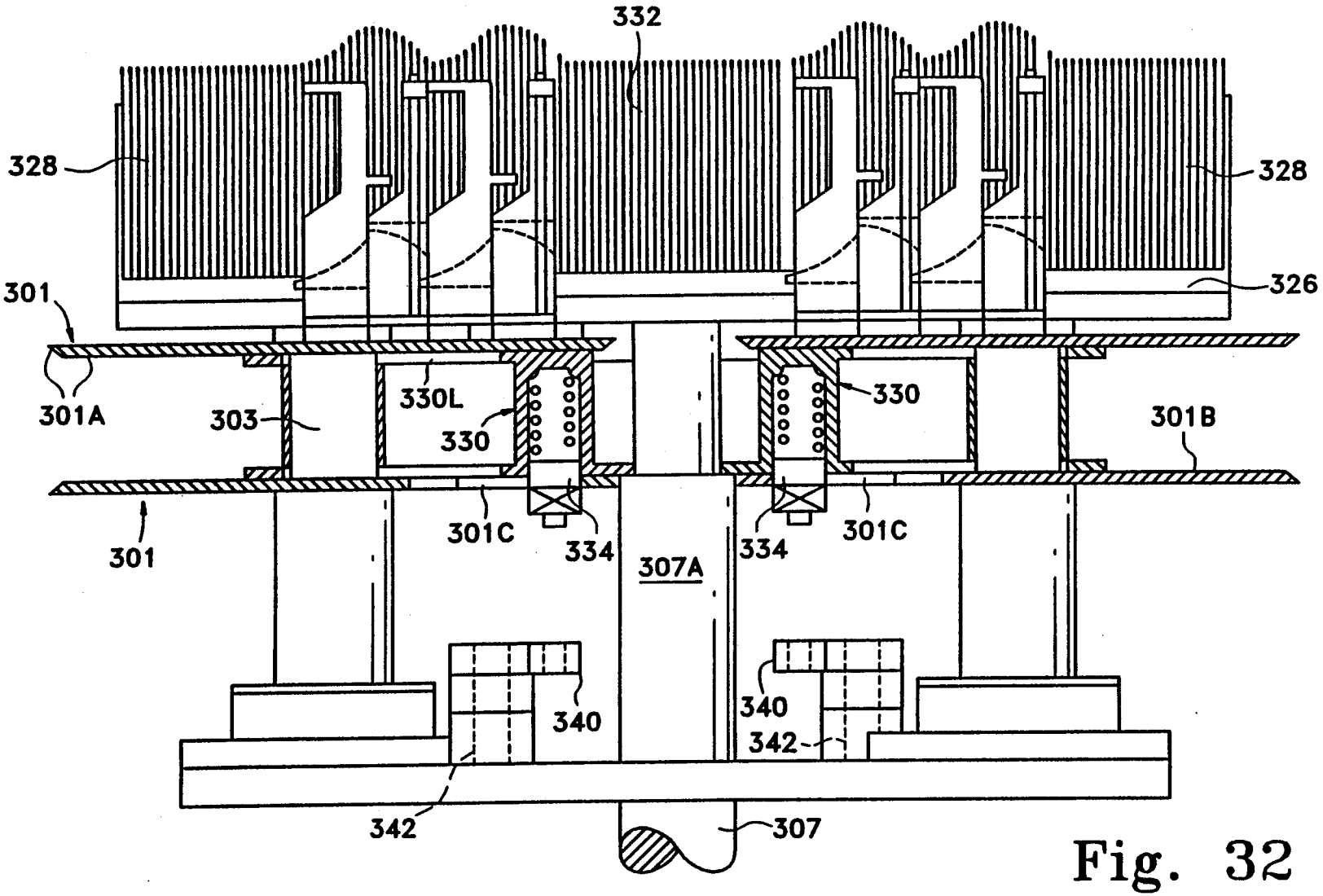
Figure 33:
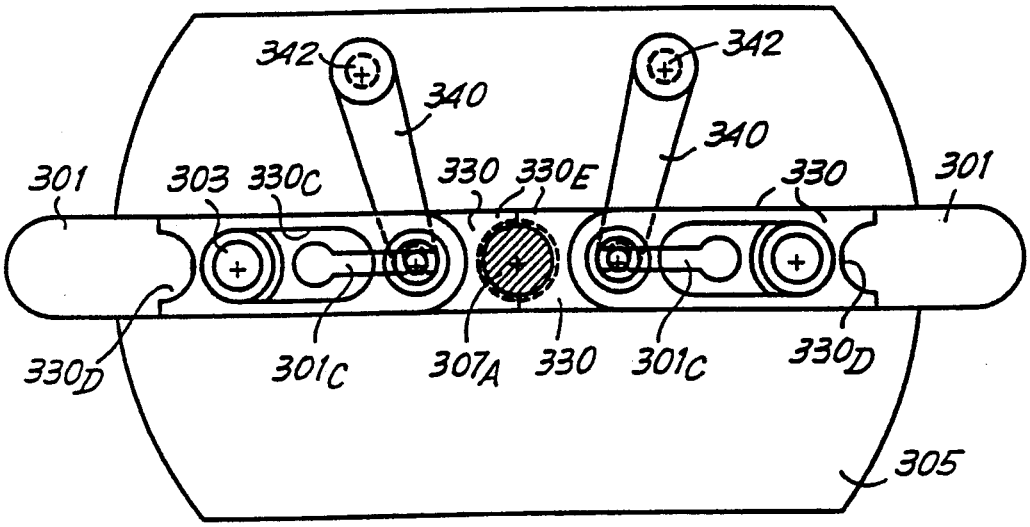
Figure 36:
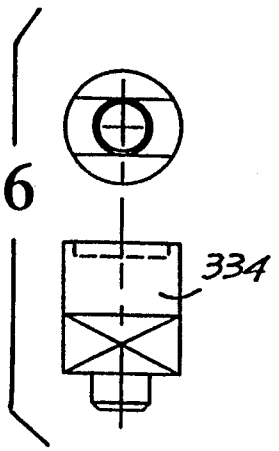
FIGS. 34, 35 and 36 show details of FIGS. 30 through 33.

In this example 301 designates the elongated plates which work epicyclically and which correspond to the plates 66 in the preceding example. Each of these plates 301 is fixed for rotation with a hollow shaft 303 which is carried by a plate 305. The plate 305 is in turn mounted loose on a central shaft 307. Each of the plates 301, carried rotatably by the rotating shaft 303, is actually composed of two plates spaced vertically apart, each of them, having beveled perimetral edges 301A and 301B, shown in FIG. 38. The beveling being directed toward the inside in order to form rolling tracks for a corresponding chain generically designated 310 and composed of a length of open chain of a special type. This chain, as shown in FIG. 32. The comprises two rows of top rollers 312 and bottom rollers 314 provided with double circumferential beveling. The chain links consist alternately of links 316 and links 318. The links 318 may be provided with leaf spring-shaped parts 318A, which permit a certain resilient deflection of the pins joining them to contiguous links, for the purpose of taking up play. The rollers 312 and 314, which have beveled outer edges, are adapted to cooperate with the perimetral profiles 301A and 301B of the double plates 301, which can perform movements of an epicyclic type. Each of the chains has two sets of carriage links 320, 322 disposed side by side and intended for carrying the textile devices provided to cooperate with the needle beds carried by the epicyclic plates 301. For this purpose, as shown in FIG. 27, each of the top plates 301 is combined with a widened member 326 (which is thus also fastened to the respective tubular shaft 303) for carrying the needle beds 328 which extend rectilinearly and are inclined upward toward one another. For the purpose of cooperating with the needles of the needle beds 328 the carriages 320 and 322 carry extensions 320A and 322A respectively, which are equipped with the cams, thread guides and other devices which are necessary for the knitting operation in conjunction with the needle beds 328.

Figure 29:
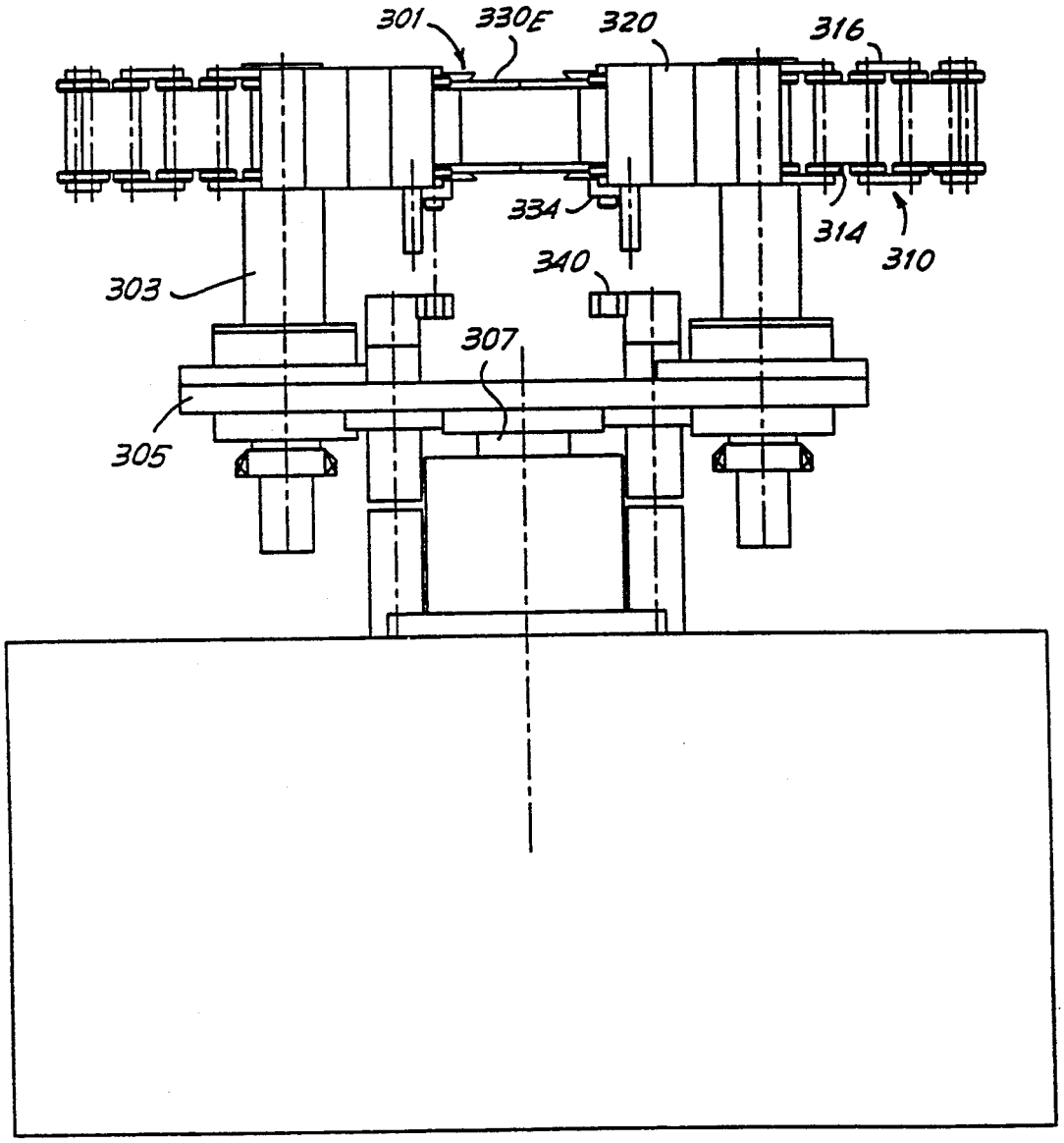
Figure 30:
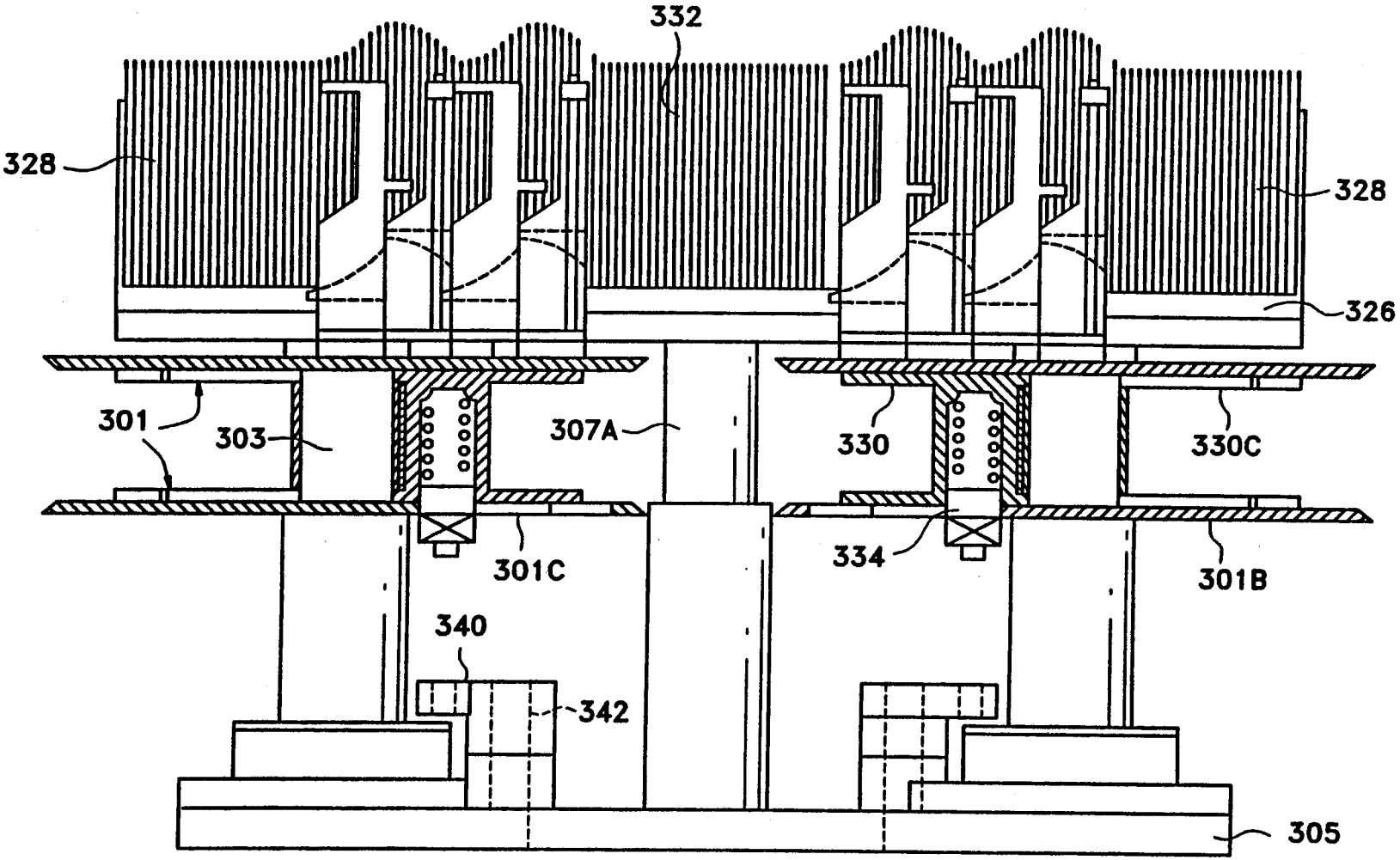
FIGS. 30, 31 and 32, 33 show in vertical section and in plan guide means in the modes for forming the legs and the body respectively.
Figure 31:
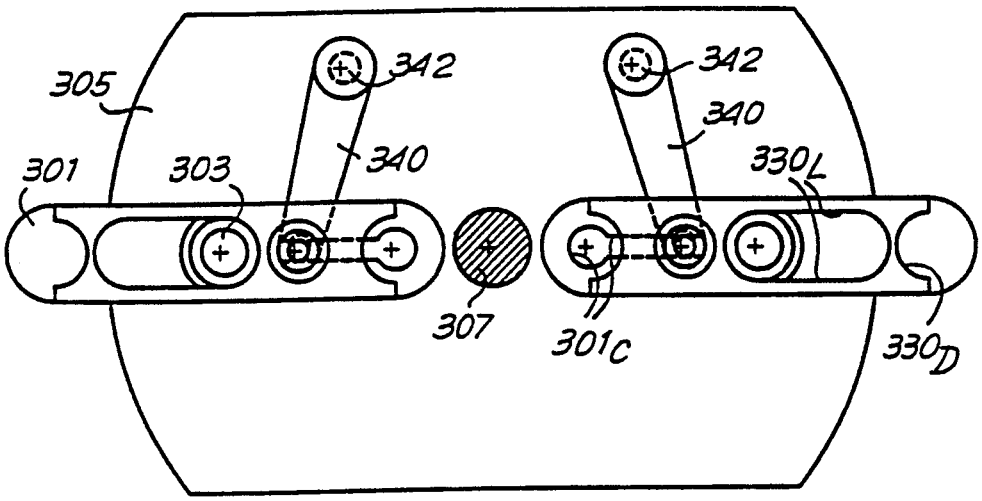
Figure 34:
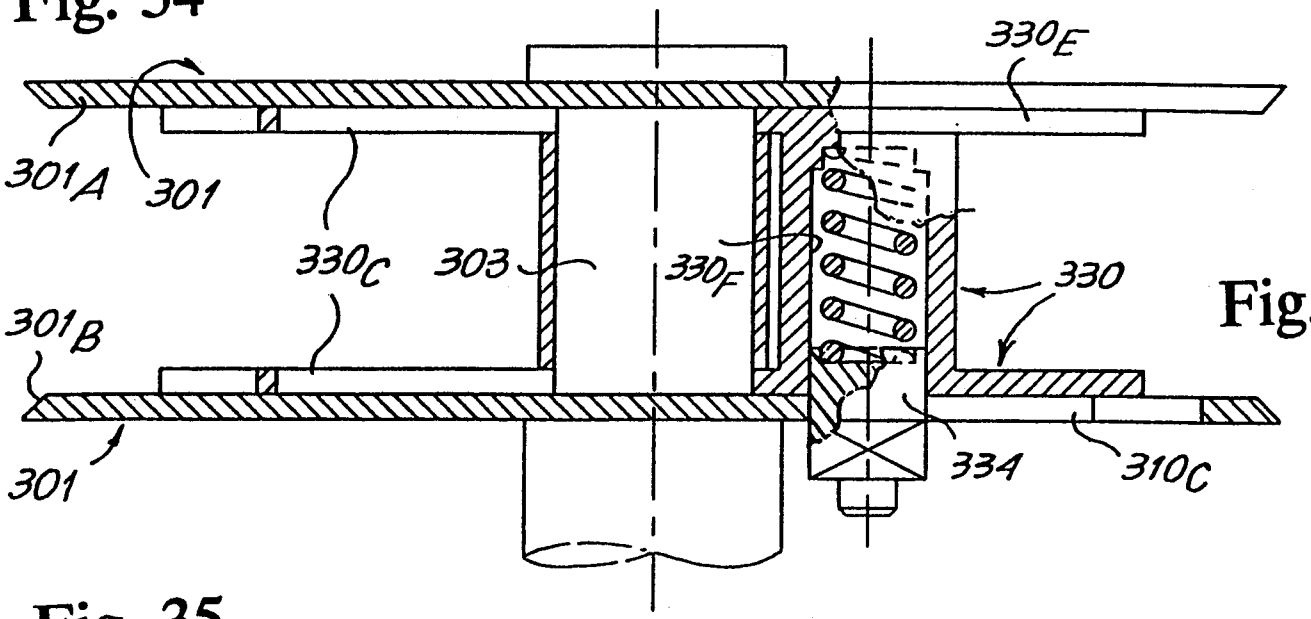
Figure 35:
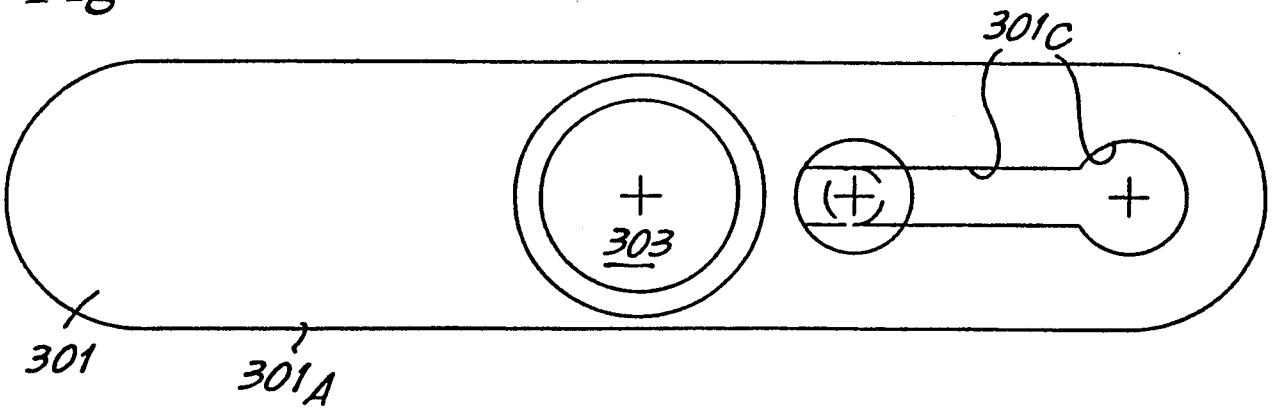
Figure 37:
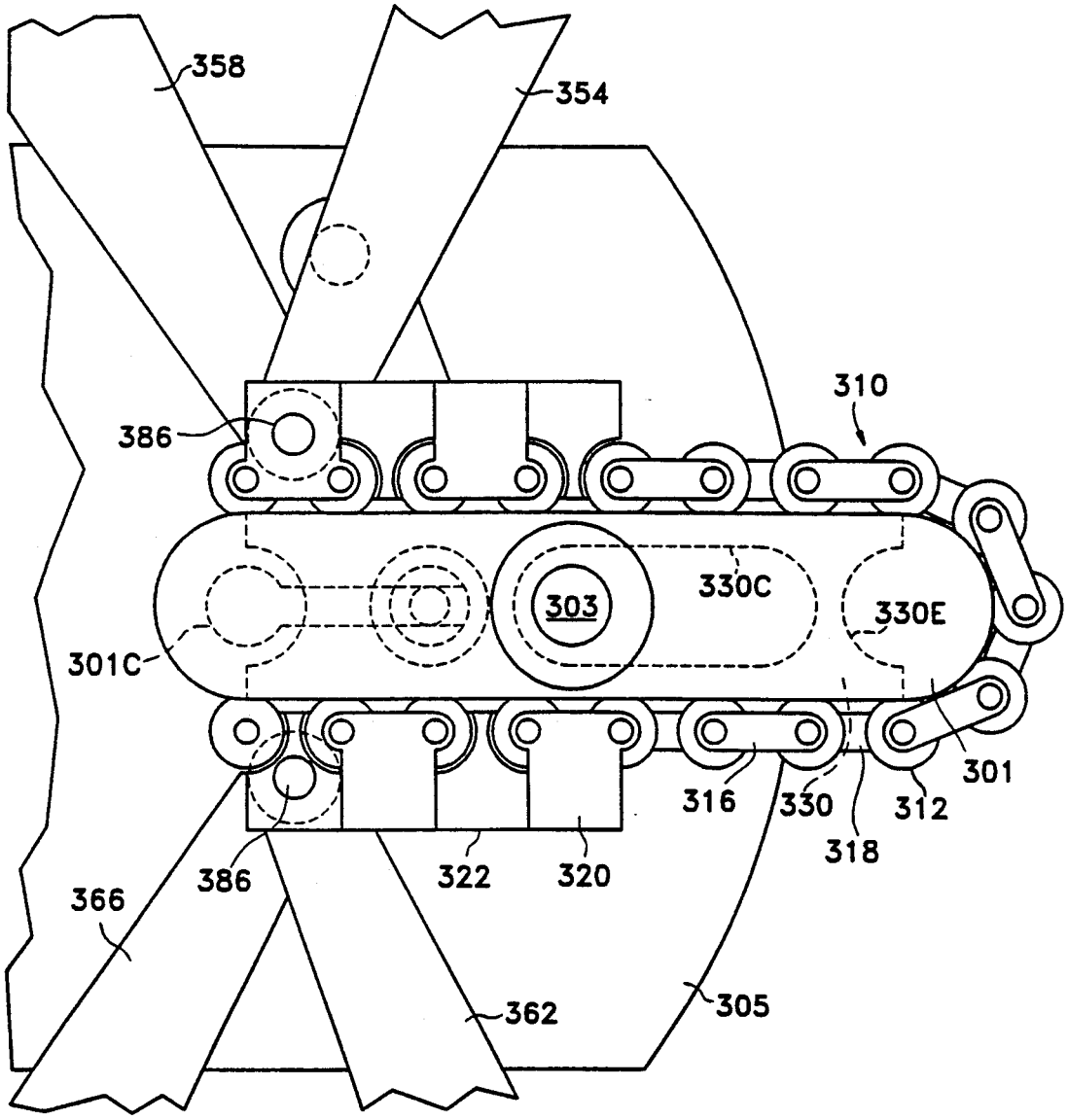
FIG. 37 shows a partial enlarged plan view of FIG. 14.
Figure 38:
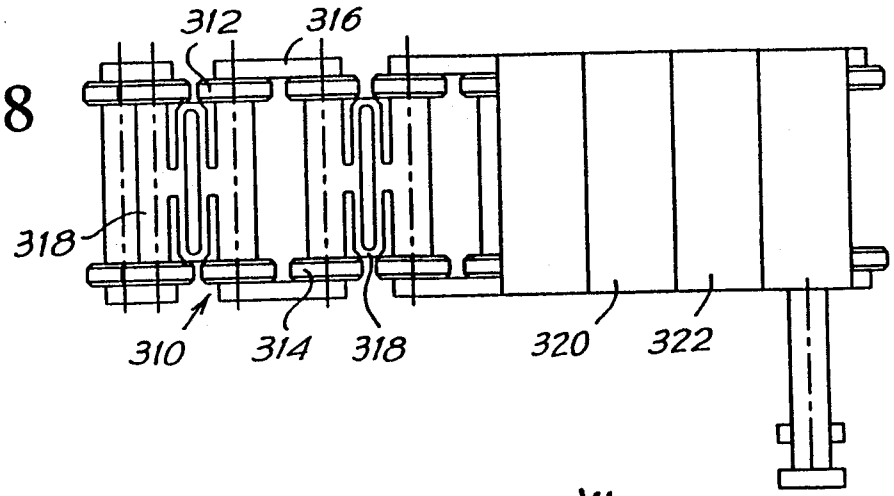
FIGS. 38 through 41 show details of a chain in side view, in plan and in sections on the lines XL—XL and XLI—XLI in FIG. 39.
Figure 39:
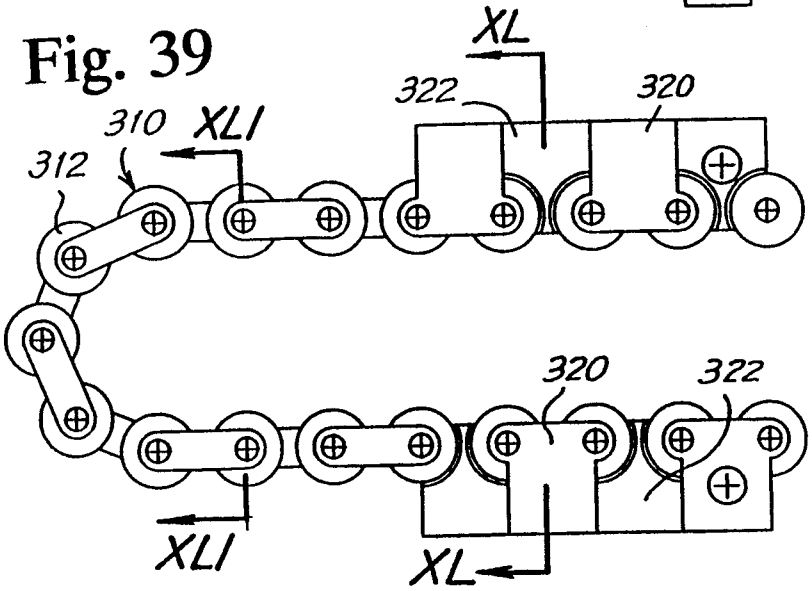
Figure 40:
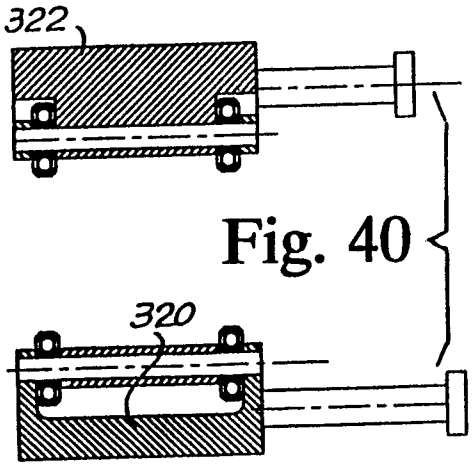
Figure 41:
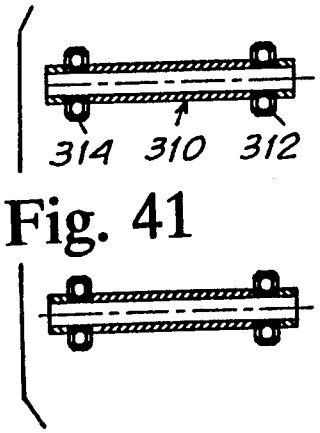
Figure 42:
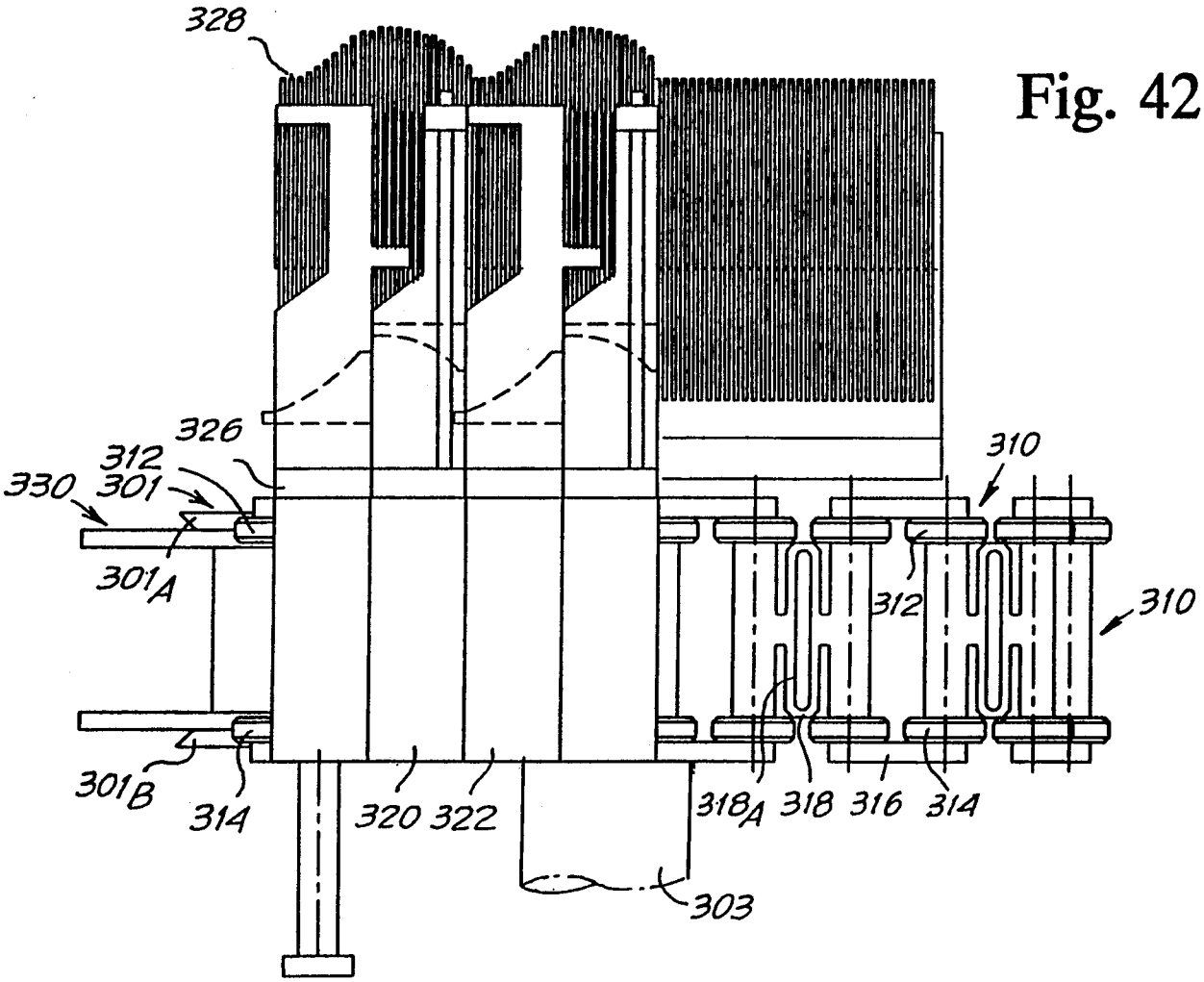
FIG. 42 shows a partial side view of a unit carrying a needle bed for legs.
Figure 43:
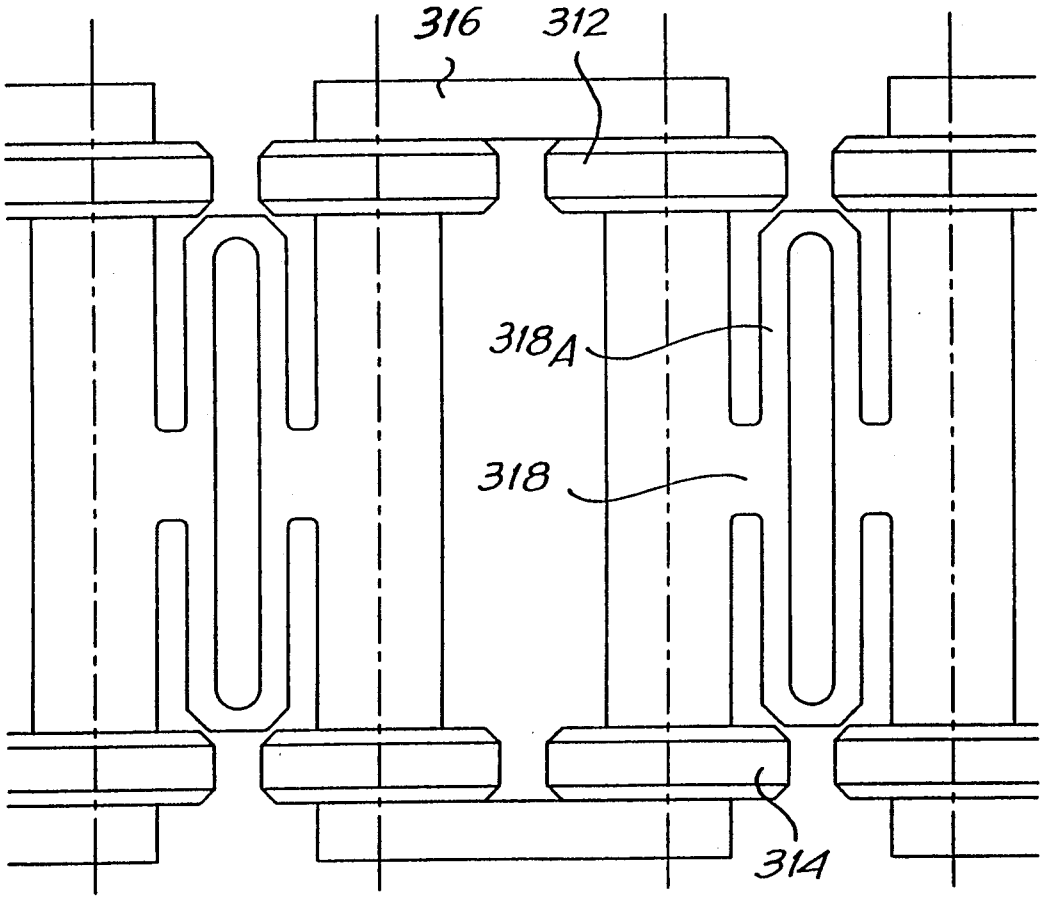
FIG. 43 shows an enlarged detail of a chain.
Figure 44:
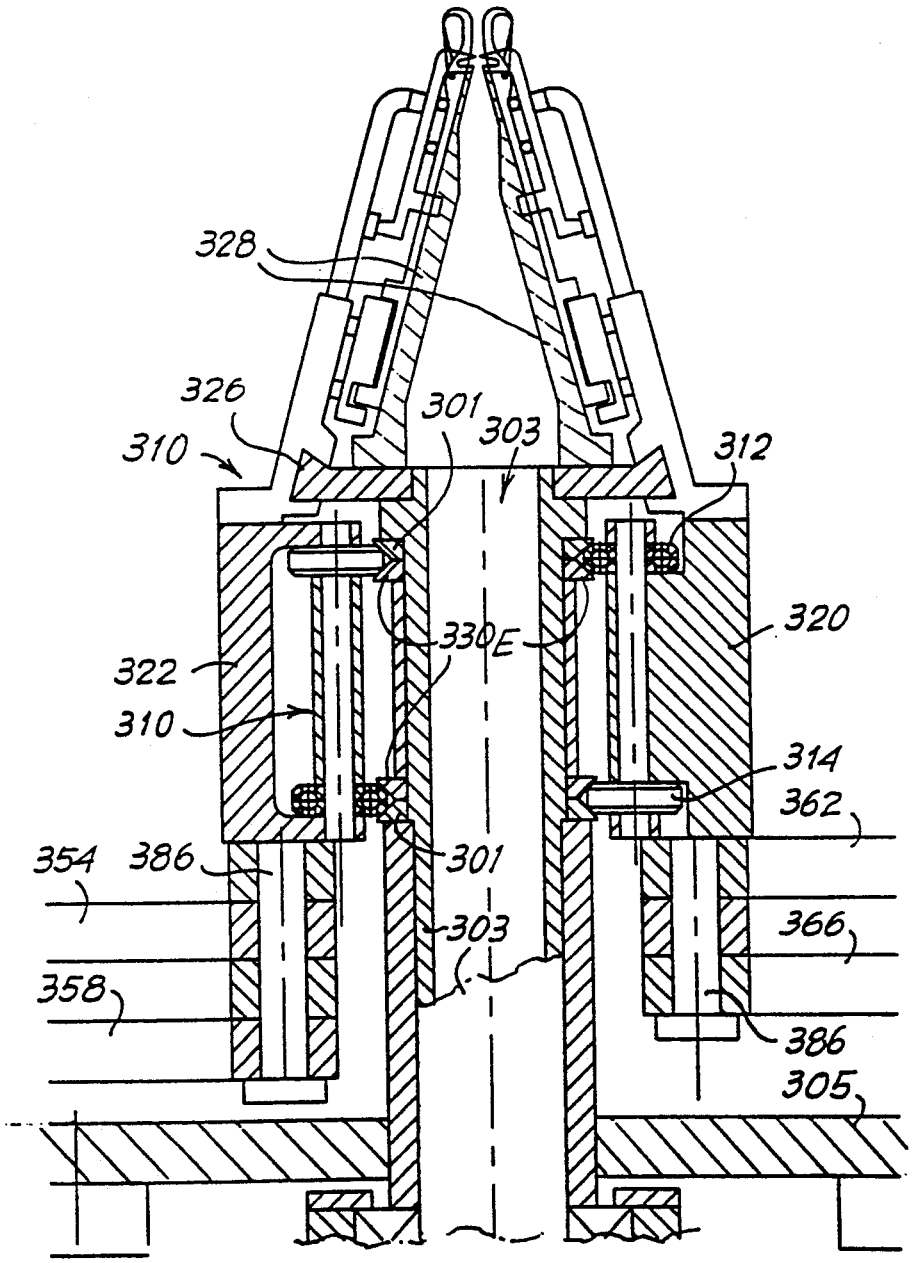
FIGS. 44 and 45 show two cross-sections.
Figure 45:
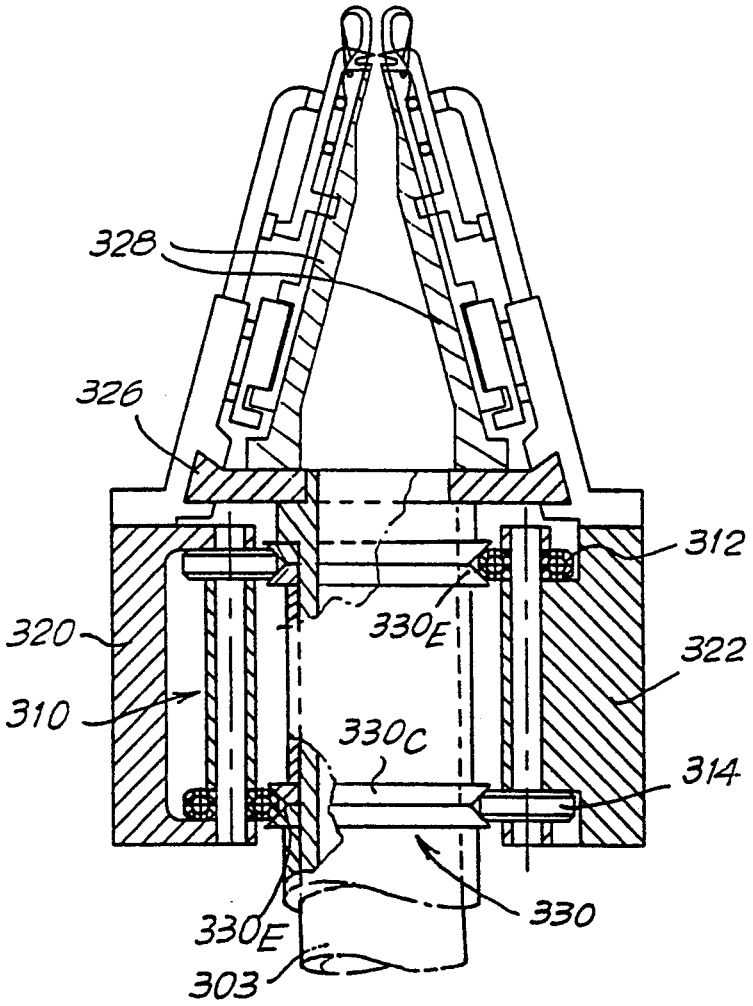
Figure 46:
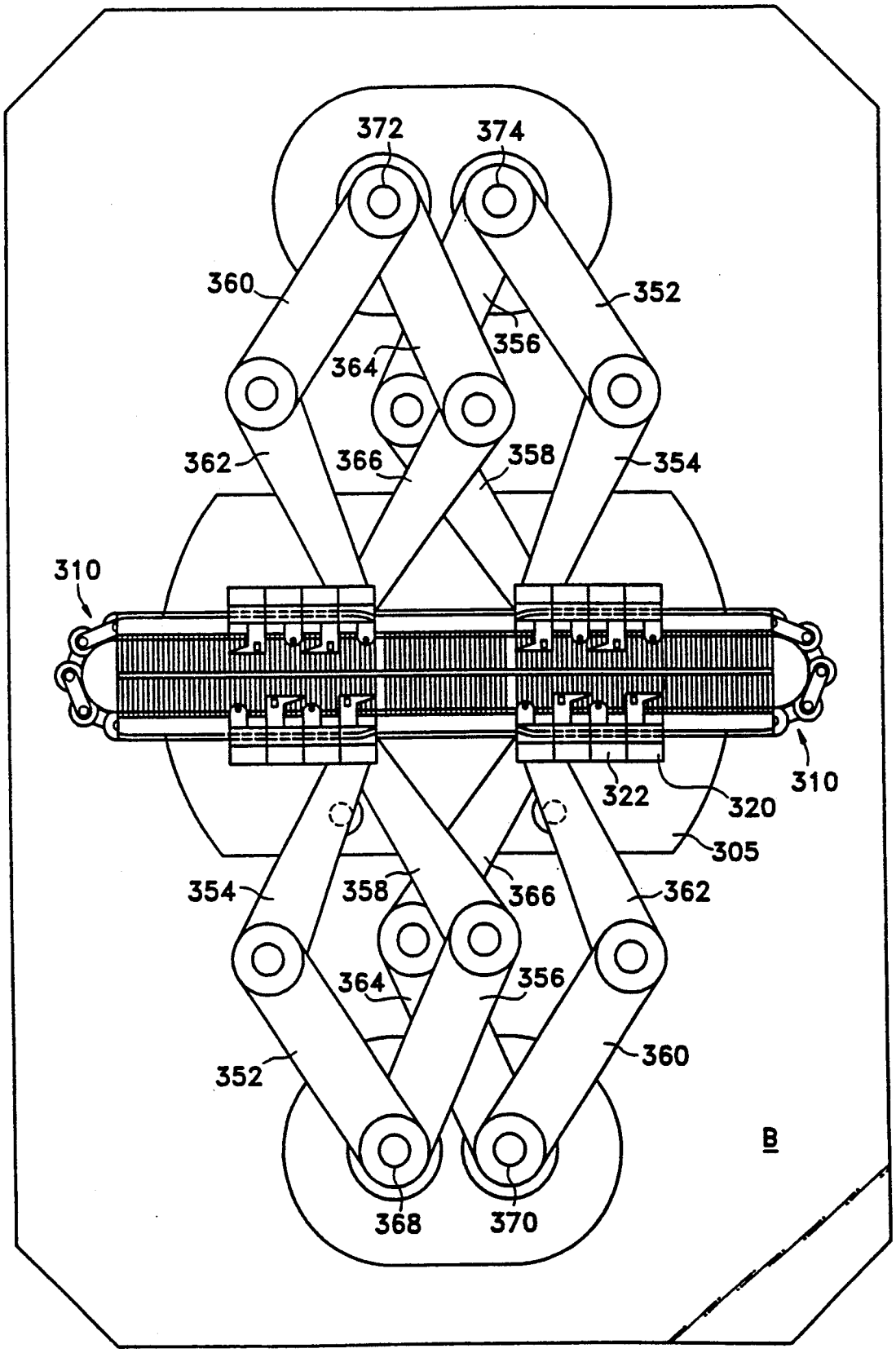
FIG. 46 show an overall plan view.

Inside the pairs of plates 301 forming the tracks 301A and 301B for the rollers 312 and 314 are disposed respective units 330 which are longitudinally slidable and are guided respectively by slots 301C in the bottom plates 301, and also by slots 330C in said units 330 which slide with the guidance of the tubular shafts 303. Substantially every one of the units 330 is slidable in the direction of the larger dimension of the plates 301 and therefore parallel to the needle beds 328, so as to move away from one another or toward one another around the extension 307A of the central shaft 307, the units 330 being appropriately hollowed out at 330D to receive the extension 307A. The extension 307A of the central shaft 307 of the plate 305 carries an additional needle bed 332, which on the alignment of the two needle beds 328 is disposed between these two needle beds in order to complete the textile assembly as a single needle bed 328, 332, 328. As shown in FIG. 34, resilient pins 334 are disposed in appropriate seats 330F of the units 330 and project downward in order to penetrate into one or the other of the enlarged end portions of the slots 301C in the bottom plates 301 and thereby to stabilize the respective units 330 in relation to the plates 301. By acting on the resilient pins 334 in such a manner as to raise them against the resilient force urging them downward, it is possible to slide the units 330 parallel to the needle beds 328 to move them relatively closer and farther away along the slots 301C and to stabilize said units 330 in the distant and close reciprocal positions. The plates which form part of the units 330 and which are slidable adjacently to and inside the plates 301 of the needle beds 328 have their longitudinal edges beveled as indicated at 330E. As shown in FIG. 29 and 34. These beveled edges 330E are adapted to cooperate with the internal bevels cf the rollers 312 and 314 of the chains 310. Consequently, the chains 310 can be guided along the periphery of the plates 301 by the beveled perimetral profiles 301A of the plates 301 in relation to the needle beds 328, and also by the profiles 330E beveled oppositely to those of the plates forming part of the units 330. In the interspace between the plates 301, which are aligned with one another when the two units 330 are brought close to one another, the guiding of the chains is entrusted to the profiles 330E which cooperate with the inner edges of the rollers 312, 314. The consequence of this is that the chains can be made to slide along the perimetral profiles 301A of the plates 301 and therefore around the needle beds 328 when the latter rotate with the shafts 303, or can be made to slide along all the needle beds 328, 332, 328 in alignment with one another when the assembly comprising these aligned needle beds together with the plate 305 and the shafts 303 and 307, 307A is rotated in order to form the body. The chains being in this case guided by the profiles 301A and in part by the profiles 330E which ensure continuity when the two units 330 are brought toward one another around the extension 307A of the central shaft 307, which extension 307A carries the intermediate double needle bed section 332.

For the purpose of moving the units 330 between the distant position and the close aligned position of the plates 301 and needle beds 328 use is made of two arms 340, which are pivoted on vertical shafts 342 which are vertically slidable in appropriate guides formed by the plate 305. In a particular position of the plate 305 shafts 344 correspond, in the fixed base B constituting the support structure of the assembly, to the shafts 342, and these shafts 344 are operated angularly by a linkage 346 connected to a single actuator 348 for the angular movements. Appropriate axial actuators on the shafts 344 bring about the raising and lowering of the shafts 342 and therefore of the arms 340, while an appropriate coupling between the shafts 344 and the shafts 342 permits the transmission of the angular movements from the shafts 344 to the shafts 342. The raising of the arms 340 makes it possible to connect the ends of the arms 340 to the resilient pins 334 in order to raise the latter. After which the angular movement of the arms 340 brings about the longitudinal sliding movements of the units 330 in order to bring them simultaneously closer or further apart until continuity is achieved between the guide edges 330E of the two units 330. The raising of the resilient pins 334 permits sliding along the slots 301C and the release of the resilient pins 334 (for the lowering of the arms 340) brings about the locking of the units 330 in one or the other of the widenings provided at each end of the respective slots 301C.

This makes it possible to space the two units 330 and thus to maintain the independence of the profiled guides 301A for guiding the chains 310 along the perimetral profiled guides 301A of the plates 301. When the two units 330 are brought close together, after the plates 301 (and therefore the needle beds 328, 328) have been aligned with one another, the guide profiles are completed by the edges 330E of the units 330 brought close to one another. This is done in order to complete the guidance of the chains along the series of profiles 301A of the plates 301, relative to the two needle beds 328, and of the profiles 330E of the units 330, with no interruption to the guidance, because of the presence of the double rollers 312 and 314 of the chains 310, which act precisely on the opposite profiles 301A and 330E.

Apart from the drive system moving the units 330 toward and away from one another, the base B also contains control means to effect the retention of the chains 310 during the knitting operation achieved through the rotation of the needle beds 328 about the shafts 303 or through the rotation of the plate 305 and of the shaft 307 with the needle beds 328 in alignment with one another, together with the intermediate section 332 for the formation of the body.

In order to achieve the retention of the chains while one or the other of the abovementioned rotations is taking place, for each of the chains 310 a pair of pantographs, as shown in FIGS. 14–23 is provided, each of them composed of a first pair of bent arms 352, 354 and 356, 358 and respectively a second pair of bent arms 360, 362 and 364, 366. The various pantographs are pivoted about axes designated 368, 370, 372 and 374. Each pantograph can be operated by means of a chain simultaneously with the pantograph forming its mirror image, and in particular the pantographs pivoted on the pins 370 and 372 and on the pins 368 and 374 respectively can be operated simultaneously. Each pantograph is connected at one end to one of the chains 310 at 378, 380 and 382, 384 respectively by means of pins 386 (FIG. 37) generically indicated for all the pantographs. The pins 386 being fastened to one of the shoes or end carriages 320 or 322 of the respective chain.

Figure 23:
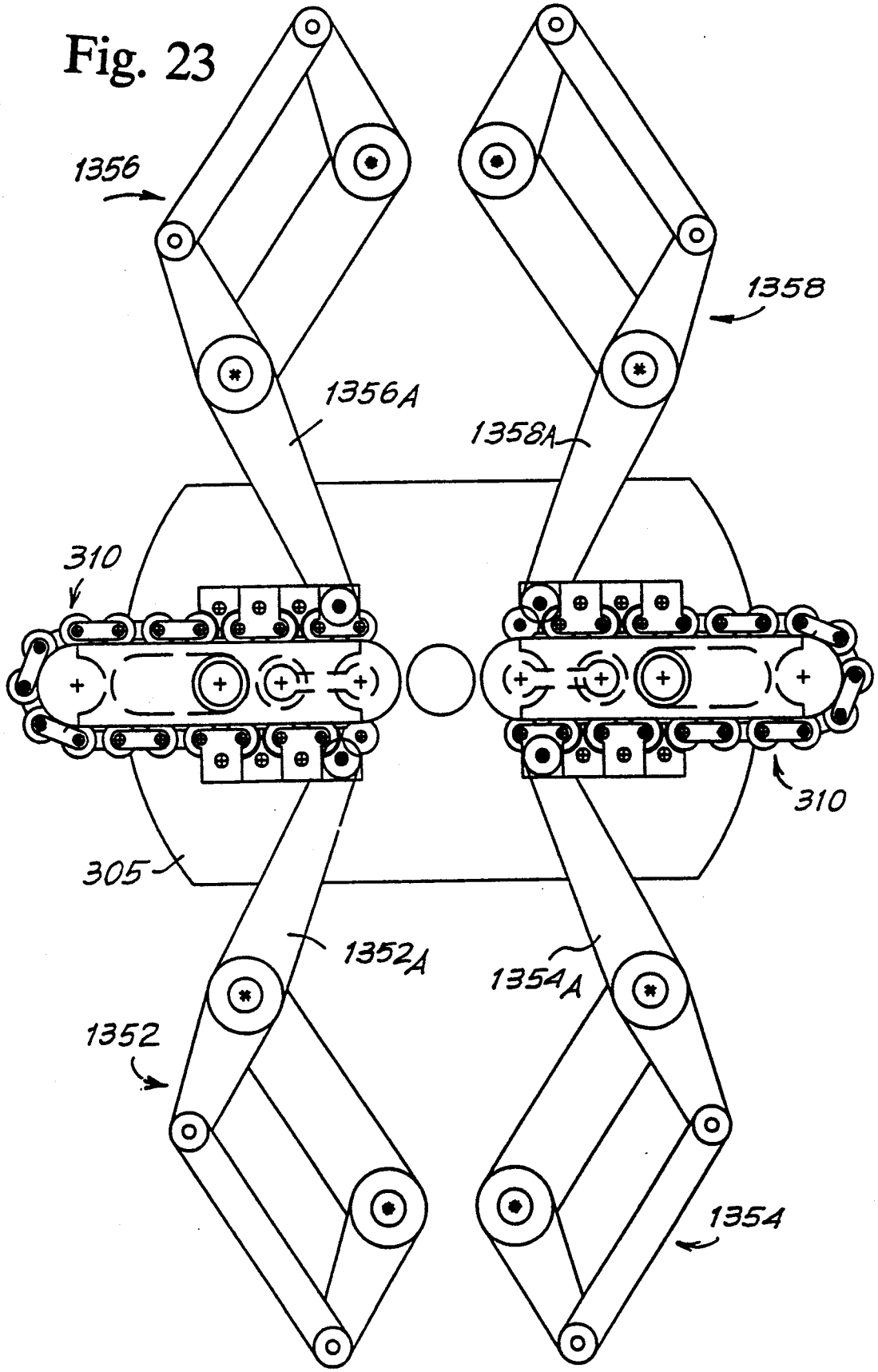
FIG. 23 shows a form of construction modified in relation to that shown in FIGS. 14 through 22.
Figure 24:
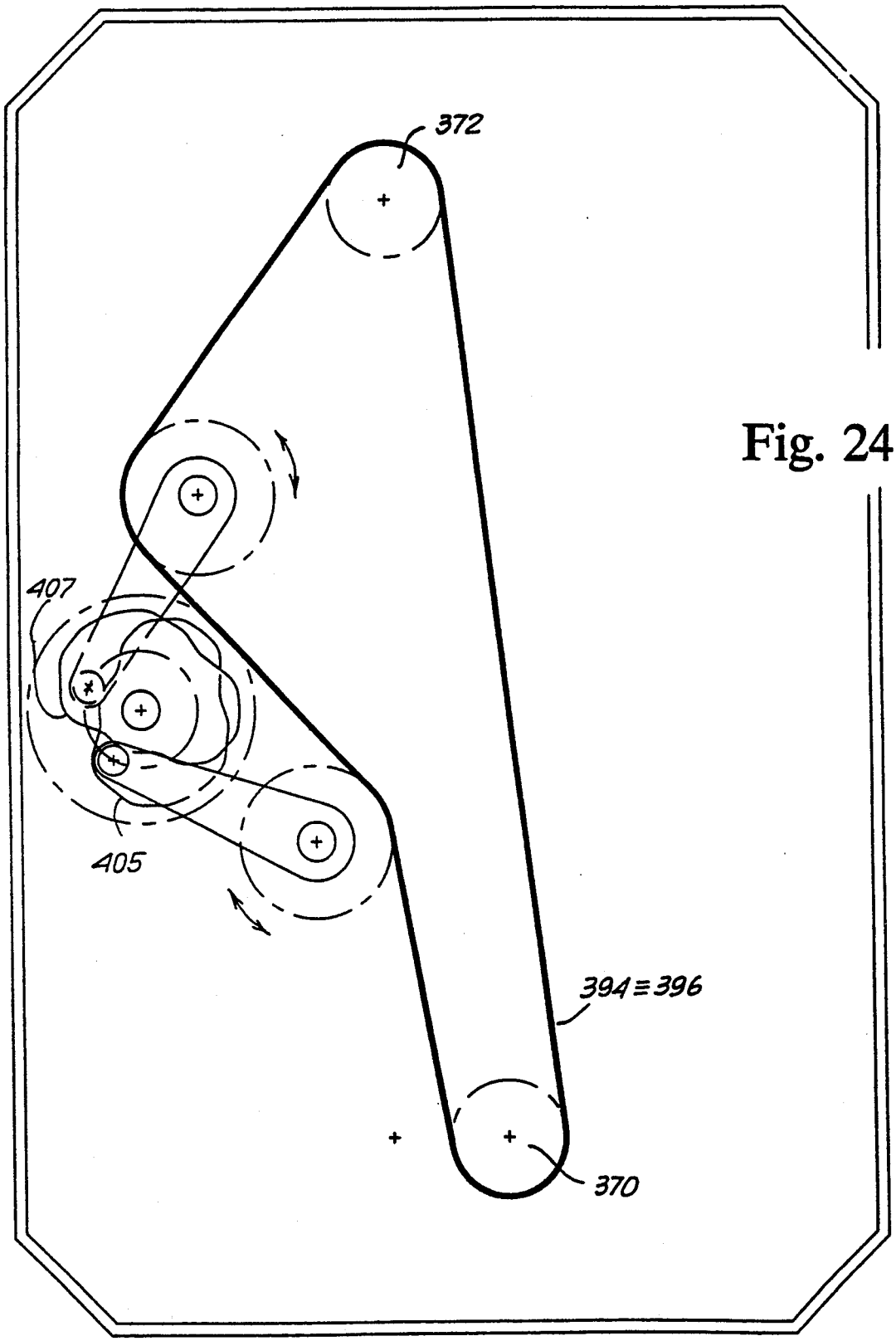
FIGS. 24, 25 and 26 show in plan forms of flexible transmissions contained in the base.
Figure 25:
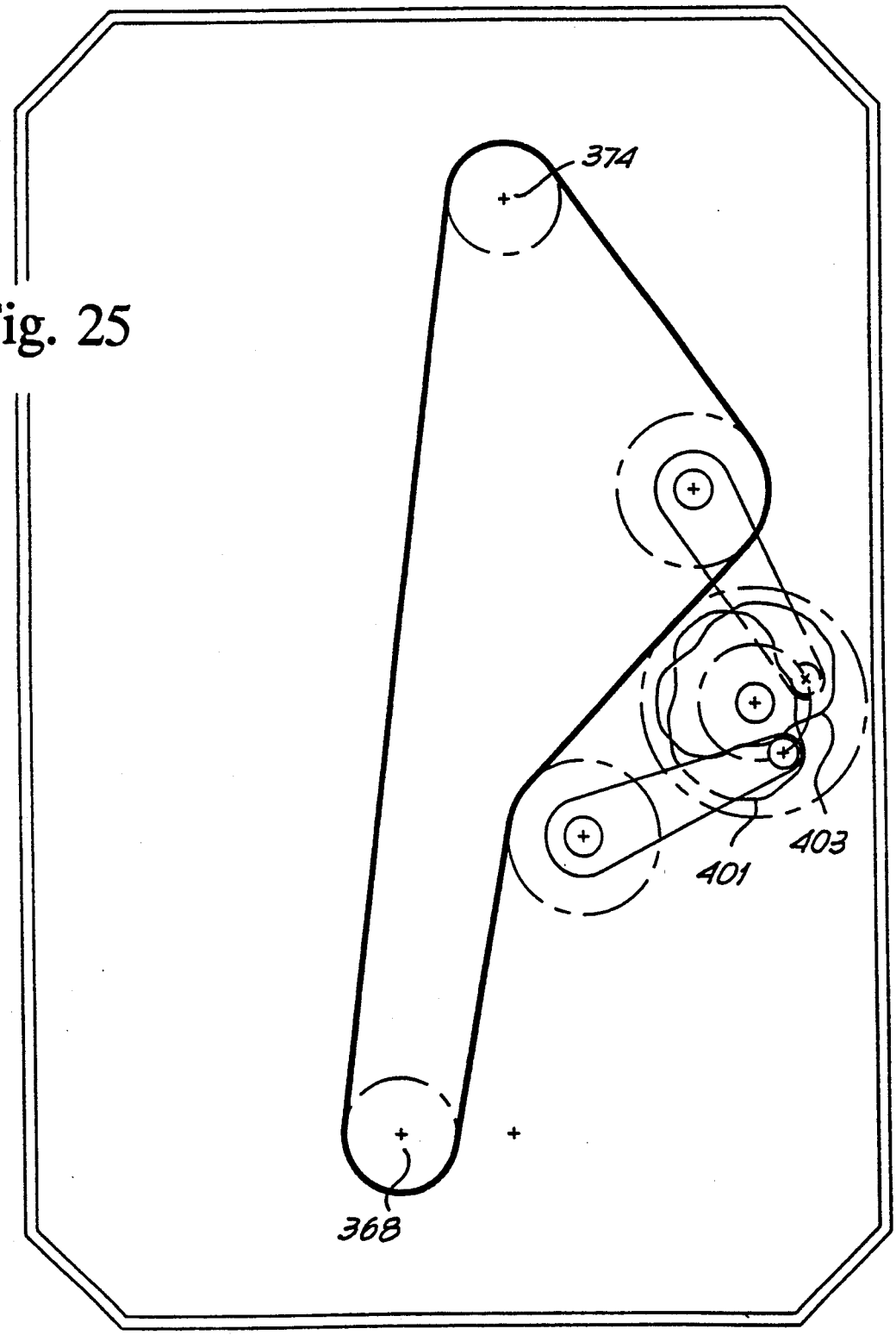
Figure 26:
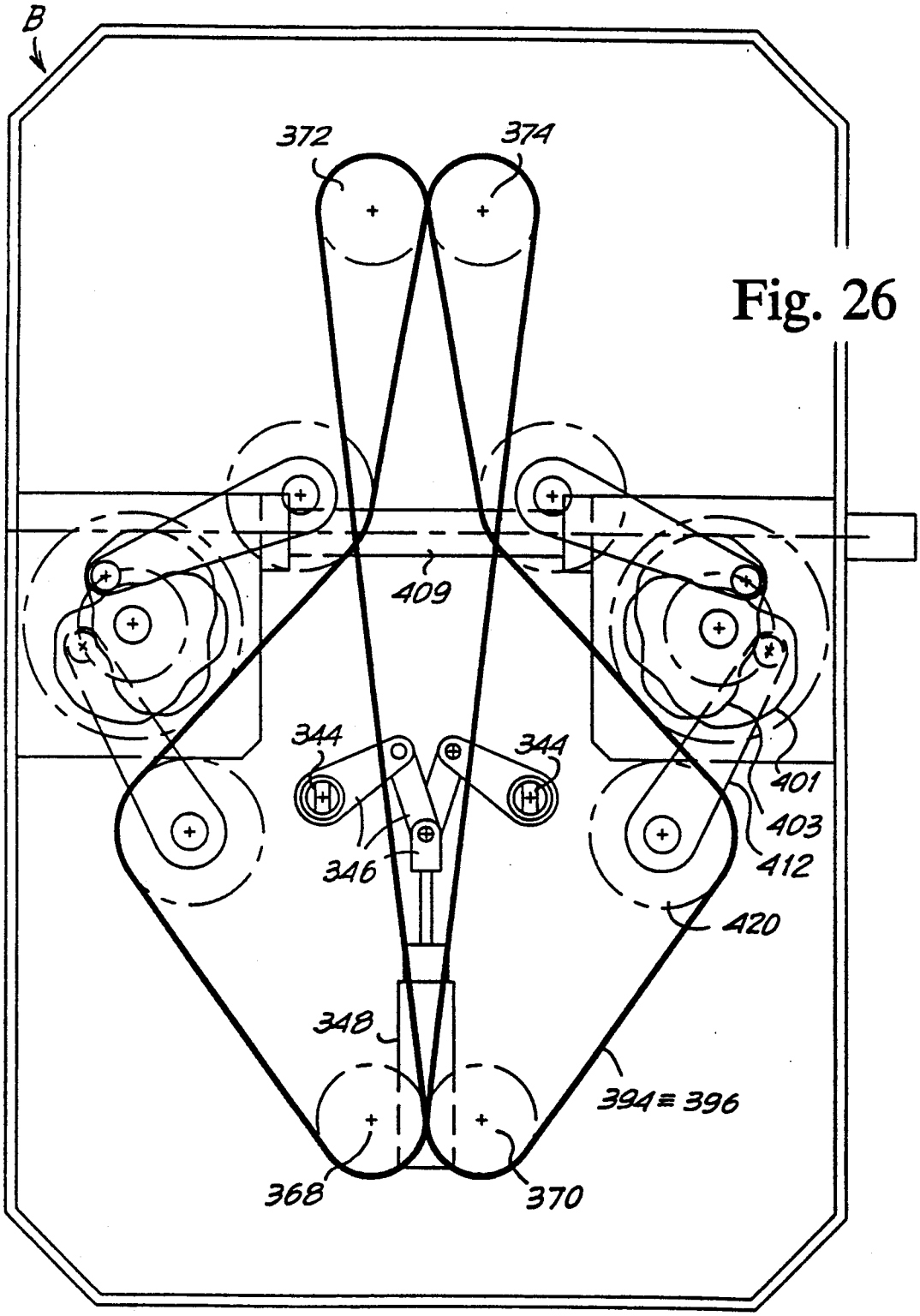

In the variant embodiment illustrated in FIG. 23, the pantograph systems first described above are replaced by systems generically designated 1352, 1354, 1356 and 1358, each of which has an extended side 1352A, 1354A, 1356A, 1358A, which is connected pivotally to the corresponding end of a chain 310. This variant can solve problems of space required inside the machine.

Figure 14:
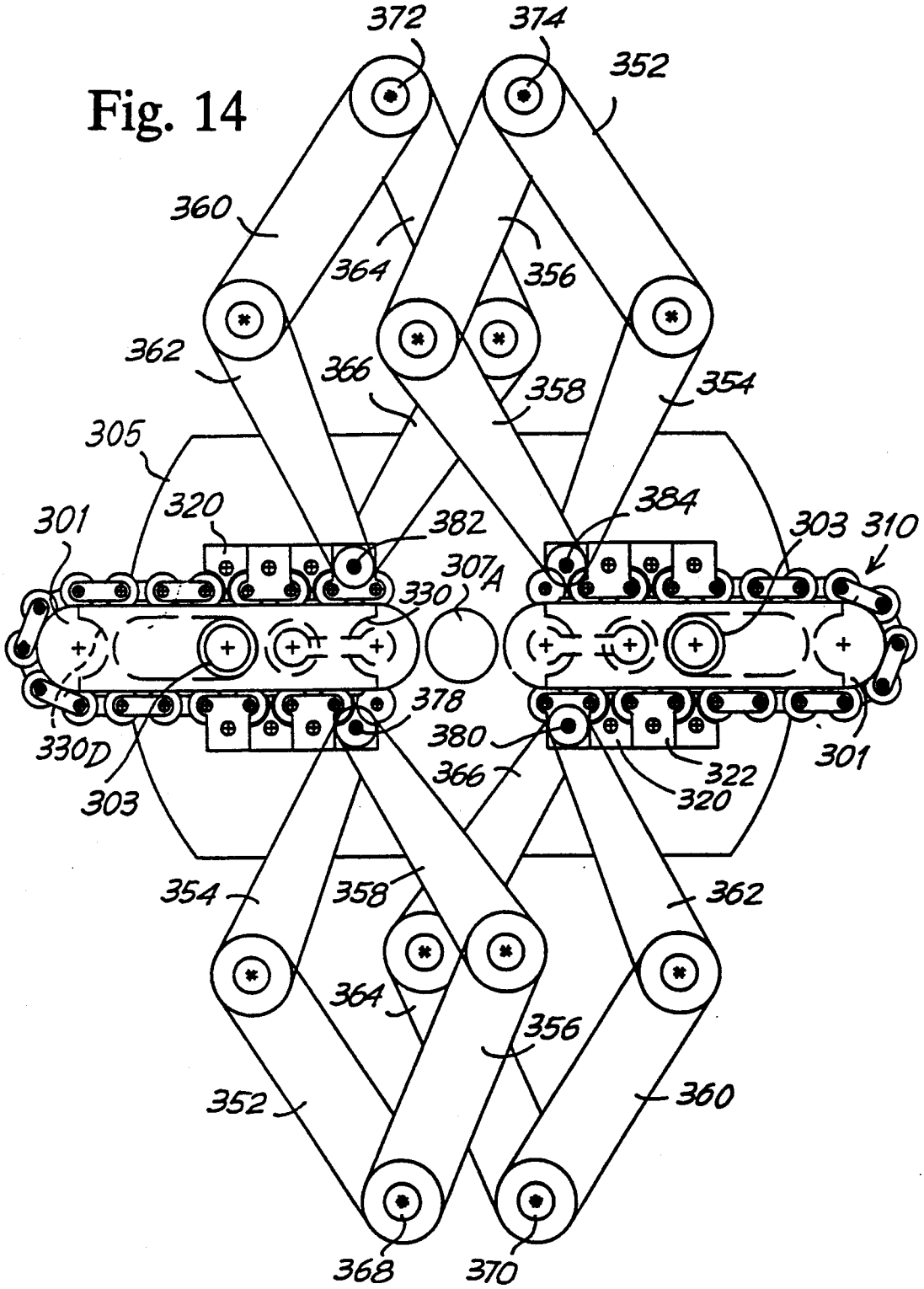
FIGS. 14 through 17 show schematic plan views of sequences of positions of rotating needle beds during the formation of the legs, in a second form of construction of the machine.
Figure 15:
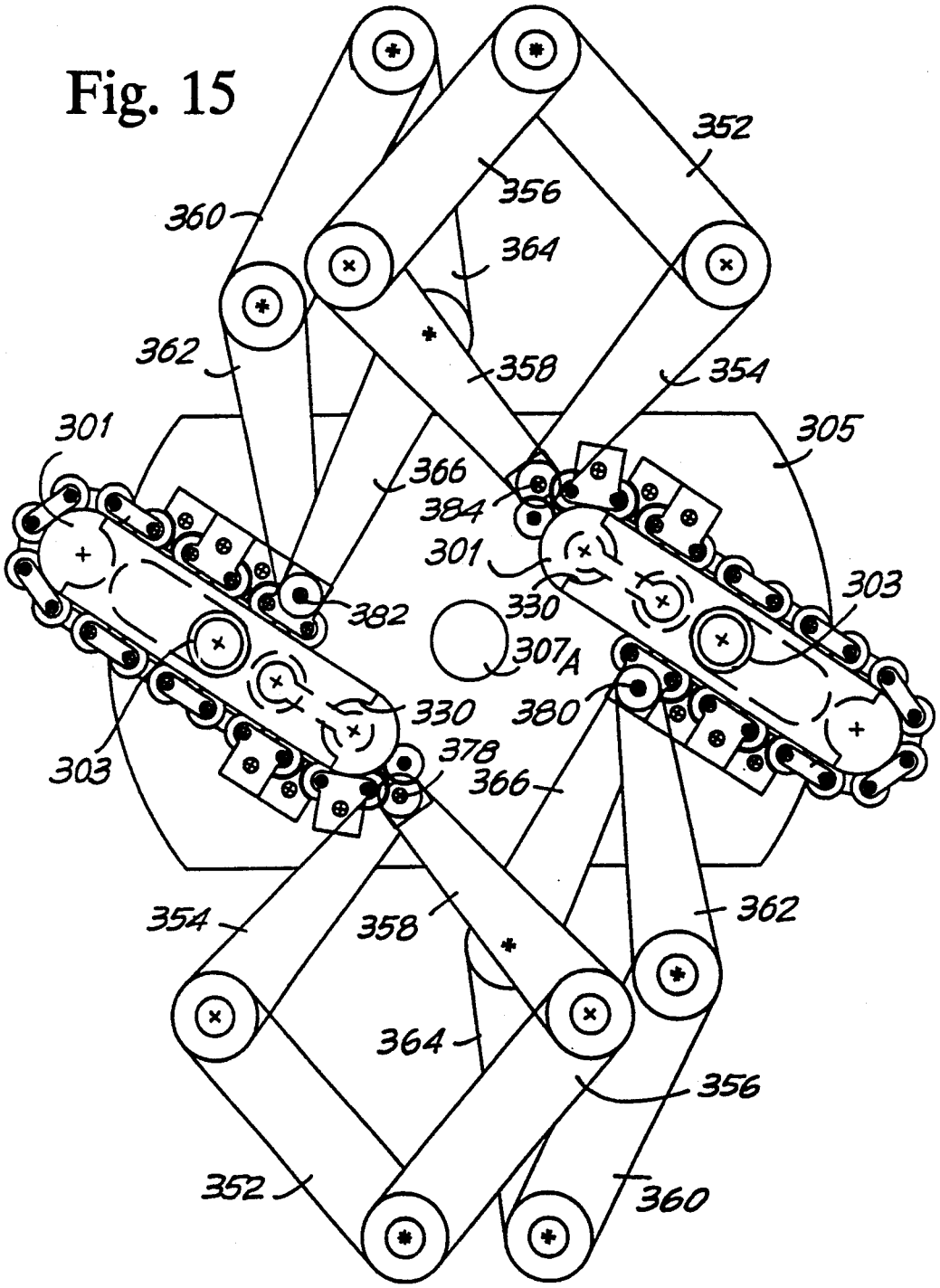
Figure 16:
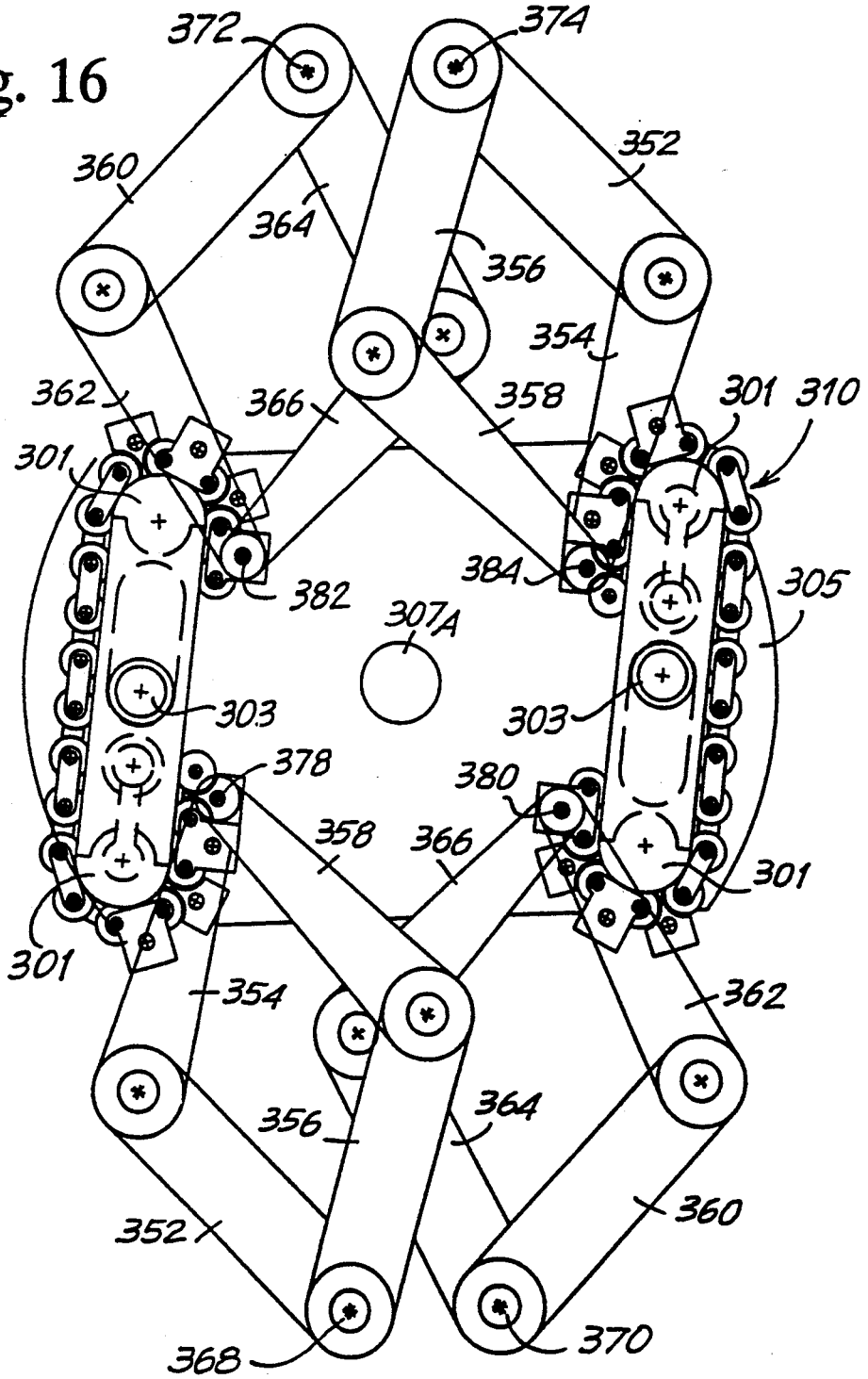
Figure 17:
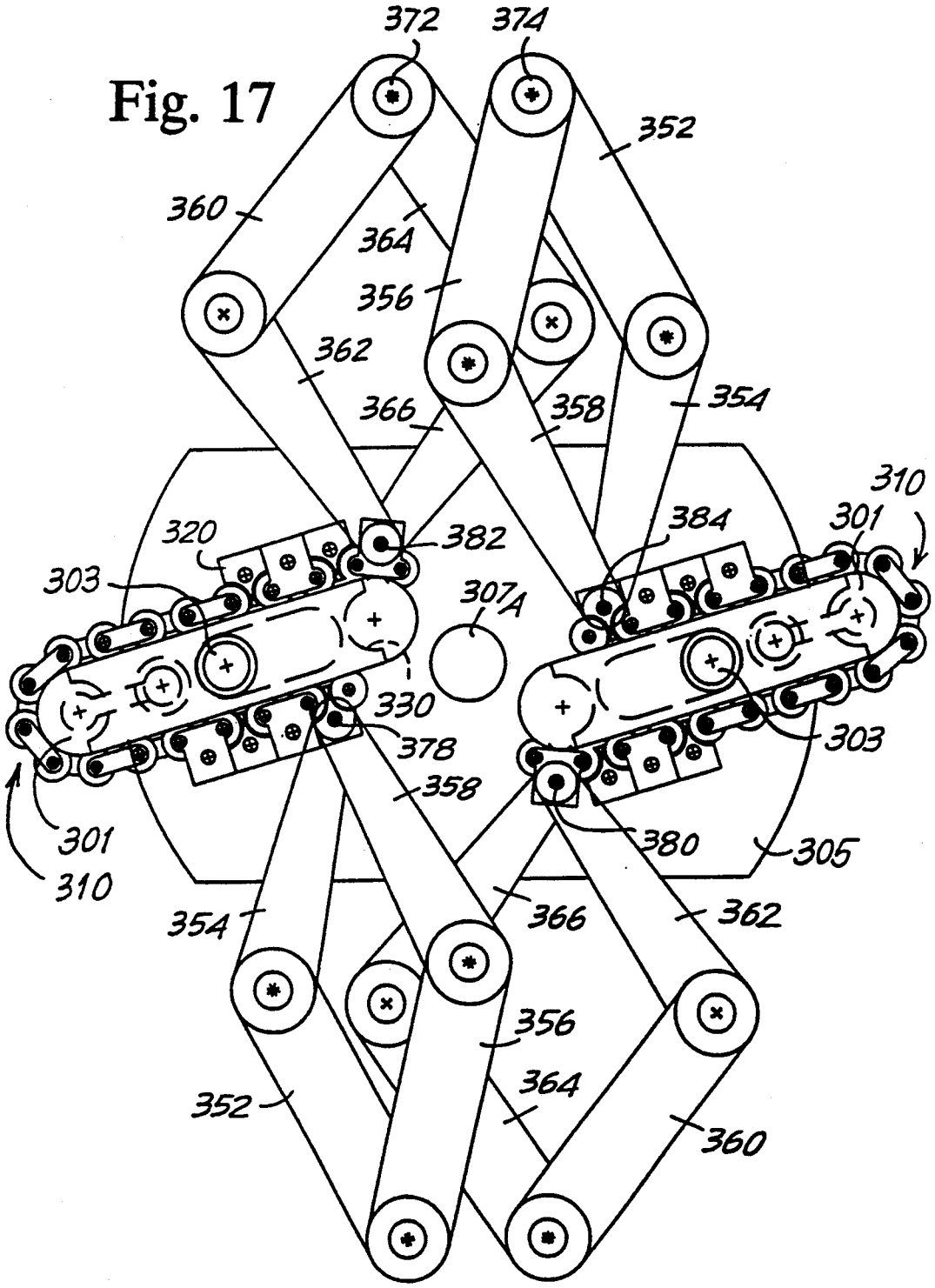
Figure 18:
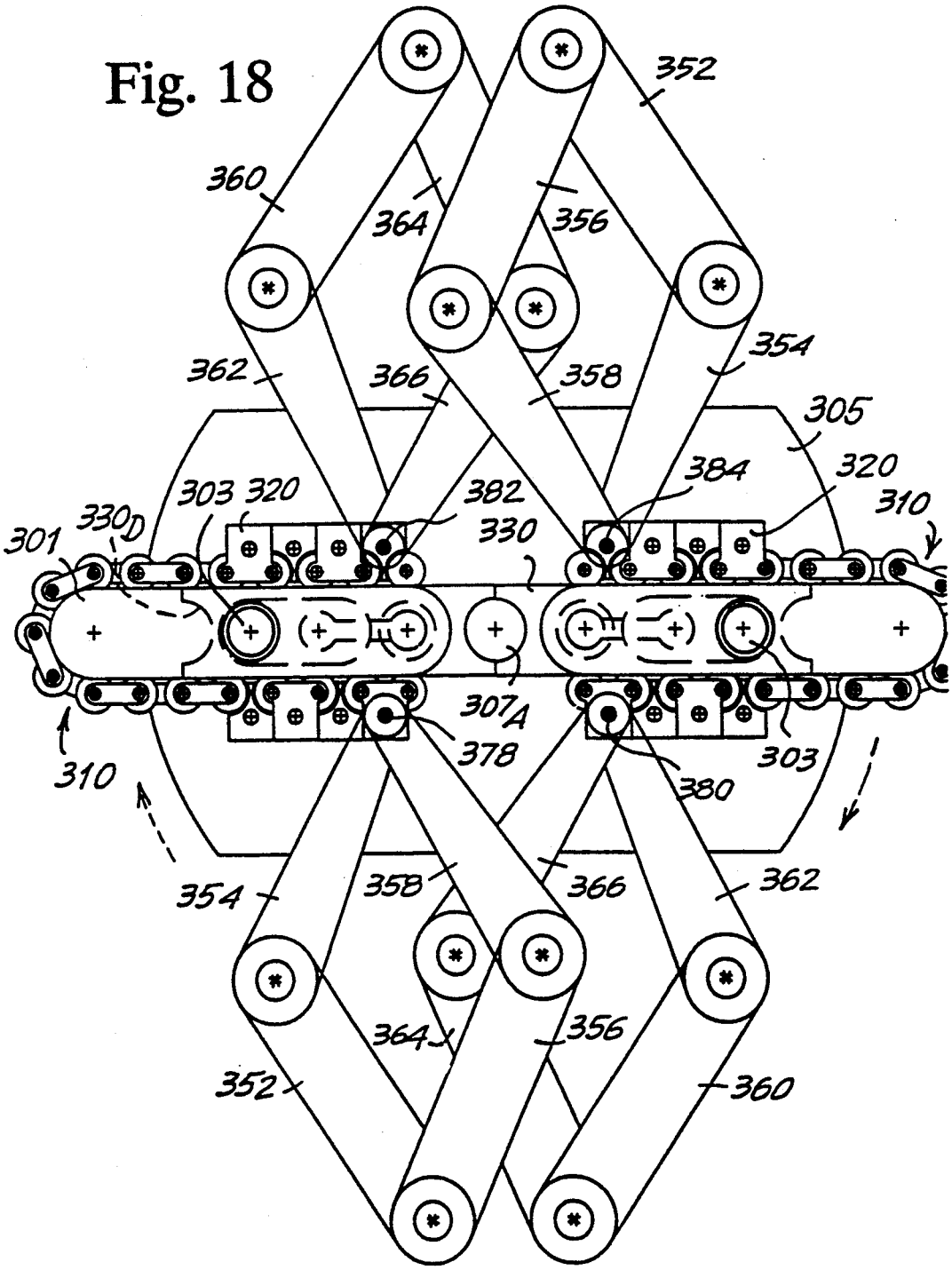
FIGS. 18 through 22 show, similarly to FIGS. 14 through 17, sequences of positions of a rotating composite needle bed during the formation of the body.
Figure 19:
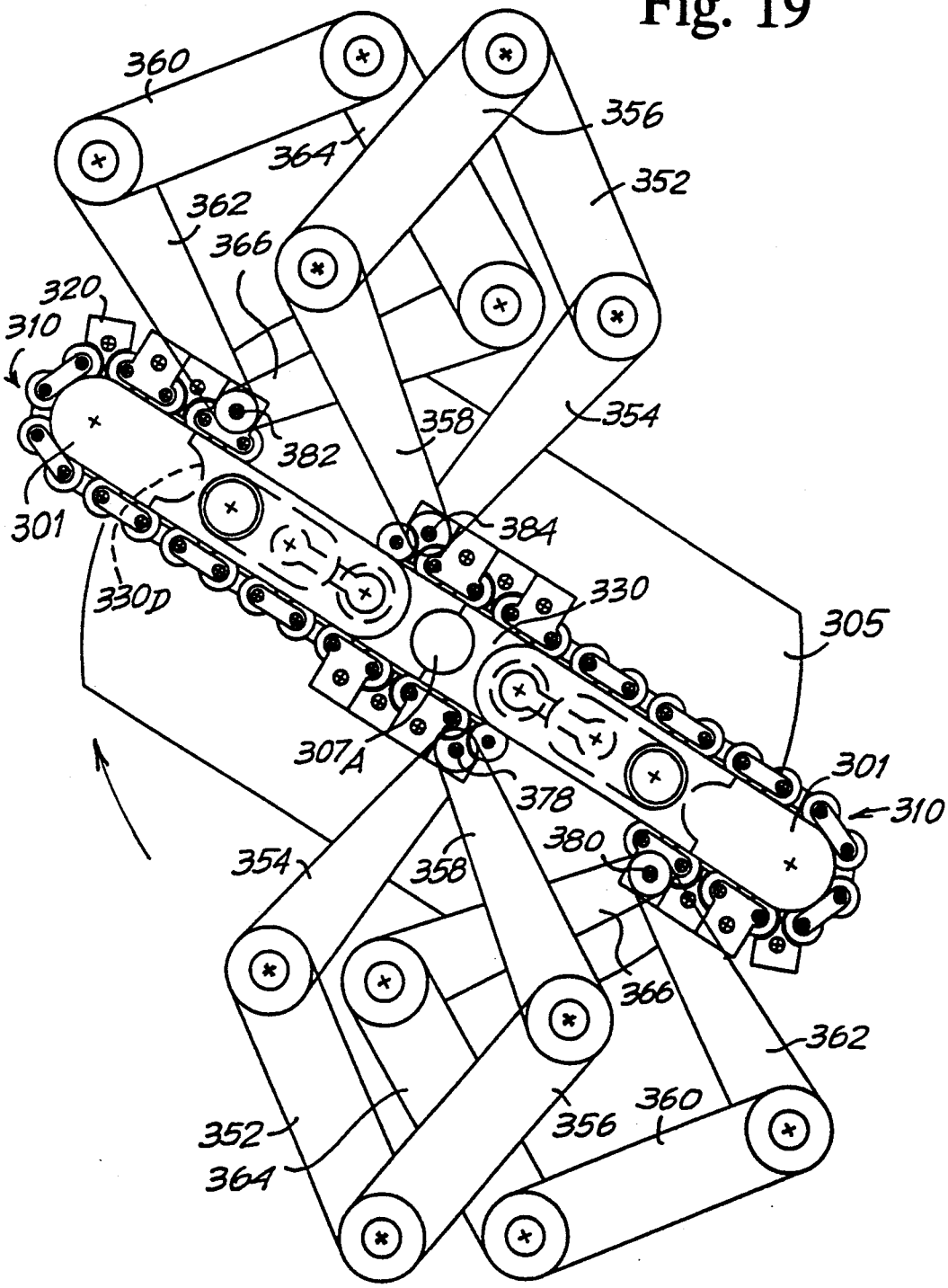
Figure 20:
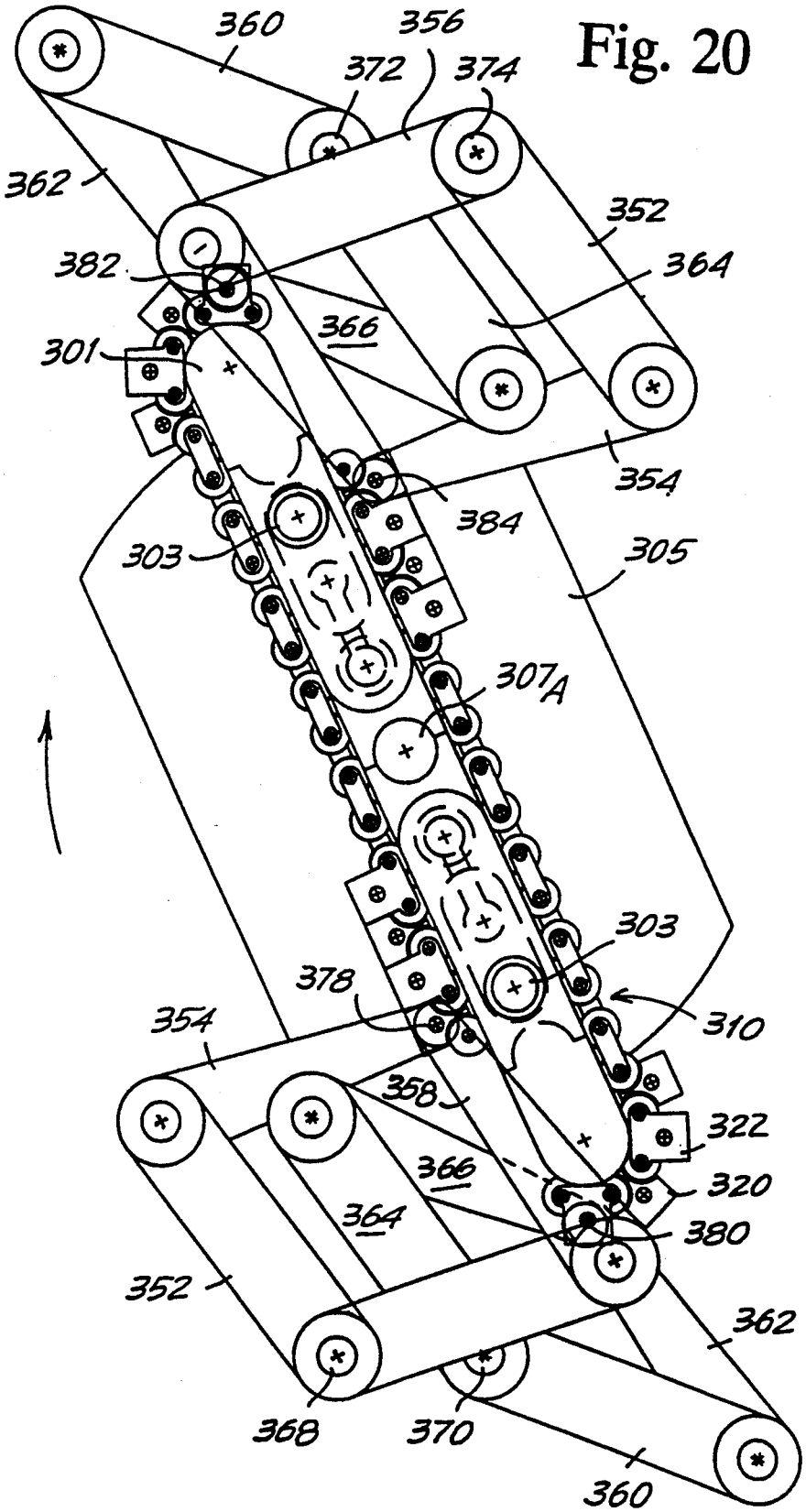
Figure 21:
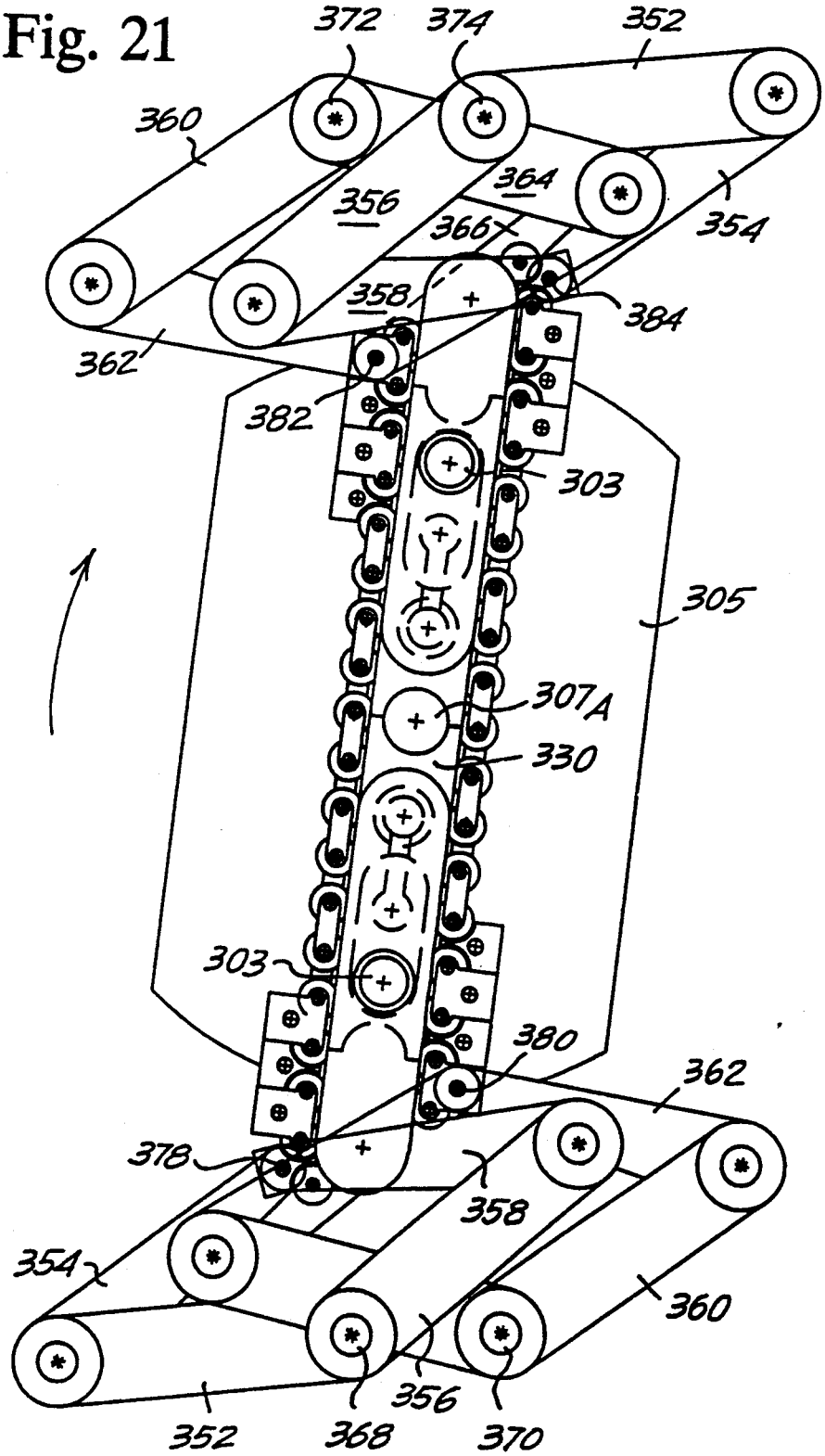
Figure 22:
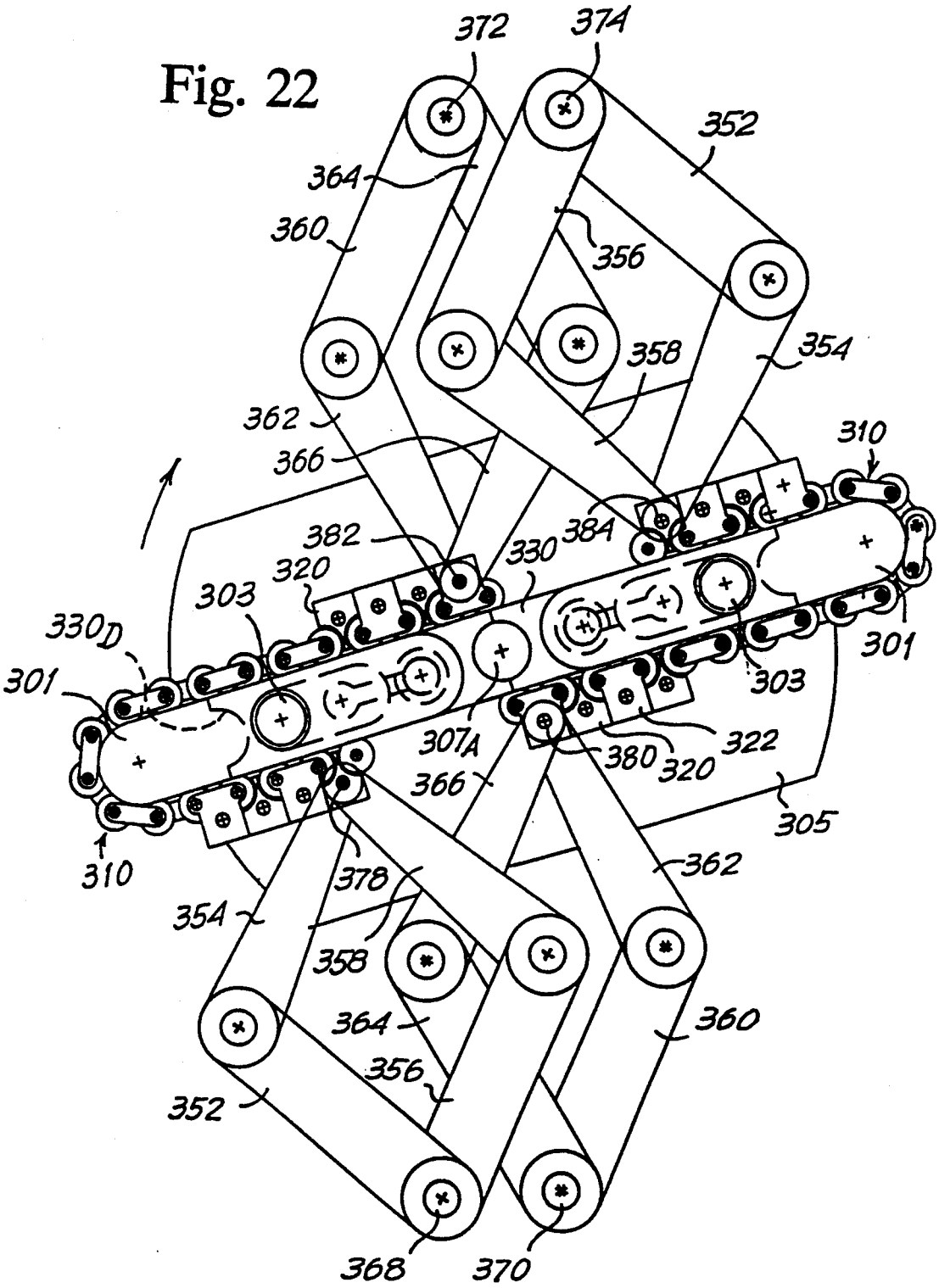

Each of the pivot axes 368, 370, 372 and 374 is composed of two coaxial shafts, each of which is intended to operate one of the coaxially pivoted arms. For example, the shaft 370 is double in order to operate the two arms 360 and 364, and the shaft 374 is double in order to operate the arms 352 and 356 respectively. Consequently, as shown in FIG. 27, the two coaxial shafts corresponding to the axis 370 carry two respective chain wheels 390 and 392 for two chains 394 and 396 respectively. The chains 394 and 396 drive the corresponding shafts on the axis 372 for the arms 360 and 364 which correspond to those of the coaxial shafts on the axis 370. Each of the chains, such as 394 and 396, must be able to be driven in two different ways, that is to say in accordance with two different programs for driving in two different ways the bent arms of the respective pantograph. For this purpose pairs of cams, such as 401, 403, 405, 407 are provided, all of which are driven with the aid of gearing by a horizontal shaft 409, and each of the cams operates a respective tappet 410, 412 and 414, 416 comprising an oscillating arm, the tappets 412 and 410 being coaxial, which is also true of the tappets 414, 416. The oscillating tappets 410, 412 are adapted to drive the chains 392, 394 by means of chain wheels such as 418 and 420. Electromagnets such as 422 and 424 (FIG. 27) or 426 and 428 respectively, associated with the oscillating arm tappets 410 and 412, or 414 and 416 respectively, are connected to each of the tappets, for coupling to one or the other of these chain wheels, for example by means of friction clutches. With the program by which the cams bring about the oscillation of the various oscillating arm tappets, such as 410 through 416, a program is determined for the movement of the respective chains in order to bring about the movement of the movable end fulcrum point 386 of each of the pantographs, in accordance with a predetermined program. By connecting the profiled cams in accordance with a predetermined program of movement, thrusts and withdrawals are obtained on the part of the two pantographs acting on the same chain 310, so that a returning action is first applied to the respective chains 310 against the guides formed by the profiles 301A, 301B, while the needle beds 328 together with the plates 301 rotate about the respective shafts 303. The chains and the respective textile devices connected to them are held in a predetermined position during the sliding movement which is made past them by the needle beds 328 rotating about the respective shafts 303. With another predetermined program of movement of the pantographs, which is obtained by switching over the transmission couplings between the tappets and the gears connected to the chains, such as 394 and 396, the chains 310 are retained relative to the tracks which guide them and which are formed by the plates 301 and consequently by the profiles 301A, 301B, and by the connecting profiles 330E, when the plates 301 are aligned relative to one another and the units 330 are brought close to one another. In this case all the needle beds 328, 332, 328 are in alignment with each other and rotate about the central axis represented by the shaft 307, while the chains 310 are held by the four pantographs. FIGS. 14 and 17 show some of the positions assumed by the needle beds 328 during their independent rotation about the axes of the shafts 303. FIGS. 18 through 22 show some of the positions assumed by the three aligned needle beds 328, 332, 328 during the rotation about the central axis of the shaft 307. The fabric leg tubes are thus first formed, followed by the body.

The units comprising the plates 301 and therefore the needle beds 328 can be rotated with the shafts 303 directly through the thrust applied by the pantographs to the chains, and consequently exerted by the latter on the chain guides of the respective units. The same may be said of the series of guides formed by the profiles 301A, 301B and 330E when the various needle beds 328, 332 and 328 rotate together with the plate 305 to form the body after the two legs have been formed, through the rotation of the needle beds 328 alone. The profiles of the pantograph control cams can therefore be designed to bring about, through the coordinated thrust of the various pantographs acting on the unit. The rotation also of the unit while the respective chains are held, in such a manner as to bring bout the sliding in relation to one another of the needle beds and of the textile component parts is carried by the carriages 320 and 322.

During the formation of the legs, that is to the rotation of only the needle beds 328 in concord but independently of one another, the plate 305 is locked against rotation about its own central shaft 307, while the shafts 303 are free to rotate in the bearings such as 450 by which the shafts 303 are mounted on the plate 305. When the unit connected to the plate 305 has to rotate about the axis of the shaft 307, the needle beds 328, 332 and 328 being in alignment, the plate 305 is released and the units 330 are brought close together so as to engage the extension 307A of the shaft 307 with the profiles 330D and thus prevent the relative rotation of the needle beds 328 about the axes of the shafts 303. The three needle beds 328, 332, 328 are together fastened to the shafts 303 and the rotation of all the units of the plate 305 and of all the needle beds about the axis of the shaft 307 is brought about. In this solution both of these rotations are entrusted to the program of movement of the pantographs acting on the needle bed guide assemblies formed by the profiles 301A, 301B and 330E.

Figure 47:
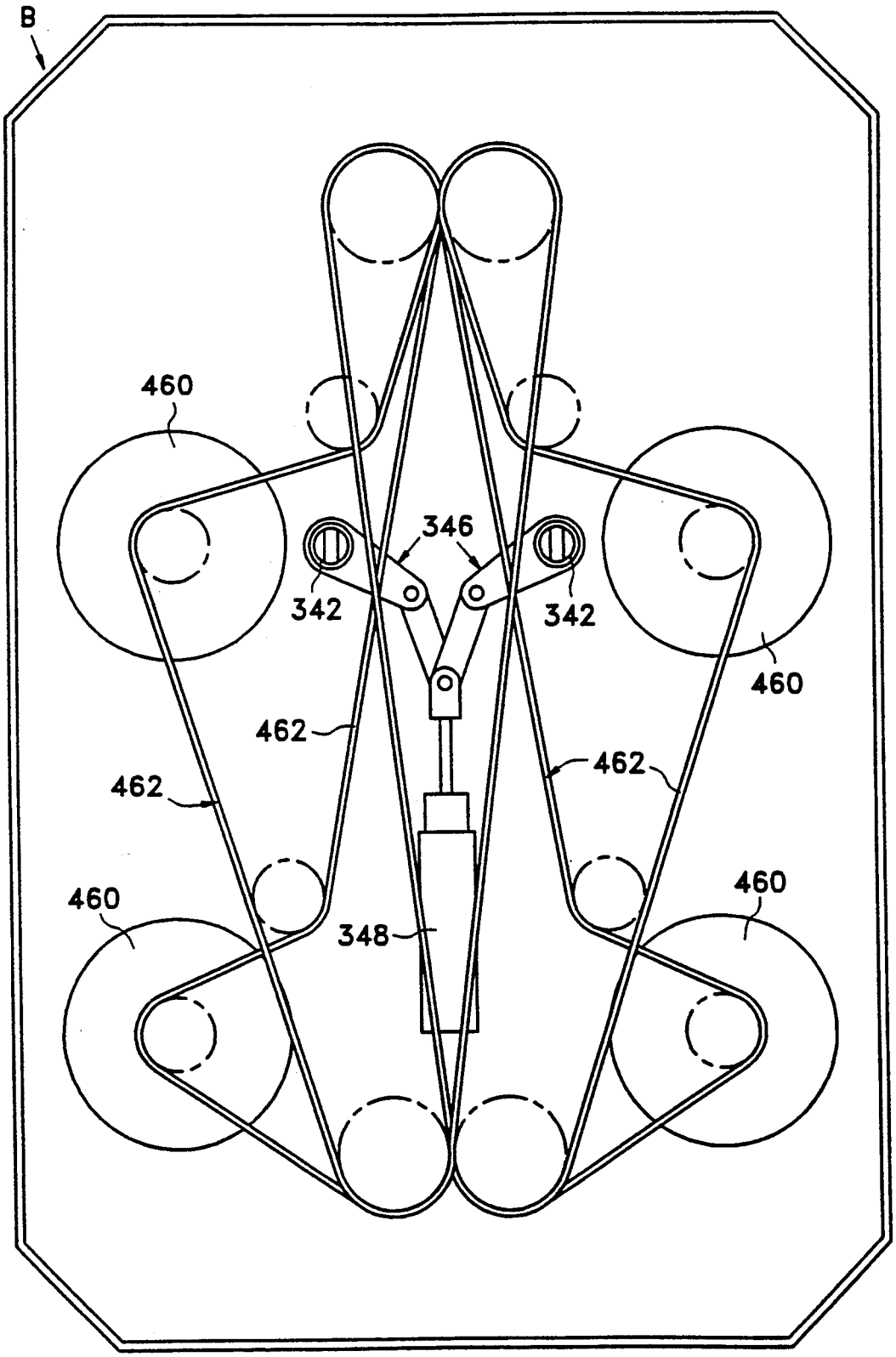
FIGS. 47 and 48 show in plan view and in side view a modified embodiment entailing the use of controlled motors.
Figure 48:
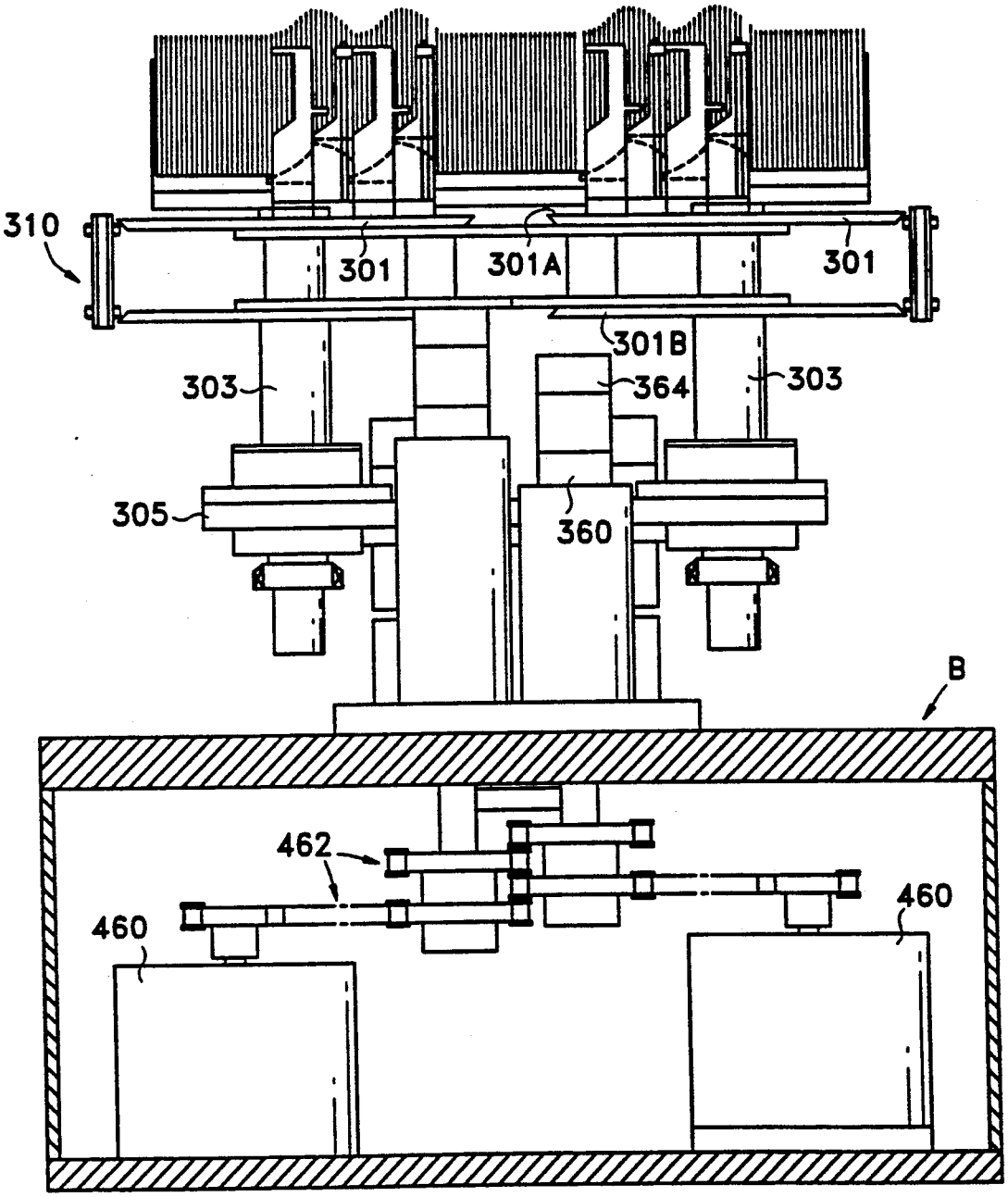

In the variant embodiment indicated in FIGS. 47 and 48, the series of cams such as 401, 403, 405, 407 and of the respective tappets such as 410, 412, 414, 416, and of the respective friction clutches can be replaced by drives comprising motors suitably controlled electronically to form "axis control" systems, that is to say electronic cam systems. It is possible to use stepping motors or electronically controlled direct current motors, as indicated generically by 460 in these figures. In this case also chains will also be provided, such as are indicated generically at 462 for all the arrangements, in order to obtain for each phase of the operation an appropriate drive equivalent to that obtained with the cams, so as to achieve control of the thrust of the pantographs acting on the chains and on the plates carrying the needle beds, in order to bring about the rotation.

Figure 49:
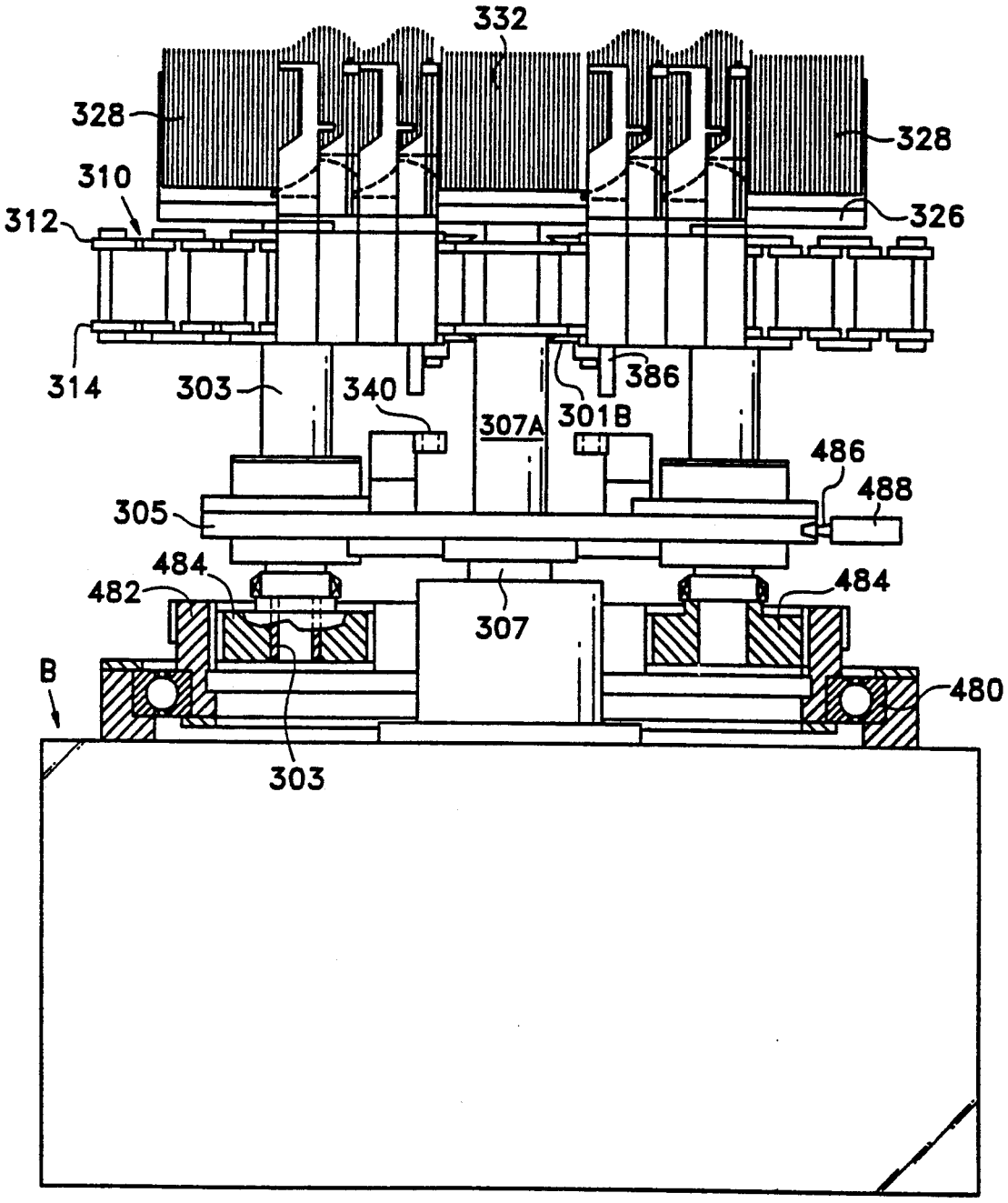
FIGS. 49 through 51 show in plan view and in partial vertical section, and in plan view, an embodiment comprising geared drives for rotating the needle beds for legs, and a simplification in plan view.
Figure 50:
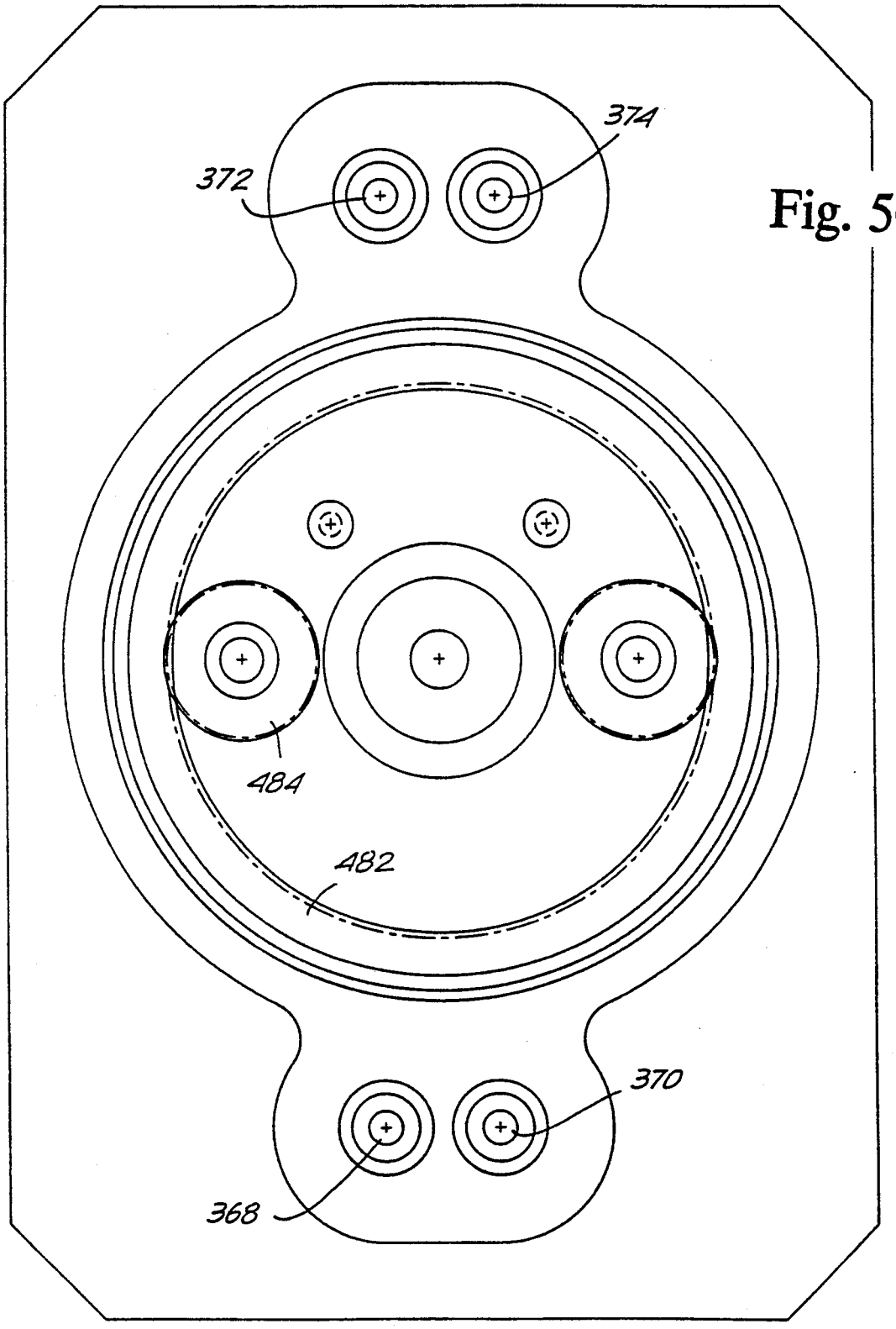

According to a variant embodiment, which is derived from the embodiment indicated in the first example described in connection with FIGS. 1 through 13, provision may be made to bring about the rotation of the plates 301 together with the support plates 326 and the needle beds 328, and also the rotation of the plate 305 with the set of needle beds 328, 332, 328, with the aid of rotational drives not depending on the pantographs, the latter being used solely to retain the chains in relation to the guides and in a position such as to hold them during the rotation of the needle beds. According to FIGS. 49 through 51, on the base B a rolling contact bearing 480 is provided, on which is mounted a ring 482 having an outer toothed rim receiving rotary movement from an external gear, and having an internal toothed rim which meshes with two gears 484 fastened to the bottom ends of the tubular shafts 303, which are mounted on the plate 305 which is rotatable on the central shaft 307. If a retaining pin 486 operated by an actuator 488 is provided, it is possible to lock the plate 305 so that the latter, being unable to turn, permits the rotation of the shafts 303 through the action of the transmission consisting of the ring 482 meshing with the gears 484. In these circumstances, the units 330 being distant from one another, the two needle beds 328 rotate independently of one another but in synchronism and thus the legs of the product are formed. When it is required to work with the three needle beds 328, 332, 328 in alignment with one another, and with the units 330 brought close to one another, the plates 301 are fastened together for the engagement of concave profiles 330D, thus preventing the rotation of the shafts 303. In these circumstances, by freeing the plate 305 from the retaining action of the pin 486, the ring 482 will directly drive the entire assembly connected to the plate 305, including therefore the three needle beds aligned with one another, by means of the gears 484 which are not able to rotate. In these circumstances the chains are held by the pantographs (or other equivalent devices) and constrained to slide in relation to the guides formed by the profiles 301A, 301B and 330E, while the sets of needle beds 328, 332, 328 rotating about the central axis of the shaft 307 slide in front of said chains and the textile component parts carried by them. This being the case, the pantographs serve only to retain the chains 310.

Figure 51:
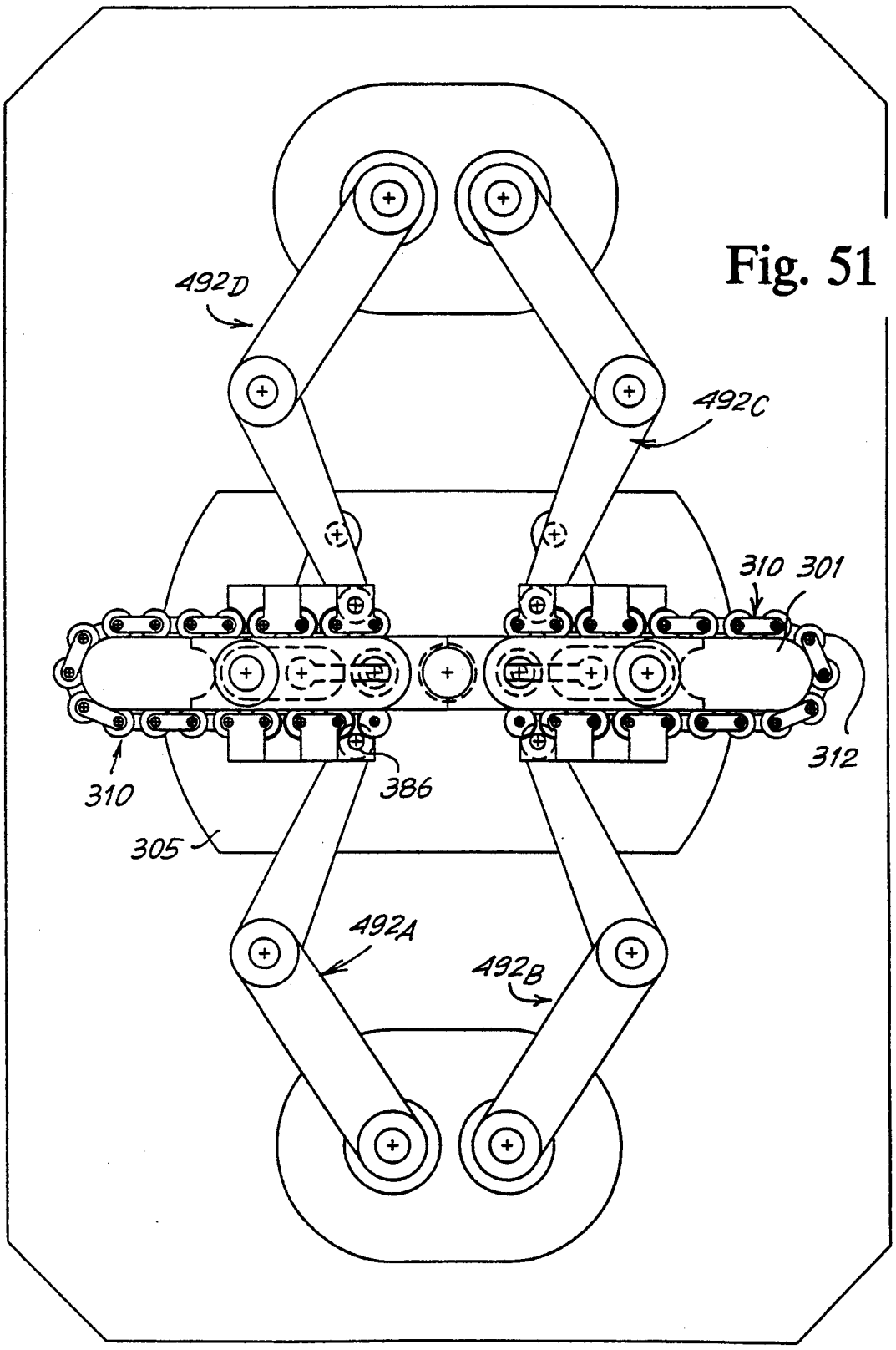
Figure 52:
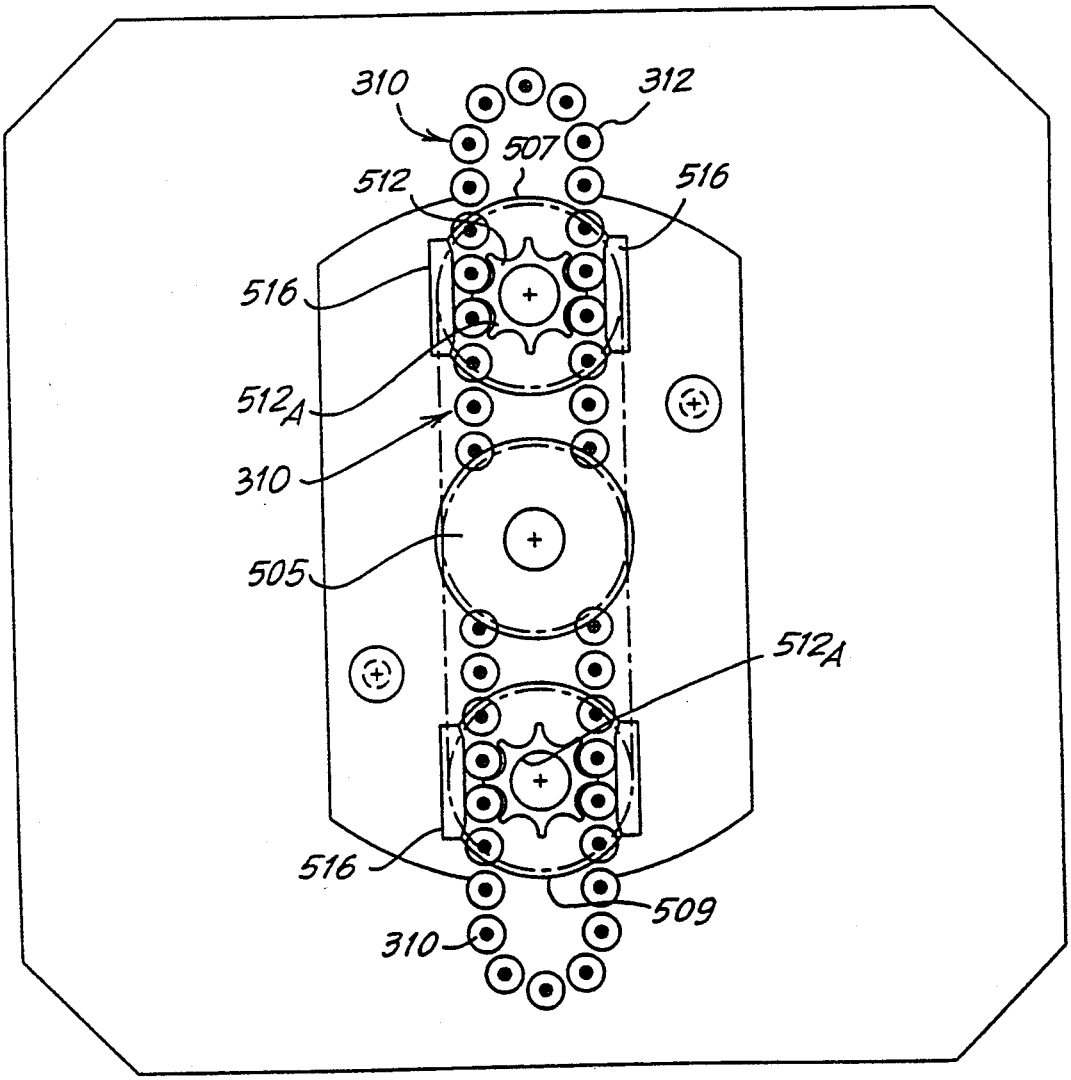
FIGS. 52 through 56 show another construction of the machine according to the invention in plan view, in two vertical sections and in the form of two enlarged details of FIGS. 53 and 54.
Figure 53:
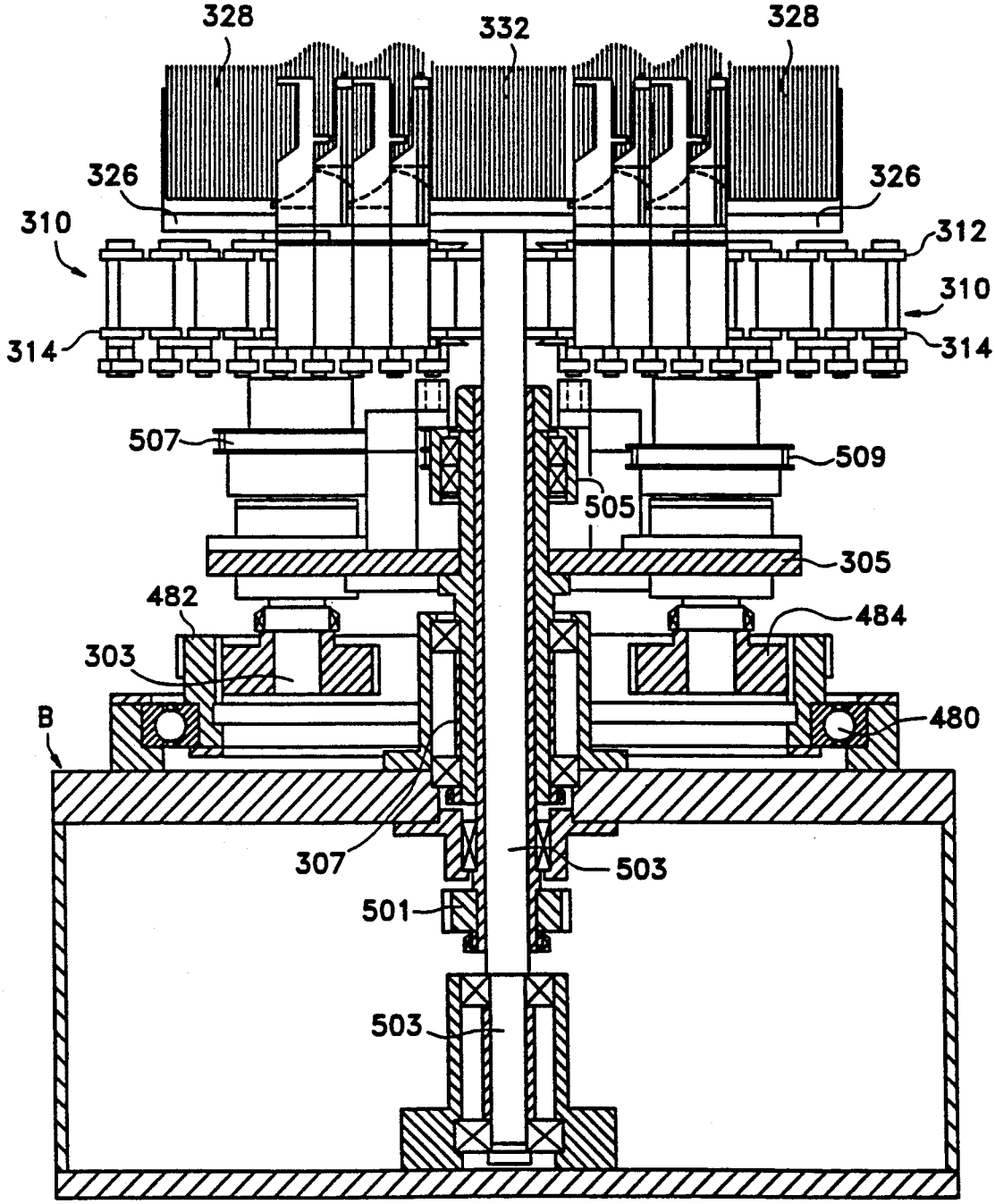
Figure 54:
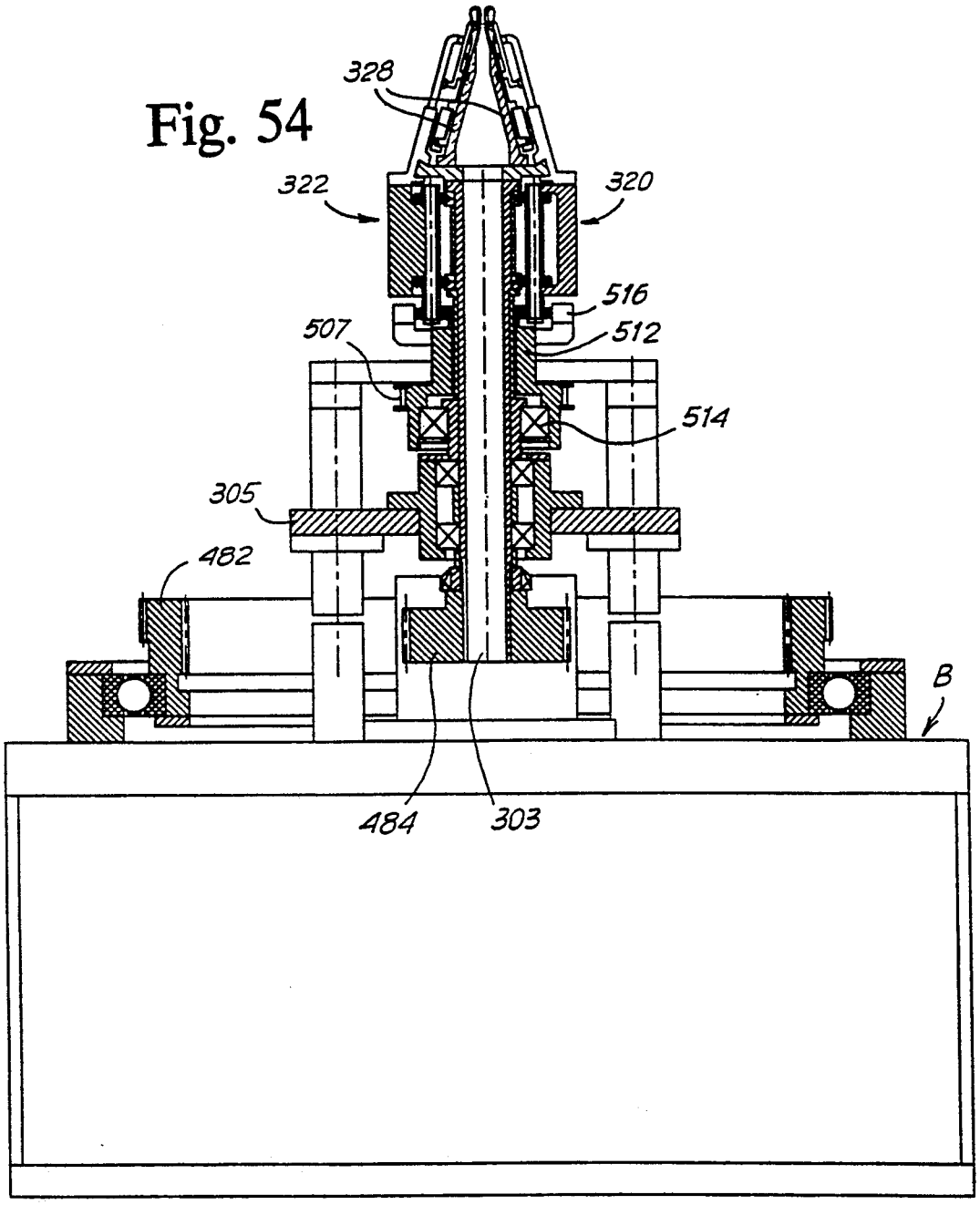
Figure 55:
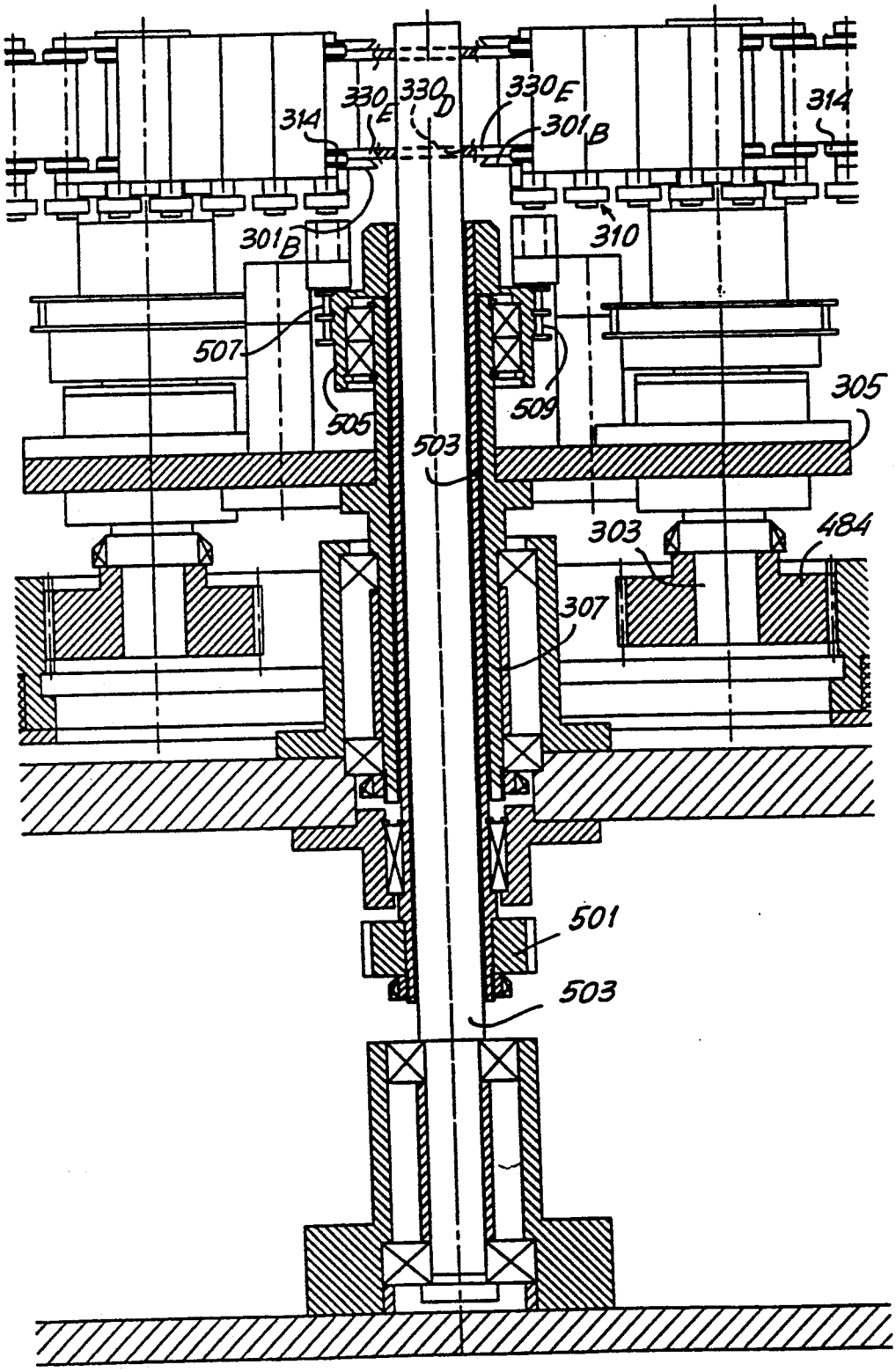
Figure 56:
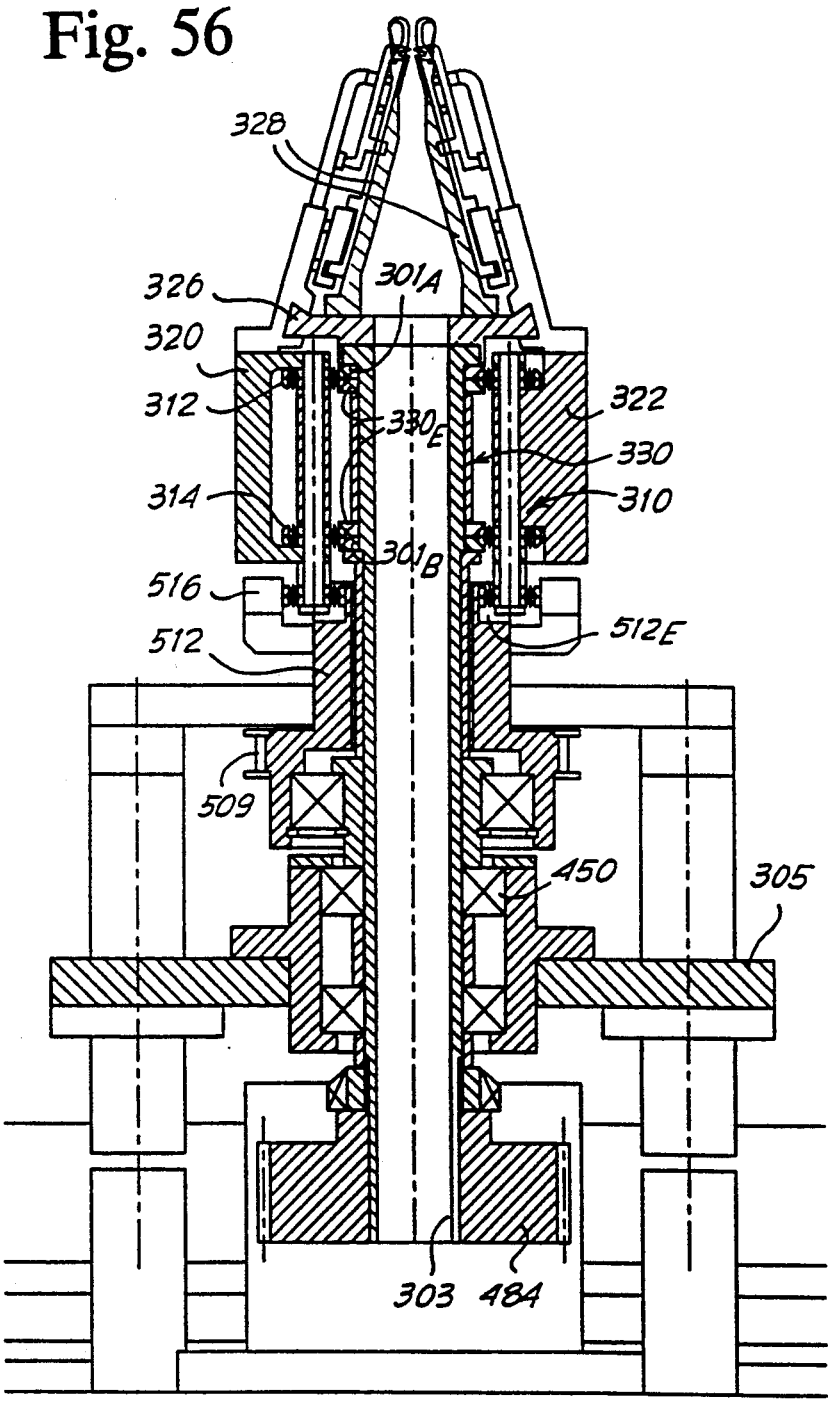

According to the simplification shown in FIG. 51, in a solution of the type in which the motorization for the rotation of the needle beds is entrusted to a specific kinematic system, it is possible to simplify the function of the pantographs by providing on the one hand a positive action and on the other hand a resilient action to ensure the adhesion of the chains 310 to the guide profiles, such as 301A, 301B and 330E provided for them in the plates which rotate in the two working modes. According to this figure simplified pantographs are provided in the form of bent arms 492A, 492B, 492C, 492D, which are in part operated positively by the cams or by the direct current motors or in some equivalent manner, and in part are simply subjected to a resilient action which is added to the positive drive action in order to ensure adhesion and to take up play. Provision may be made for the bent arms 492A and 492B or the arms 492A and 492C to be operated positively, and for the remainder to be acted on resiliently.

Another embodiment provides a different system for retention of the chains on their guides in each of the working modes of the machine, in which the pantographs are dispensed with and the chains are provided with star-shaped members adapted to engage them and impart to them compensating movements for their retention relative to the rotation of the needle beds. In this case the chains are held against the guides 301A, 301B and 330E through the action-of magnetic attraction.

In FIGS. 52 through 62 a solution of this type is illustrated in which the movement of the needle beds is achieved with the aid of a drive comprising a ring 482 having double toothing and gears 484, as indicated above. Corresponding members are given the same reference numerals as were used for previous examples, such as the plate 305 intended to move the set of three needle beds 328, 332, 328 on the shaft 307, which in this case is tubular and is again mounted on the base B. The plate 305 carries the shafts 303 with the gears 484 meshing with the toothed ring 482, and the shafts 303 carry the assemblies comprising the plates 301 and the chains 310 for driving the needle beds 328 during the formation of the legs. In order to apply a retaining action to the chains 310 relative to the rotating needle beds, as a replacement for the action of the pantographs in the preceding examples, a second transmission is provided between a movement take-off member 501 coaxial to a central pillar 503, around which the tubular central shaft 307 extends. The movement take-off member 501 is fastened to a tubular shaft 503 inside the tubular shaft 307. The shaft 503 transmits the rotation to a double pinion 505, which by means of two chains 507 and 509 takes the movement to respective star-shaped members 512 mounted by means of bearings 514 coaxially and independently on the respective shafts 303 above the system by which the latter is mounted on the plate 505. Each star-shaped member 512 is provided at the top, level with the chain 310, with star toothing 512A meshing by its teeth with the respective chain 310 so as to exert through its movements a retaining action on the chains so that the textile component parts associated with the chains can slide with the aid of the carriages 320 and 322, with an action similar to that of the pantographs, while the needle beds rotate individually or conjointly. In a position corresponding to the star toothings 312A, a support 516 is provided, which ensures that the teeth of the star toothings 512A mesh with the chain links.

Figure 57:
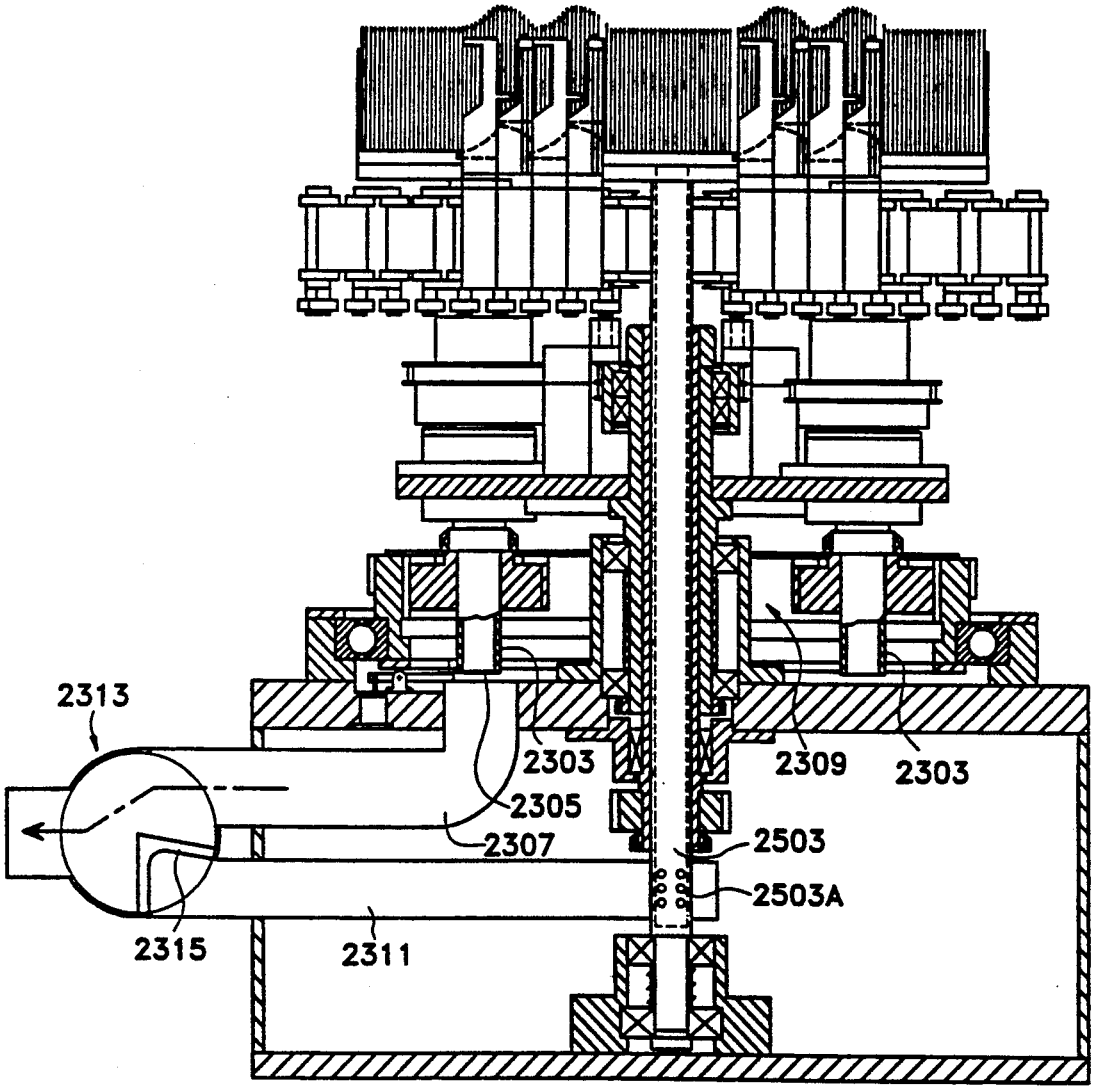
FIGS. 57 and 58 show a variant of FIGS. 52 through 56 to illustrate a pneumatic tensioning and separation system.
Figure 58:
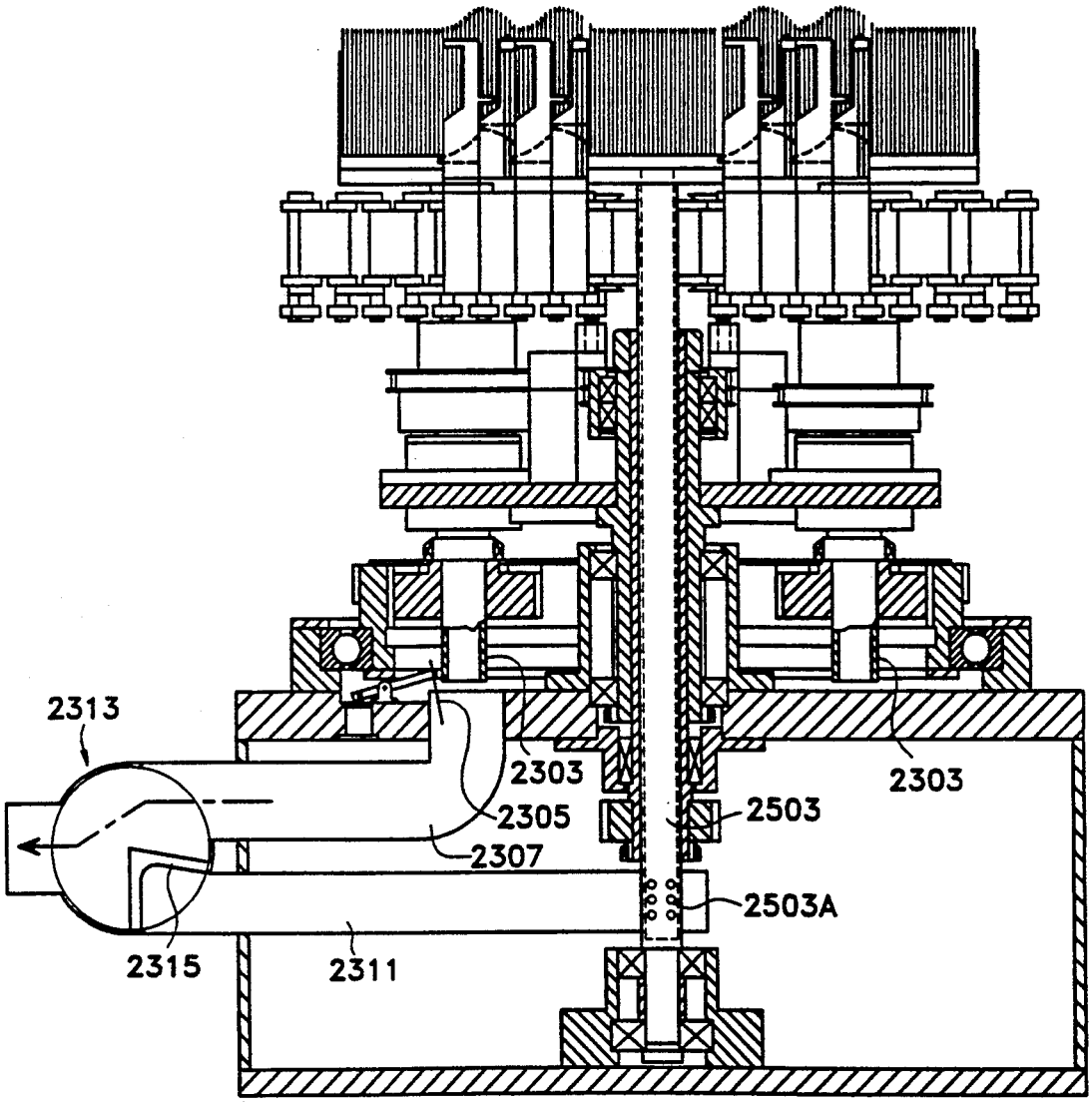
Figure 59:
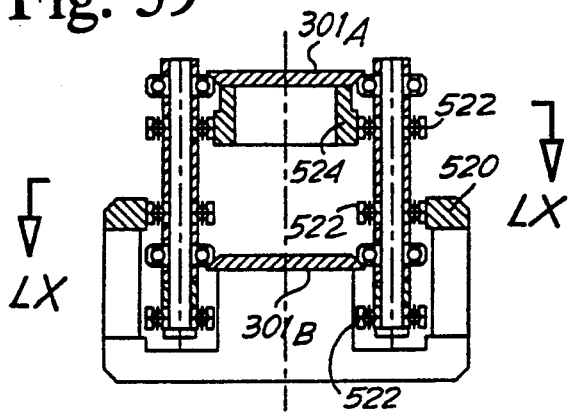
FIGS. 59 through 62 show constructional details of the tracks and of the flexible members sliding over them, in section and in plan.
Figure 61:
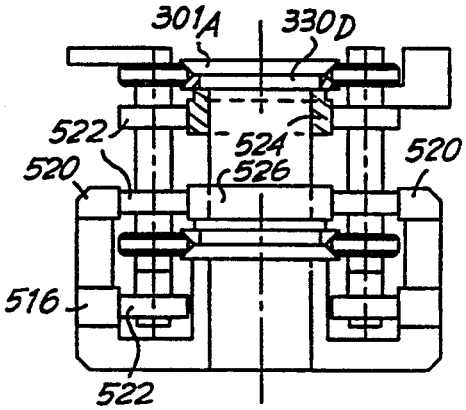
Figure 60:
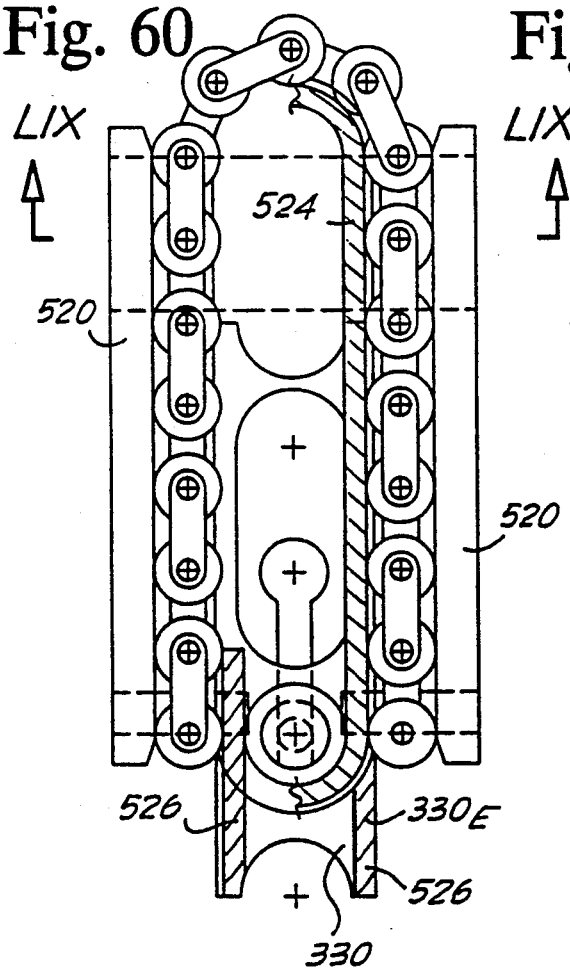
Figure 62:
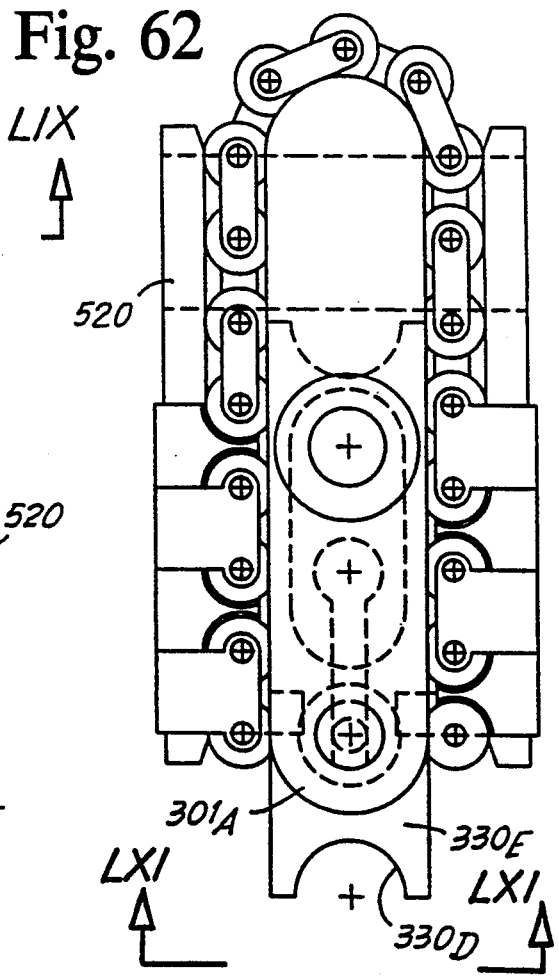
Figure 63:
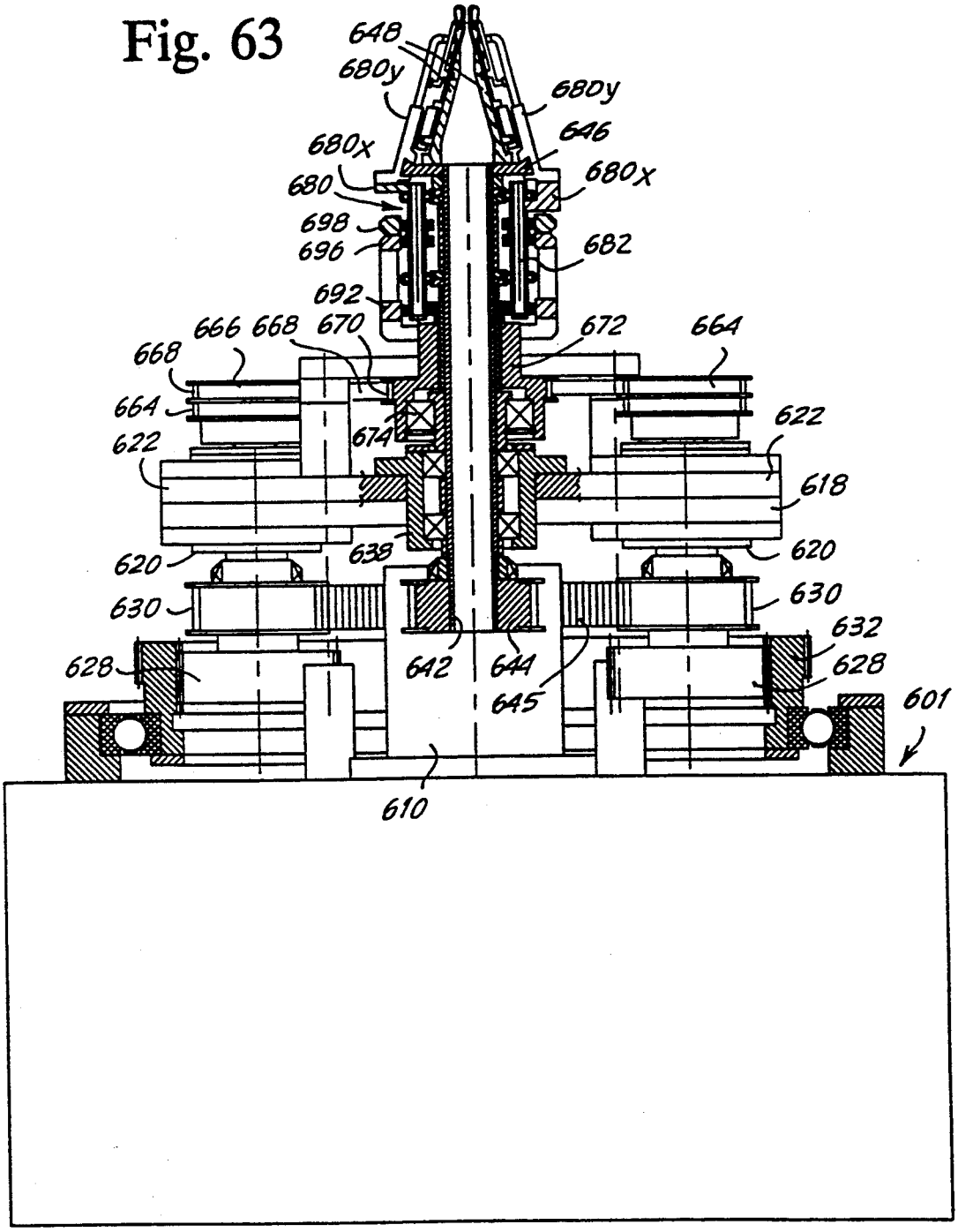
FIGS. 63 and 64 show two vertical sections of another form of construction of the machine, with angled arms.
Figure 64:
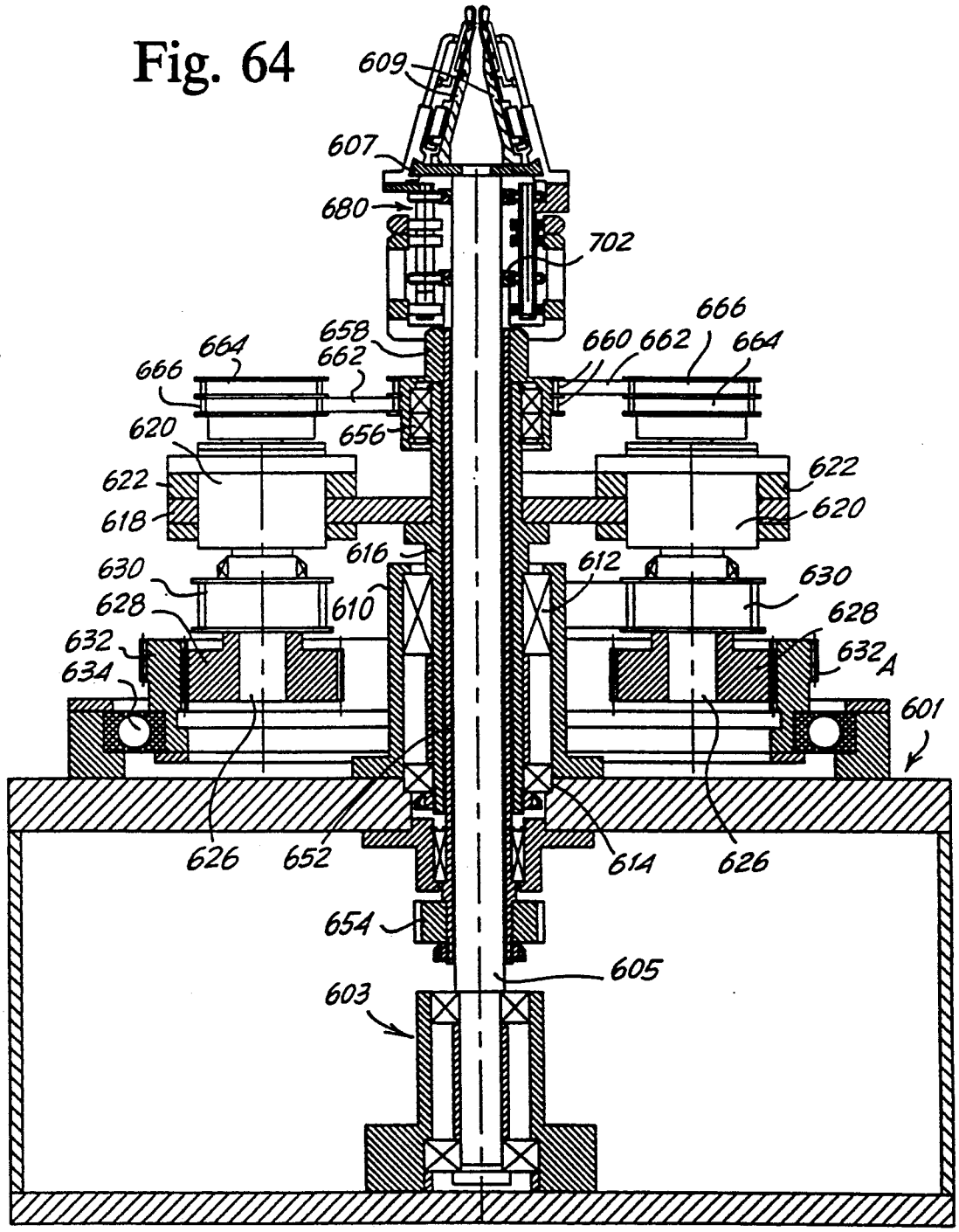
Figure 65:
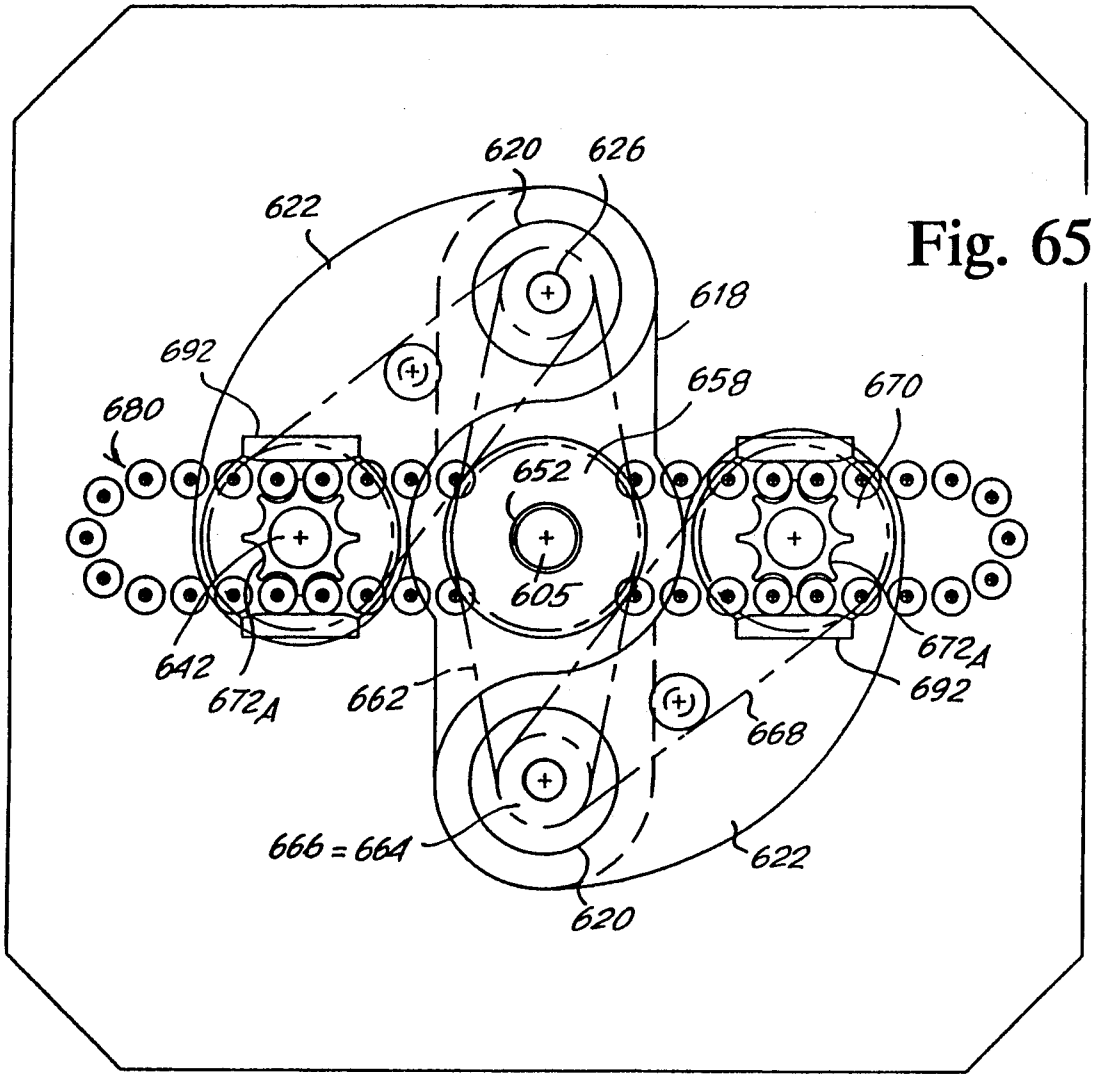
FIGS. 65 and 66 show schematic plan views.
Figure 66:
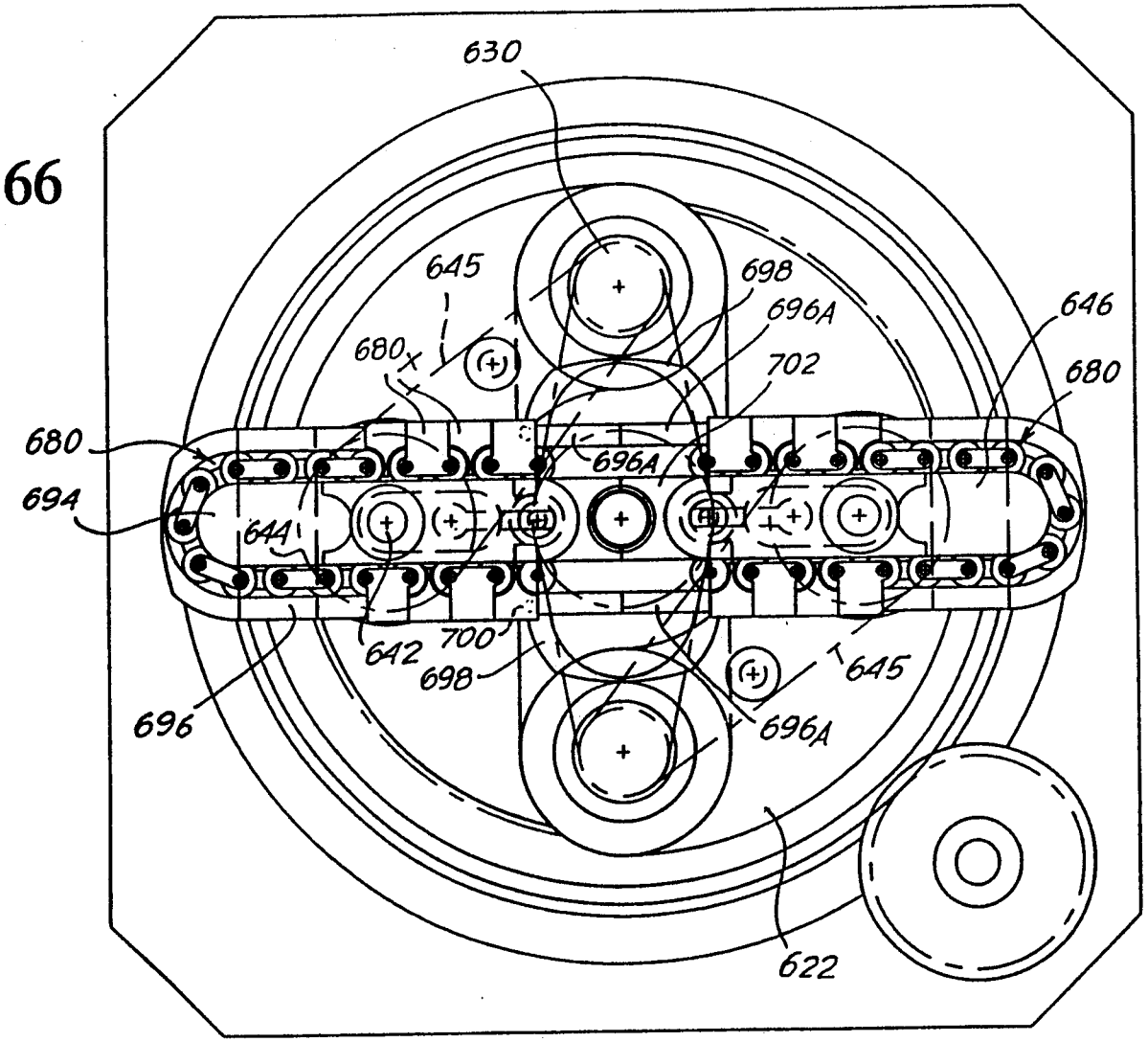
Figure 67:
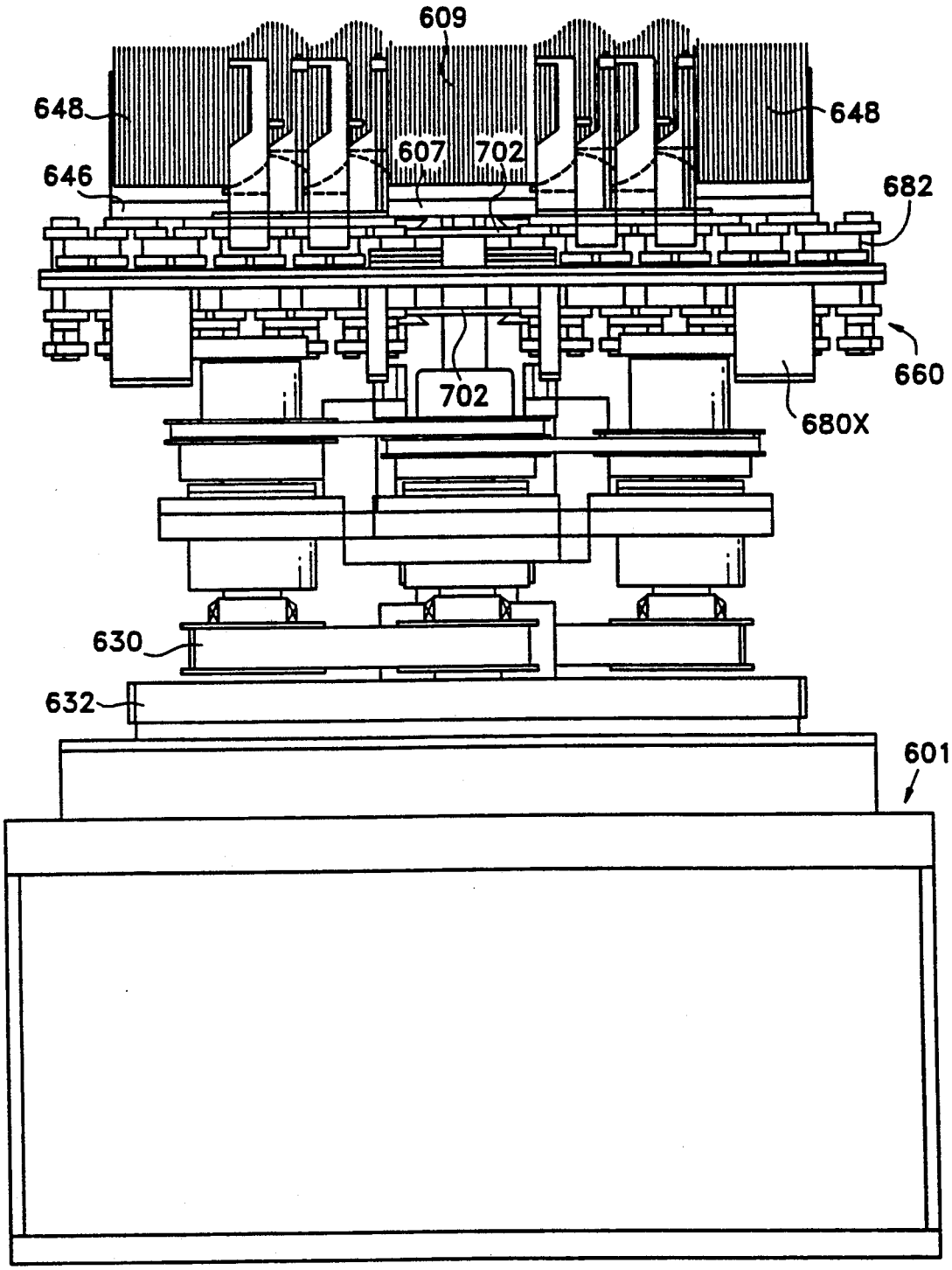
FIGS. 67 and 68 show a vertical section and an enlarged detail thereof.
Figure 68:
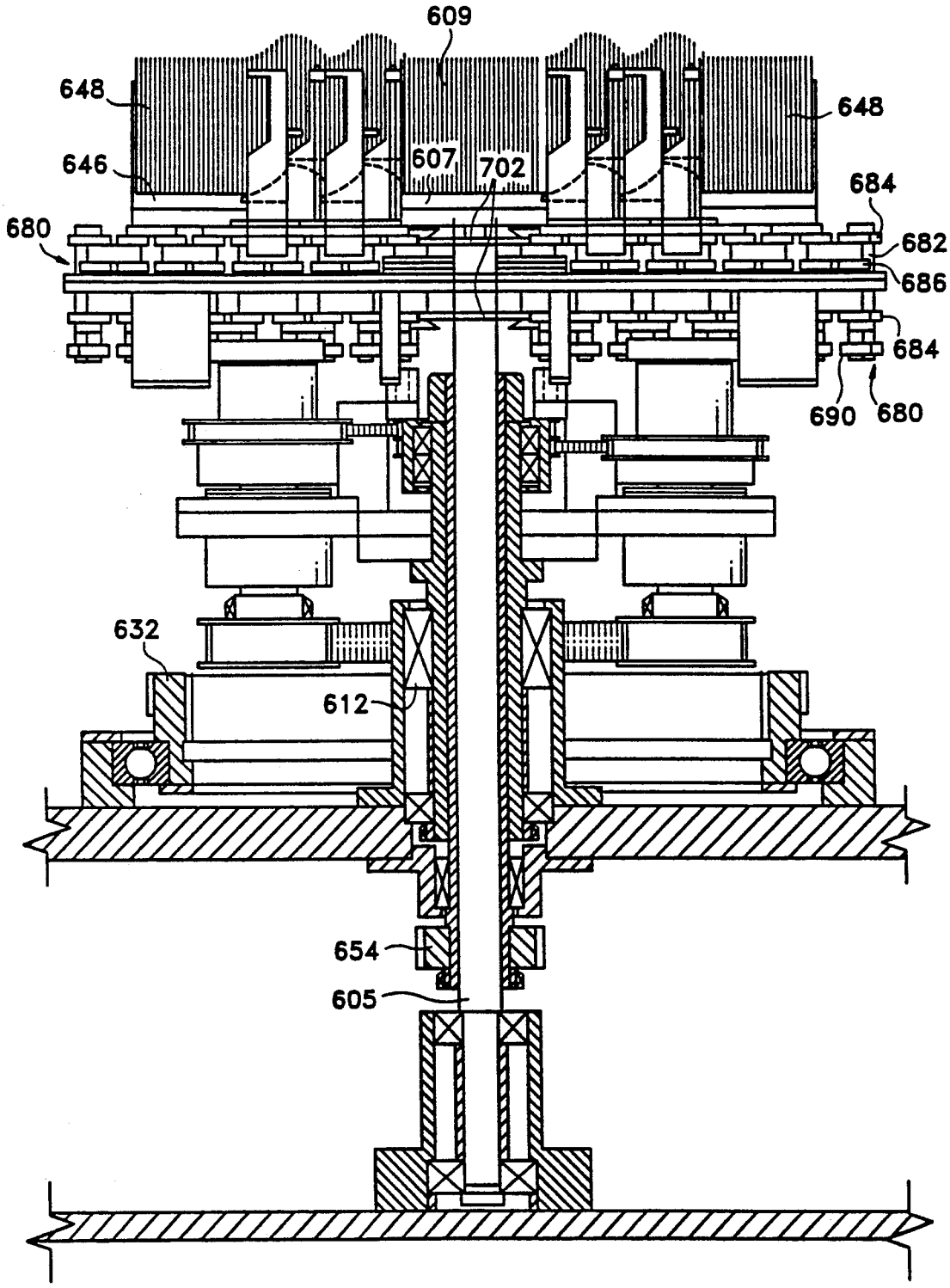
Figure 69:
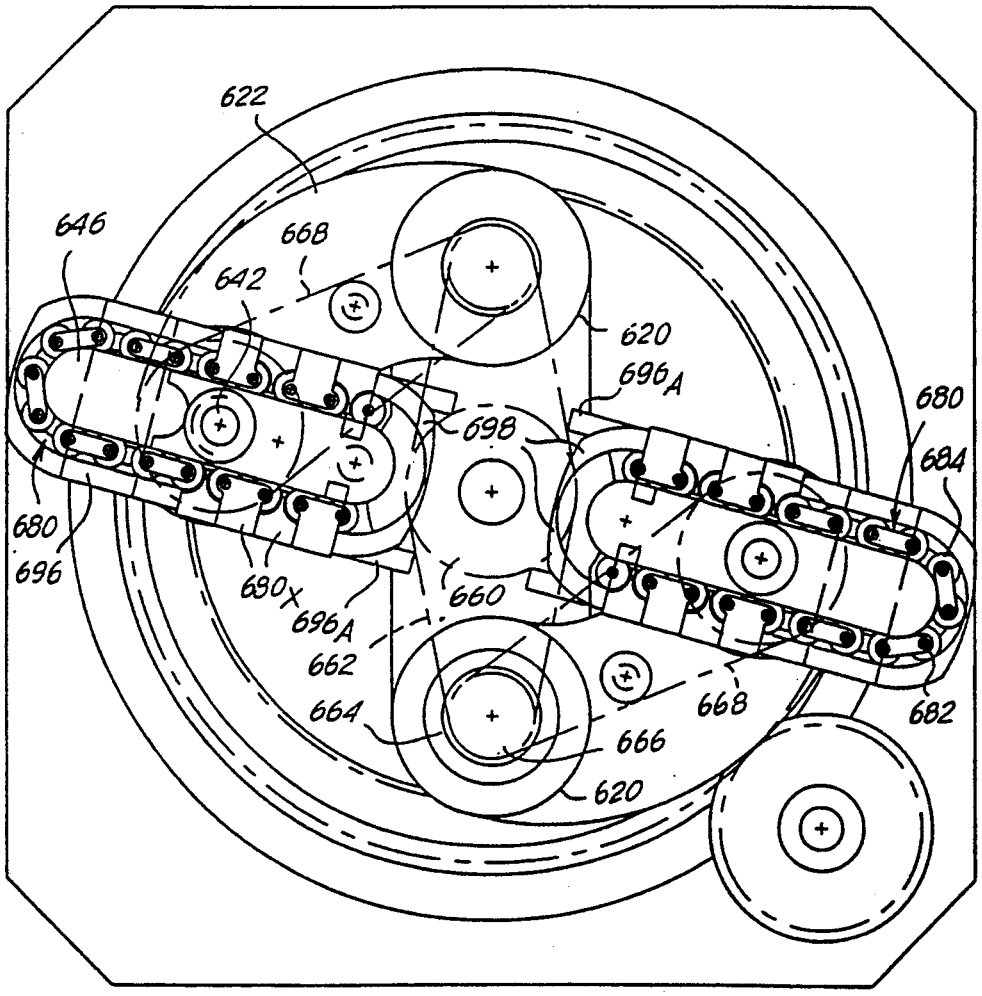
FIGS. 69 and 70 show two schematic plan views.
Figure 70:
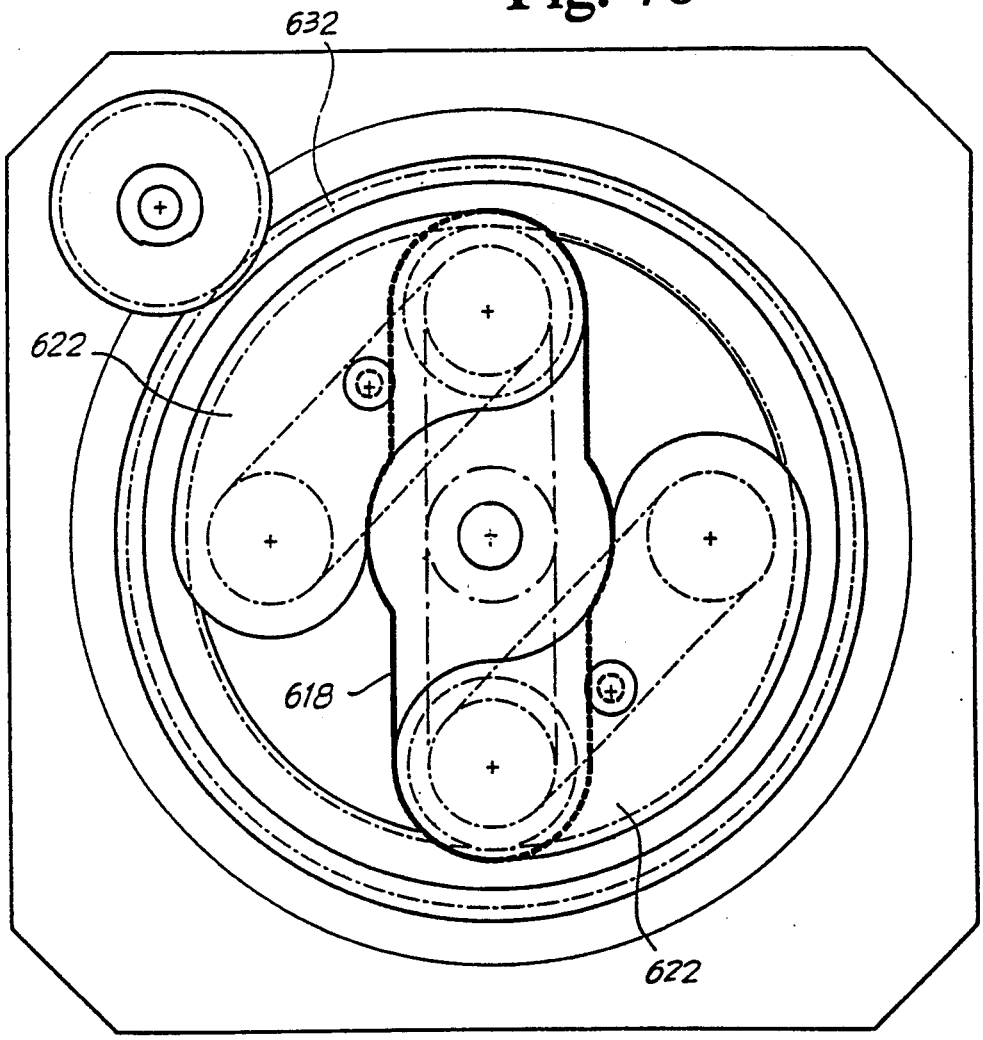
Figure 71:
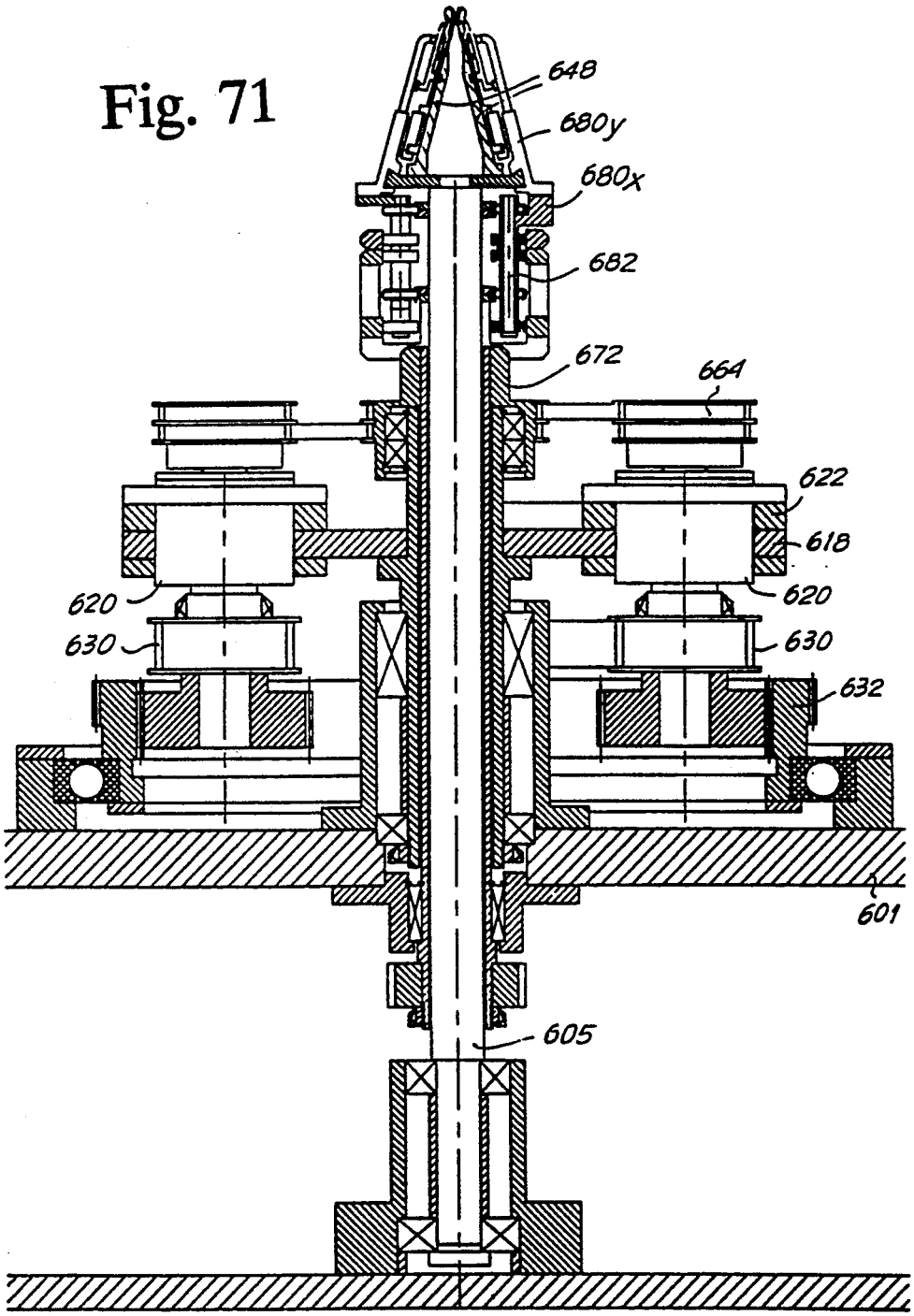
FIGS. 71 and 72 show a vertical section and an enlarged detail thereof.
Figure 72:
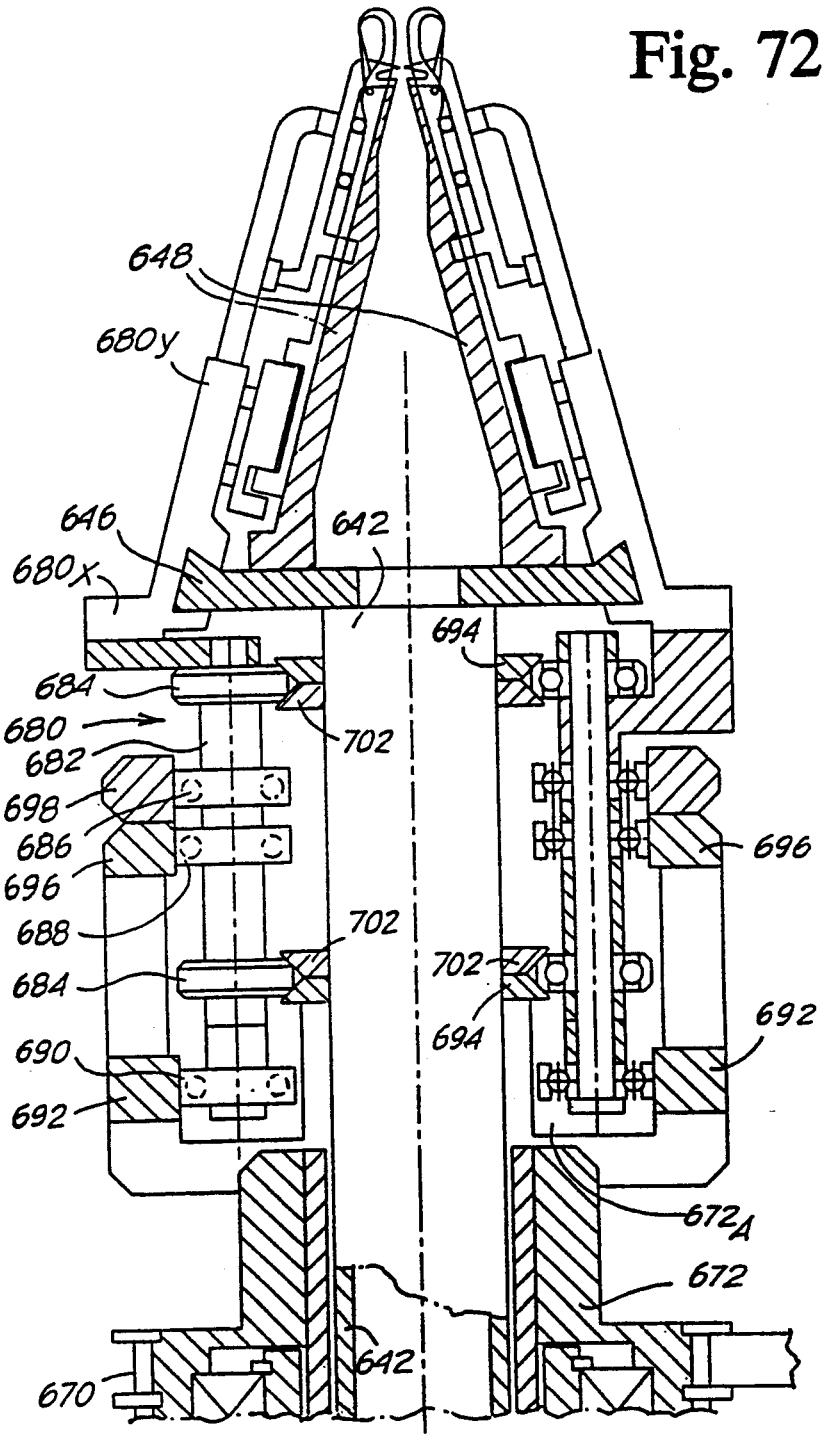

In the variant illustrated in FIGS. 57 and 58, which is otherwise entirely equivalent to the solution shown in FIGS. 52 through 56, a pneumatic tensioning system associated with the machine is shown. At the bottom ends of the hollow shafts 303, perforated portions 2303 are formed, one of which is closed while the other has a cap 2305 closing and opening its bottom. The cap 2305 is positioned in line with a suction duct 2307 opening into a casing 2309 in which said perforated portions 2303 extend. The shaft 2503 (corresponding to the shaft 503) is tubular and has a perforated zone 2503A in a position corresponding to an end collector of a suction duct 2311. A multiway valve 2313 is adapted to stabilize the suction through the displacement of its internal movable member 2315. In the setting shown in FIG. 57, the suction from the duct 2307 tensions the fabric of the two legs inside the tubular shafts 303 through the vacuum stabilized in the chamber 2309. During the formation of the body tensioning can be effected through the hollow shaft 2503, or through the tubular shaft 303 equipped with the cap 2305, while the other can be isolated from the chamber 2309. For the pneumatic removal of the finished product the cap 2305 is opened (FIG. 58) and the product is extracted through the tubular shaft 303 equipped with the cap, while the other shaft 303 and the shaft 2503 are closed or the suction in them is appropriately reduced.

Since no pantographs are provided in the embodiment illustrated in FIGS. 52 through 58 to hold the chains 310 against the guides in relation to which said chains have to slide during the rotation of the guides and needle beds, use is made of a magnetic attraction effect. As can be seen in particular in FIGS. 59 through 62, in addition to the supports 516 cooperating with the star toothings 512A, additional outer supports 520 are provided, which act on additional rollers 522 carried by the link pivot pins of the chain 310. Additional rollers 522 are disposed at two levels to cooperate with two different magnetic tracks 524 and 526. The magnetic tracks 524 are situated facing the top rollers 522 and extend on paths corresponding to the guides 301A and 301B of the plates 301, in order to exert a retaining action through the rollers 522 during the formation of the leg. The other magnetic track 526 extends so as to act along the guide profiles 330E of the connection zone formed by the slidable units 330 when the latter are brought close to one another for the formation of the complete needle bed arrangement comprising the needle beds 328 and the needle bed 332; these magnetic tracks 526 cooperate with the bottom additional rollers 522 in positions corresponding to the outer retaining supports 520. Rollers or bearings, such as 522, are also adapted to operate in positions corresponding to the supports 516 for the star-shaped members 512A. The presence of the rows of additional rollers 522 at two different levels ensures continuity of the support action for the chains, in addition to the retaining action of the magnetic attraction provided by the magnetic tracks such as 524 and 526.

In FIGS. 63 through 72 a solution is shown which is modified in relation to the preceding solutions and which can be achieved with external mechanical guides for the chains driving the carriages carrying the textile component parts cooperating with the needle beds, in place of the pantographs and magnetic systems.

A fixed base 601 has a central support 603 from which extends a central pillar 605 (free to rotate), which is adapted to support a top central plate 607 for two needle bed sections 609 intended for forming the crotch zone of the body of the product. A tubular shaft 616 is supported on the base 601 by means of a sleeve 610 and bearings 612, 614. The shaft surrounds the pillar 605 and is connected to a central plate 618 which is free to rotate about the central axis represented by the pillar 605. The plate 618, which is elongated, carries toward its ends rotational supports 620 for two corresponding arcuate arms 622 which extend on opposite sides to one another. The supports 620 hold ball bearings or other rolling support means for two respective shafts 626, which extend downward and each of which is provided with a gear 628 and a wheel 630 for a chain or for a cogged belt (or provided with gearing), the respective gears and wheels being fastened together. The two gears 628 mesh with the internal toothed rim of a ring 632 which is mounted by means of bearings 634 on the base structure 601 for rotation through the action of an external gear meshing with an external toothing 632A on the ring 632. A suitable locking means, such as a pin, can prevent the rotation of the central elongated plate 618. With the plate 618 locked in this way, the gears 628 rotate through the action of the ring 632 and bring about the rotation of the chain wheels 630.

Each of the two arcuate arms 622 at the movable end opposite the end pivoted to the respective support 620 has a support sleeve 638 in which a tubular shaft 642 is mounted by means of bearings 640. At the bottom end, each shaft 642 carries a chain wheel 644 disposed at the same level as the chain wheels 630 and connected by a chain 645 to one of the chain wheels 630, so that any rotational movement made by the gear 628 is transmitted to the shaft 642. At its top end, each shaft 642 carries an elongated plate 646 for a pair of needle beds 648 extending upward and inclined toward one another. Any movement transmitted by the kinematic chain 632, 628, 630, 645, 644 consequently brings about the rotation of the respective plate 646 fastened to the tubular shaft 642, and also of the needle beds 648 which are intended for forming each of the legs of the pantihose product. Another internal tubular shaft 652 extends inside the tubular shaft 616 and around the pillar 605, and can be caused to rotate by a gear 654 fastened to it at the bottom, receiving the movement from outside. On the top end of the tubular shaft 616 a cap member 658 is mounted by bearings 656 and is fixed to the tubular shaft 652, consequently receiving the movement from the gear 654. The cap member 658 forms two toothings 660 for two chains 662 (or cogged belts) disposed at two different levels and deflected on chain wheels 664 mounted loose on the axis of the shafts 626 at the ends of the central elongated plate 618. Each of the chain wheels 664 is fastened to a corresponding chain wheel 666 for a chain 668. The chain 668 is deflected on a chain wheel 670 composed of a star-shaped member 672, which is mounted loose—by means of a bearing 674—on the tubular shaft 642 carried by the end of the corresponding arcuate arm 622, above the support sleeve 638. At its top end the star-shaped member 672 forms a star toothing 672A for the purposes to be indicated below. Basically, each star toothing 672A is driven by means of the kinematic system receiving movement from the gear 654 and comprising the shaft 652, the chain transmissions 660, 662, 664 and the chain transmissions 666, 668, 670. This transmission is independent of the transmission by the ring 632, which supplies movement to the shafts 642 of the needle beds 648.

Each of the epicyclic units—which comprise the needle beds 648, the plate 646 and the shaft 642 which is rotatable, supported through a respective arcuate arm 622 by the central elongated plate 618—includes a length of chain 680 shaped in the manner described below, and its purpose will also be described below. Each length of chain 680 is composed of links provided with pivot pins 682 and rollers 684 at two levels, each of the rollers being shaped with annular beveled edges; the paired rollers 684 are present in each of the links of the chain 680 rollers 684 serve to guide the length of chain in multiple guides which enable the lengths of chain 680 to travel over different trajectories, one trajectory being associated with each of the respective needle beds 648, while the other trajectory is common to both the lengths of chain 680 and is associated with the set of needle beds 648, 609 and 648 when the latter are in alignment with one another and brought close together. The rollers 684 cooperate with tracks inside the trajectory of the chains, while other guide rollers 686, 688 and 690 on three different levels provide external guidance for the chains. The bottom rollers 690 also serve to cooperate with the toothings 672A of the corresponding star-shaped member 672. Shoulders 692 are provided facing the toothings 672A of the star-shaped member 672, and are adapted to ensure the engagement of the rollers 690 in the toothings 672A, the shoulders 692 preventing the rollers 690 from moving away from the teeth of the toothings 672A of the star-shaped member 672. For the internal guiding of the chains 680 during the circulation in cooperation with the needle beds 648, inclined rolling tracks 694 are provided which cooperate with the outer edges of the pairs of rollers 684 provided with beveled edges. These tracks 694 are fastened to the shaft 642 and to the plate 646 carrying the needle beds 648. For the external guidance of the chains 680, that is to say in order to prevent them from moving away from the tracks 694, a perimetral support 696 is provided, which extends over the two rectilinear lengths and over a connecting length which is external in the body forming mode, the support 696 cooperating with the rollers 688. In order to supplement the external supports 696, arcuate supports 698 are provided, which are pivoted at 700 on the ends of the supports 696, in such a manner that the external support 696 can be supplemented by the arcuate supports 698 when the latter are closed toward one another and toward the track 694. The trajectory of the corresponding chain around the pair of needle beds 648 is thus completed. When the two arcuate supports 698 are moved away from one another it is possible to allow rectilinear sliding as a continuation of the rectilinear lengths of the supports 696. The supports 696 cooperate with the rollers 688, while the arcuate supports 698 articulated at 700 cooperate with the rollers 686. When, in the manner indicated below, the needle beds 648 are aligned with the intermediate needle bed section 609 for the formation of the body, the guides for the lengths of chain are supplemented on the inside by a pair of guide profiles 702 which are adapted to cooperate with the inside beveled edges of the pairs of bevel-edged rollers 684. In the intermediate portion an equivalent number of internal guides carried by the plate 607 of the intermediate needle bed sections 609 correspond to these internal guides 702. For external guidance extensions 696A of the supports 696 are provided and come into operation when the chain lengths 680 are not deflected by the arcuate supports 698.

Guidance of the chain lengths 680 is in all cases ensured both on the paths around the plates 646 of the needle beds 648, and of the path along the aligned needle beds 648, 609, 648 when the latter are brought close to one another.

For the formation of the legs use is made of only the pairs of needle beds 648, which are moved away from one another by the movement away from one another of the tubular shafts 642 through the action of the arcuate arms 622. During the formation of the legs of the tights or pantihose the gears 628 receive the movement from the ring 632, while the central elongated plate 618 is locked, and this movement is transmitted through the chain wheels 630, the chains 645 and the chain wheels 644 to the respective shafts 642 for the purpose of rotating the needle beds about the vertical axes of said tubular shafts 642. During this phase the movement of the wheel 654 is transmitted through the gear 654, the tubular shaft 652, the cap member 658 provided with the toothings 660, the chains 662, the toothed wheels 664, 666 and the chains 668 to the cap members 672 and to the star toothings 672A, which impart a relative movement to the chain lengths 680 along the tracks 694 and the supports 696 and 698, in such a manner that the needle beds 648 rotate and the chain lengths 680 remain substantially in the same orientation in space, so that there is a relative sliding of the chains 680 relative to the needle beds 648. However, it is the needle beds which rotate and the chains which do not rotate and they consequently can allow the feeding of yarn from fixed positions to the sets of textile component parts, that are carried by said chains 680, in particular by shoes 680X and by respective extensions 680Y which are equipped with the cams for controlling the needles and the thread guides for feeding the threads.

When the operations of knitting the body have to be carried out after the legs have been knitted, the two needle beds 648, carried by the plates 646 and rotated by the shafts 642, are brought toward one another through the action of the angular displacement of the arcuate arms 622, until said needle beds are brought into alignment with the central pillar 605. The arcuate supports 698 are rotated about the axes 700 in the outward direction relative to one another, so that the ends 696A of the rectilinear supports 696 remain active. When the two units comprising the needle beds 648 are brought close to one another, the ends 696A come into alignment with each other and are centered relative to the pillar 605, which participates in the alignment of the needle beds 648 with one another and with the intermediate needle bed section 609. The internal guides 702, provided with concave profiles, participate in this. In these circumstances the two shafts 642 are prevented from rotating by mutual opposition of the units of the needle beds 648 and connection to the pillar 605. Rotation of the gears 628 is also prevented. The central elongated plate 618 is at this point released and the rotation of the ring 632 then brings about the direct driving of the gears 628 without their rolling on the internal toothing of said ring, and the ring 632 effects the rotational driving of the plate 618 and therefore of the shafts 642 conjointly, without their rotation, the chains driven by the gears 628 being locked. Conversely, the movement received from the gear 654 is still transmitted to the cap member 658 and to the star-shaped members 672, 672A, which remain responsible for retaining the chain lengths 680 in a position substantially fixed in space, while the set of needle beds 648, 609, 648 rotates about the axis of the pillar 605. In order to stabilize the holding in position of the chains 680, a transmission is provided which has a suitably modified ratio relative to the transmission used during the formation of the legs, for the rotation of the needle beds 648 independently of one another. In this phase the two star-shaped members 672, 672A intervene in succession on the lengths of chain which slide relative to the guide tracks and to the guide supports already described for the trajectories along the set of needle beds 648, 609, 648, each of the star-shaped members ensuring the engagement of the chain at least at one point during the entire trajectory on which the chains have to travel in the respective tracks.

The control of the angle of the arms 622 about the pivot pins 626 is effected by means of actuators (not shown) and in accordance with the predetermined program for the control of the various parts of the machine during the various phases of a working cycle. This program will be able to control transmission to the star-shaped members 672, 672A in order to carry out in each working phase the task of retaining the chain lengths which must travel over the two different trajectories around the needle beds 648 and around the set of needle beds 648, 609, 648 respectively.

It is understood that the drawing shows only an exemplification, which is given solely as a practical demonstration of the invention, while the latter may vary in respect of shapes and arrangements without thereby departing from the scope of the underlying concept of the invention. The presence of reference numerals in the following claims is intended to facilitate the reading of the latter by reference to the description and the drawings, and does not limit the scope of the protection provided by said claims.

I claim:

1. Knitting machine for producing stocking-knicker products, the machine comprising: substantially parallel rectilinear needle beds convergent in a working zone; a rotatable central unit having a central vertical shaft and carrying a plate having a double rectilinear needle bed central segment; two epicyclic units mounted substantially symmetrically on said central unit with shafts offset relative to the central shaft, each of said epicyclic units carrying an elongated plate having a double rectilinear needle bed; annular guide means along each elongated plate, for guiding carriages holding textile component parts, said textile component parts including cam means and thread guide means for cooperating with the respective double rectilinear needle bed and for the knitting of the legs while the central unit is stationary; supplementary guide means corresponding to the double needle bed central segment for the purpose of completing the guiding of said carriages around the two double rectilinear needle beds and the double needle bed central segment when they are in alignment with one another on said central unit, for the knitting of the body by rotation of the entire central unit; a transmission means for the rotation of said central unit and addition transmission means for the rotation of said epicyclic units; and means for holding the carriages in a substantially fixed position in relation to the rotation epicyclic units and in relation to the rotating epicyclic units and in relation to the rotating central unit.

2. Machine as claimed in claim 1, wherein: said offset shafts of the epicyclic units are tubular and are combined with a pneumatic suction duct for pneumatic tensioning of the product being formed; and door means connected to said suction duct excluding one of said tubular shafts from the pneumatic suction for pneumatic discharge of the finished product.

3. Machine as claimed in claim 1, further comprising: a drive ring having an internal toothing and rotating coaxially to the central shaft; an epicyclic gear on each of said offset shafts of the epicyclic units and meshing with said internal toothing of the drive ring; means for temporarily locking said central unit in order to bring about the rotation of the epicyclic units with the double needle beds; and means for permitting the rotation of the central unit and of the double needle beds in alignment.

4. Machine as claimed in claim 1, further comprising: a first endless chain on each of the two epicyclic units extending in correspondence with the guide means along the elongated plate; a second endless chain on the central unit extending in correspondence with the guide means on the elongated plates and with the supplementary guide means of the central plate, when said plates are aligned with each other; pin means on said carriages for engagement with one or the other of said first and second chains in order to drive said carriages; and means for holding said chains and therefore the carriages in said substantially fixed position in relation to the rotating epicyclic units and in relation to the rotating central unit.

5. Machine as claimed in claim 1, wherein: said annular guide means are internal guide means which cooperate with lengths of chain engaging the carriages; supplementary internal guide means are carried by units slidable on said epicyclic units in order to be brought close to one another when the double needle beds are in alignment with one another, in order to complete slide guides for the lengths of chain and the appertaining carriages; said lengths of chain including a series of rollers for cooperation with said internal guide means; and means for holding said lengths of chain against said internal guide means during the rotation of the epicyclic units and of the central unit.

6. Machine as claimed in claim 5, further comprising: drive means for moving said slidable units toward one another and completing the guide means along all the double needle beds in alignment, and for moving said slidable units away from one another and bringing into operation the guide means along the double needle beds of the epicyclic units.

7. Machine as claimed in claim 6, wherein: said drive means includes resilient pins means carries by said slidable units and for cooperating with profiled slots for locking said slidable units.

8. Machine as claimed in claim 5, wherein: said means for holding the lengths of chain include single pantograph joints or double pantograph joints engaging ends of the lengths of chain and driven by positive drive means including cams or servomotors, or partly by positive drive means against an antagonistic resilient action.

9. Machine as claimed in claim 8, wherein: the positively driven pantograph joints also act by thrust on the epicyclic units and on the central unit to bring about the rotation thereof.

10. Machine as claimed in claim 8, further comprising, two different positive drive means for driving the pantograph joints, and brought into action alternately to act during a phase of independent rotation of the epicyclic units and during a phase of conjoint rotation of all the double needle beds in alignment and fastened to the central unit.

11. Machine as claimed in claim 5, wherein: said means for holding the lengths of chain include magnetic track means for attracting said lengths of chain against said internal guides by magnetism.

12. Machine as claimed in claim 5, wherein: said means for holding the lengths of chain include external supports cooperating with components of the links of the lengths of chain; and that symmetrical portions of said supports are pivoted on pins and are brought close to one another to complete the guide means along the double needle beds of the epicyclic units and are moved away from each other to permit the guiding of the lengths of chain along the double needle beds in alignment with one another.

13. Machine as claimed in claim 5, further comprising: a movement transmission means having components coaxial to the central shaft of the central unit and having components on the offset shafts of the epicyclic units for engaging the lengths of chain with star-shaped members in order to hold said lengths of chain during the rotation of the epicyclic units separately from one another and during the conjoint rotation of the central unit and the needle beds aligned with one another.

14. Machine as claimed in claim 1, further comprising: arms pivoted by pivot pins on the central unit at a distance spaced from the central axis, at the free end of each of said arms is mounted a respective offset shaft of an epicyclic unit to enable said epicyclic units to be brought close to an moved away from the axis of the central unit.

15. Machine as claimed in claim 14, further comprising: first and second transmissions, each having components on the pivot pins of the arms, for transmitting rotational movement to the epicyclic units and to the star-shaped toothed members which control the lengths of chain of the carriages of the textile components cooperating with the needle beds.

* * * * *